US007662533B2

(12) United States Patent
Ohshima et al.

(10) Patent No.: US 7,662,533 B2
(45) Date of Patent: Feb. 16, 2010

(54) IMAGE FORMING METHOD, AND IMAGE FORMING APPARATUS AND PROCESS CARTRIDGE USING THE IMAGE FORMING METHOD

(75) Inventors: Kohichi Ohshima, Mishima (JP); Yasuo Suzuki, Fuji (JP); Tetsuro Suzuki, Fuji (JP); Michitaka Sasaki, Chiba (JP)

(73) Assignee: Ricoh Company Limited, Tokyo (JP)

( * ) Notice: Subject to any disclaimer, the term of this patent is extended or adjusted under 35 U.S.C. 154(b) by 578 days.

(21) Appl. No.: 11/165,279

(22) Filed: Jun. 24, 2005

(65) Prior Publication Data

US 2005/0287465 A1 Dec. 29, 2005

(30) Foreign Application Priority Data

Jun. 25, 2004 (JP) ..... 2004-188616

(51) Int. Cl.
*G03G 15/20* (2006.01)

(52) U.S. Cl. ..... 430/124.1; 430/58.05; 430/58.7; 399/159

(58) Field of Classification Search ..... 430/124.1, 430/58.05, 58.7; 399/159
See application file for complete search history.

(56) References Cited

U.S. PATENT DOCUMENTS 5,492,784 A 2/1996 Yoshikawa et al.
5,578,405 A 11/1996 Ikegami et al.
5,665,500 A 9/1997 Suzuki
5,871,876 A 2/1999 Ikuno et al.
5,928,828 A 7/1999 Suzuki
6,026,262 A 2/2000 Kinoshita et al.
6,030,733 A 2/2000 Kami et al.

(Continued)

FOREIGN PATENT DOCUMENTS

JP 56-48637 5/1981

(Continued)

OTHER PUBLICATIONS

U.S. Appl. No. 11/218,657, filed Sep. 6, 2005, Suzuki, et al.

(Continued)

*Primary Examiner*—Mark F Huff
*Assistant Examiner*—Rachel L Burney
(74) *Attorney, Agent, or Firm*—Oblon, Spivak, McClelland, Maier & Neustadt, L.L.P.

(57) ABSTRACT

An image forming method including: forming an electrostatic latent image on an image bearing member; developing the latent image with a toner; transferring the toner image onto a receiving material; and fixing the toner image. The image bearing member includes a substrate, and a charge generation layer, a charge transport layer and a crosslinked charge transport layer, wherein the crosslinked charge transport layer includes a compound obtained from radical polymerizable monomers including a monomer having three or more functional groups and no charge transport structure and a monomer having one functional group and a charge transport structure. The toner includes a binder resin, a colorant, and a release agent, wherein tetrahydrofuran-soluble components of the binder resin have a molecular weight distribution such that at least one peak is observed in a range of from 1,000 to 10,000 and the half-width of the molecular weight distribution curve is not greater than 15,000.

22 Claims, 7 Drawing Sheets

U.S. PATENT DOCUMENTS

| | | | | |
|---|---|---|---|---|
| 6,066,428 | A | 5/2000 | Katayama et al. | |
| 6,136,483 | A | 10/2000 | Suzuki et al. | |
| 6,151,468 | A | 11/2000 | Kami et al. | |
| 6,194,535 | B1 | 2/2001 | Katayama et al. | |
| 6,210,848 | B1 | 4/2001 | Nagai et al. | |
| 6,335,137 | B1 * | 1/2002 | Suzuki et al. | 430/110.1 |
| 6,416,915 | B1 * | 7/2002 | Kikuchi et al. | 430/56 |
| 6,819,892 | B2 | 11/2004 | Nakazato et al. | |
| 6,861,188 | B2 | 3/2005 | Ikegami et al. | |
| 6,899,983 | B2 | 5/2005 | Tamoto et al. | |
| 2003/0077531 | A1 | 4/2003 | Suzuki et al. | |
| 2004/0053152 | A1 | 3/2004 | Nagai et al. | |
| 2004/0126687 | A1 | 7/2004 | Ikegami et al. | |
| 2004/0170911 | A1 | 9/2004 | Shimada | |
| 2004/0180280 | A1 | 9/2004 | Ikegami et al. | |
| 2004/0248024 | A1 | 12/2004 | Suzuki et al. | |
| 2004/0253527 | A1 | 12/2004 | Suzuki et al. | |
| 2005/0008957 | A1 | 1/2005 | Ikegami et al. | |

FOREIGN PATENT DOCUMENTS

| | | |
|---|---|---|
| JP | 60-32060 | 2/1985 |
| JP | 60-90344 | 5/1985 |
| JP | 60-136752 | 7/1985 |
| JP | 60-186854 | 9/1985 |
| JP | 60-186859 | 9/1985 |
| JP | 60-186864 | 9/1985 |
| JP | 60-186866 | 9/1985 |
| JP | 64-1728 | 1/1989 |
| JP | 2-167561 | 6/1990 |
| JP | 2-45188 | 10/1990 |
| JP | 3-229264 | 10/1991 |
| JP | 4-281461 | 10/1992 |
| JP | 6-118681 | 4/1994 |
| JP | 9-96923 | 4/1997 |
| JP | 9-124943 | 5/1997 |
| JP | 9-190004 | 7/1997 |
| JP | 2000-66425 | 3/2000 |
| JP | 2000-338718 | 12/2000 |
| JP | 3194392 | 6/2001 |
| JP | 3262488 | 12/2001 |
| JP | 2002-251032 | 9/2002 |

OTHER PUBLICATIONS

U.S. Appl. No. 11/261,751, filed Oct. 31, 2005, Ohshima et al.
U.S. Appl. No. 11/332,545, filed Jan. 17, 2006, Tamoto, et al.
U.S. Appl. No. 11/367,786, filed Mar. 6, 2006, Ohta, et al.
U.S. Appl. No. 11/480,517, filed Jul. 5, 2006, Yanagawa, et al.
U.S. Appl. No. 11/500,352, filed Aug. 8, 2006, Toshine, et al.
U.S. Appl. No. 11/563,710, filed Nov. 28, 2006, Inaba, et al.
U.S. Appl. No. 11/616,523, filed Dec. 27, 2006, Fujiwara, et al.
U.S. Appl. No. 11/621,805, filed Jan. 10, 2007, Suzuki, et al.
U.S. Appl. No. 11/684,520, filed Mar. 9, 2007, Toshine, et al.
U.S. Appl. No. 11/685,441, filed Mar. 13, 2007, Yanagawa, et al.
U.S. Appl. No. 11/692,682, filed Mar. 28, 2007, Mori, et al.
U.S. Appl. No. 12/035,016, filed Feb. 21, 2008, Iwamoto, et al.
U.S. Appl. No. 12/047,011, filed Mar. 12, 2008, Kami, et al.
U.S. Appl. No. 12/000,239, filed Dec. 11, 2007, Fujiwara, et al.

* cited by examiner

IMAGE FORMING METHOD, AND IMAGE FORMING APPARATUS AND PROCESS CARTRIDGE USING THE IMAGE FORMING METHOD

BACKGROUND OF THE INVENTION

1. Field of the Invention

The present invention relates to an image forming method for use in electrophotography, electrostatic recording and electrostatic printing. In addition, the present invention also relates to an image forming apparatus and a process cartridge using the image forming method.

2. Discussion of the Background

Image forming methods in which an electrostatic latent image formed on an image bearing member (such as photoreceptors and dielectric materials) using electrophotography, electrostatic recording and electroprinting is developed with a developer including a toner have been widely used for copiers, printers and facsimile machines.

Electrophotographic image forming methods typically include the following processes:

(1) an image bearing member (such as photoreceptors) is charged with a charger (charging process);

(2) the charged image bearing member is exposed to image-wise light to form an electrostatic latent image on the image bearing member (electrostatic latent image forming process);

(3) the electrostatic latent image is developed with a developer including a charged toner to form a visual toner image on the image bearing member (developing process);

(4) the toner image is transferred onto a receiving material optionally via an intermediate transfer medium (transfer process); and (5) the toner image on the receiving material is fixed upon application of heat and/or pressure thereto, resulting in production of a hard copy (fixing process).

When developing an electrostatic latent image with a dry developer, cascade developing methods, magnetic brush developing methods, and powder cloud developing methods have been used. These methods typically use a dry toner in which a colorant such as carbon blacks is dispersed in a binder resin.

As for the fixing method, heat fixing methods using a heat roller are widely used because of having a high energy efficiency. Recently, in order to save energy, toner images are fixed at a relatively low temperature and therefore the heat energy applied to toner images becomes smaller and smaller particularly in high speed image forming methods. Therefore, it has been attempted to perform a heat fixing operation while reducing the heating energy applied to toner images.

In addition, in order to protect environment, it is needed to decrease the warm-up time of image forming apparatus and the electric power consumption of the apparatus in a waiting state. Requirements for next generation image forming apparatuses are described in the DSM (Demand-side Management) program of IEA (International Energy Agency). There are several requirements therein such that the warm-up time should be not greater than 10 seconds and the power consumption in a waiting state should be not greater than 10 to 30 watt (which changes depending on the copying speed) in copiers having a copy speed not less than 30 cpm (copies per minutes). In order to fulfill these requirements, the power consumption of copiers must be dramatically reduced.

In attempting to fulfill the requirements, a method which uses a fixing member (such as heat rollers) having a low heat capacity or a toner having improved temperature response is proposed. However, the method is not fully satisfactory. In order to fulfill the requirements and shorten the waiting time, it is necessary to lower the fixing temperature while decreasing the minimum fixable temperature of the toner used. Specifically, it is necessary to lower the fixing temperature by about 20° C. compared to a case where a conventional toner having a low fixable temperature is used. This requirement cannot be fulfilled by a combination of conventional techniques, and it is necessary to develop an advanced technique.

When it is attempted to decrease the low temperature fixability of a toner, the fixable temperature range of the toner is typically narrowed and the high temperature. preservability of the toner deteriorates. For example, published unexamined Japanese patent applications Nos. (hereinafter referred to as JP-A) 60-90344 and 03-229264 have disclosed techniques in that a resin or a wax having a low softening point is included in a toner to improve the low temperature fixability of the toner. However, such toners cause a blocking problem in that toner particles are adhered to each other when heated in the image forming apparatus for which the toner is used or when preserved at a relatively high temperature. In addition, such toners have a narrower fixable temperature range than other conventional toners. Therefore, a toner having a wide fixable temperature range and high temperature preservability has not yet obtained.

Recently, a need for high quality copy images increases more and more. Toner having a volume average particle diameter of from 10 to 15 μm cannot fulfill this need, and therefore a need exists for a toner having a smaller particle diameter. However, as the particle diameter of toner decreases, the amount of toner particles constituting a half tone image decreases (i.e., the height of a half tone toner image decreases) and therefore the amount of heat applied to a half tone toner image formed on a recessed portion of a receiving material (such as papers) seriously decreases, resulting in occurrence of problems such as offset problems.

In addition, toner is required to have not only a good combination of electrostatic, thermal, mechanical and chemical properties but also good powder properties such as good fluidity, good blocking resistance and narrow particle diameter distribution. Therefore, toner typically includes a variety of additives.

Among the drawbacks of conventional low temperature fixable toner, the problem in that external additives of the toner which are added to improve the fluidity of the toner are embedded into or released from the toner particles is serious. The reason for occurrence of such a problem is that a binder resin having a low softening point is used for such a low temperature fixable toner. In attempting to improve the fluidity of a toner (i.e., to improve the feedability and charging properties of a toner), the following methods have been disclosed:

(1) methods in which a particulate inorganic material having an average particle diameter of from about 5 to about 100 nm is added to a toner;

(2) methods in which a particulate inorganic material having an average particle diameter of from about 0.5 to about 5 μm is added to a toner to improve cleanability of the toner (which have been disclosed in JP-As 60-136752 and 60-32060); and (3) methods in which a particulate organic material having an average particle diameter of from about 0.05 to about 5 μm is added to a toner (which have been disclosed in JP-As 60-186854, 60-186859, 60-186864 and 60-186866).

However, toners including such a particulate inorganic material or a particulate organic material as an external additive typically cause a problem in that the particulate material is released from or embedded into toner particles as the number of produced copies increases. When such a problem occurs, the fluidity and charging property of the toner (i.e., main properties of electrophotographic toner) deteriorate. In particular, an external additive released from toner particles often scratches the surface of the photoreceptor used, resulting in occurrence of a problem in that an undesired image having a rice-fish form which is illustrated in FIG. 1 is produced. This rice-fish form image is sometimes referred to as a (white) streak image.

In attempting to solve the streak image problem, the following methods have been proposed:

(1) a method using inorganic oxides having a relatively large particle diameter of from 150 nm to 5 μm as an external additive (disclosed in published examined Japanese patent application No. 02-45188); and (2) a method in which a silica is fixed on a surface of a toner (disclosed in JP-A02-167561).

However, the method (1) has a drawback in that the external additive is released from the toner as the number of copies increases because the adhesion of the external additive to the toner is weak. The method (2) has a drawback in that embedding of the silica into the toner particles is accelerated.

In attempting to prevent release of an external additive from toner particles, JP-A 09-96923 discloses a method in which two kinds of particulate hydrophobic metal oxides are mixed with a toner to prepare a toner, on the surface of which the particulate hydrophobic metal oxides are uniformly adhered. However, in order to fixedly adhere the metal oxides to the toner, a strong force has to be applied when the metal oxides are mixed with the toner in a mixer, and thereby the metal oxides tend to be embedded into the toner particles. Therefore, the desired effect cannot be produced.

In addition, in order to prevent formation of streak images, JP-A 2000-338718 discloses a method in which a resin including no tetrahydrofuran-insoluble components and having a specific GPC molecular weight distribution, wherein components having a molecular weight in a range from $1\times10^5$ to $1\times10^7$ have a specific dynamic viscoelasticity G'. The streak image problem cannot be fully solved by this technique when a large number (100,000 or more) of copies are produced.

On the other hand, a photoreceptor including an organic photosensitive material is typically used as an image bearing member of electrophotographic image forming apparatus. Such an organic photoreceptor is typically prepared by a method in which a charge generation layer is formed on an electroconductive substrate by depositing an organic charge generation material or coating a coating liquid including a charge generation material dispersed in a binder resin solution, and then a charge transport layer is formed on the charge generation layer by coating a coating liquid including a charge transport material dispersed in a binder resin solution.

The thus prepared organic photoreceptors have the following advantages over other photoreceptors:

(1) various materials having a sensitivity to a specific wavelength range corresponding to the light emitted by light irradiators such as visible light or infrared light have been developed;

(2) environment-friendly materials can be used; and (3) the manufacturing cost is relatively low.

However, the organic photoreceptors have a drawback of having a low mechanical strength.

As mentioned above, a photoreceptor is typically subjected to charging, light irradiation, developing, and transferring processes. When a toner image formed on a photoreceptor is transferred on a receiving material or an intermediate transfer medium, all the particles of the toner image are not transferred, and part of the toner particles remains on the surface of the photoreceptor without being transferred. The residual toner particles are typically removed from the photoreceptor by a cleaner such as fur brushes, magnetic brushes and blades. Among these cleaners, blades made of a rubber plate are typically used as a cleaner. Thus, external forces are applied to a photoreceptor in the charging, developing, transferring and cleaning processes. Therefore, the photoreceptor has to have good durability. In particular, the photoreceptor is requested to have such a good mechanical durability as not to be damaged (scratched) even when rubbed with a charger, a developer, a cleaner or when a jammed paper is removed while rubbing the surface of the photoreceptor. In addition, as image forming apparatus are downsized, the diameter of the photoreceptors used becomes smaller and smaller. Further, a need exists for high speed and maintenance-free image forming apparatus. Therefore a need for a photoreceptor having excellent durability increases more and more.

Organic photoreceptors have a low chemical stability. In addition, photosensitive layers including a low molecular weight charge transport material and an inactive polymer as main components are generally soft. When such photosensitive layers are repeatedly used for forming images, the surface of the photoreceptors is easily abraded due to the mechanical stresses applied by developing members and cleaners. In addition, the pressure and hardness of a cleaner is increased more and more in order that toner particles having a relatively small particle diameter, which are used for forming high quality images, can be well removed from the surface of a photoreceptor. Therefore, abrasion of the surface of a photoreceptor is accelerated. When the surface of a photoreceptor is abraded, the physical properties such as photosensitivity and chargeability of the photoreceptor deteriorate, resulting in formation of undesired images such as images having low image density and/or background fouling. Further, toner particles remaining on a scratch formed on a surface of a photoreceptor cause an undesired streak image. At the present time, a photoreceptor is often replaced with a new photoreceptor before expiration of its life due to formation of a scratch thereon or serious abrasion of the surface thereof.

In attempting to fulfill the requirements mentioned above (or to solve the problems mentioned above), various proposals have been made. With respect to mechanical durability, a method in which a bisphenol Z-form polycarbonate resin is used as a binder resin of an outermost layer is proposed to improve the abrasion resistance and to prevent formation of a toner film on the surface of the outermost layer. In addition, JP-A 06-118681 discloses a photoreceptor having an outermost layer including a crosslinked silicone resin containing a colloidal silica.

However, the former technique has a drawback in that the abrasion resistance of the resultant photoreceptor is not sufficient. In contrast, the latter technique has a drawback in that the electrophotographic properties of the resultant photoreceptor are not satisfactory (i.e., background fouling and/or blurred images are formed), although the outermost layer has good abrasion resistance.

In attempting to remedy the drawbacks, photoreceptors in which a crosslinkable organic silicone polymer bonded with a silicon-modified positive hole transport compound is used for the outermost layer thereof have been proposed by JP-As 09-124943 and 09-190004. However, the photoreceptors have a drawback in that since the crosslinked outermost layer is hardly abraded, water adsorbed on the surface thereof under high humidity conditions cannot be removed, resulting in formation of blurred images. In addition, a problem in that a film of paper dust and/or toner is formed on the surface of the outermost layer, resulting in formation of undesired images such as spot images and streak images tends to occur.

Therefore, in order to prepare a photoreceptor having excellent durability, it is a serious problem to be solved in the electrophotographic field to reduce the abrasion loss of the surface of the photoreceptor. In attempting to solve the abrasion problem, the following photoreceptors have been proposed:

(1) a photoreceptor having a crosslinked charge transport layer which is prepared by crosslinking a crosslinkable binder resin (JP-A 56-48637);
(2) a photoreceptor using a charge transport polymer (JP-A 64-1728; and
(3) a photoreceptor having a crosslinked charge transport layer in which an inorganic filler is dispersed (JP-A 04-281461).

The photoreceptor (1) mentioned above has a drawback of having a high residual potential (i.e., the potential of a lighted portion of the photoreceptor is high), resulting in decrease of image density. This is because a charge transport material generally has poor compatibility with a crosslinked resin, resulting in uneven distribution of the charge transport material; and impurities included in the charge transport layer such as polymerization initiators and non-reacted functional groups increase the residual potential.

The photoreceptor (2) has a drawback of having insufficient abrasion resistance, i.e., the photoreceptor cannot fulfill the abrasion resistance requirement for photoreceptors. In addition, it is difficult to prepare a charge transport polymer having a high purity, and to control the polymerization and refinement processes in manufacturing the polymer, and thereby a charge transport layer having desired electric properties cannot be stably produced. Further, since the coating liquid typically has a high viscosity, it is difficult to stably manufacture the desired photoreceptor.

The photoreceptor (3) has better abrasion resistance than photoreceptors having a photosensitive layer in which a low molecular weight charge transport material is dispersed in an inactive polymer. However, the photoreceptor has a high residual potential because charge traps are present on the surface of particles of the inorganic filler. Therefore, the resultant images have a low image density. In addition, when the surface of the charge transport layer including an inorganic filler is rough, a cleaning problem in that toner particles remaining on the surface of the photoreceptor cannot be well removed occurs, resulting in occurrence of the toner filming problem and the blurred image problem.

Thus, the photoreceptors (1)-(3) cannot fulfill the durability requirements (i.e., a combination of electric durability and mechanical durability).

In attempting to solve the abrasion resistance and scratch resistance, Japanese Patent No. (hereinafter referred to as JP) 3,262,488 discloses a photoreceptor having a crosslinked protective layer obtained from a poly-functional acrylate monomer. Although there is a description in the patent that the protective layer can include a charge transport material, there is no specific description concerning details of the charge transport material to be included therein. As a result of the present inventors' experiment, it is found that a low molecular weight charge transport material is not well dispersed in such a crosslinked acrylic protective layer, resulting in precipitation of the charge transport material, and thereby the residual potential of the photoreceptor is increased. Therefore, the resultant photoreceptor produces low density images while having a low mechanical strength. In addition, since the protective layer is prepared by reacting the acrylic monomer in a film including a binder resin, a desired three-dimensional network cannot be formed (i.e., the density of crosslinking bonds (hereinafter crosslinking density) is low), and therefore good abrasion resistance cannot be imparted to the photoreceptor.

Further, in attempting to solve the abrasion resistance, Japanese Patent No. 3,194,392 discloses a photoreceptor having a charge transport layer which is prepared using a coating liquid including a monomer having a C═C double bond, a charge transport material having a C═C double bond and a binder resin. In this charge transport layer, the binder resin is considered to improve the adhesion of the crosslinked charge transport layer to the charge generation layer located below the charge transport layer, and to relax the internal stress of the charge transport layer when the layer is crosslinked. As the binder resin, resins having a C═C double bond, which have reactivity with the charge transport material, and other resins having no C═C double bond, which have no reactivity with the charge transport material, can be used. When a resin having no C═C double bond is used, the resin has poor compatibility with a reaction product of the monomer with the charge transport material, and thereby the charge transport layer causes a phase separation problem. Therefore, problems in that the surface of the photoreceptor is scratched, and a film of toner and/or paper dust is formed on the surface thereof occur. In addition, this charge transport layer has a low crosslinking density similarly to the case of the photoreceptor of JP 3,262,488 mentioned above. In addition, difunctional monomers are used as specific examples in JP 3,194,392. In this case, the resultant photoreceptor has insufficient abrasion resistance. In addition, when a binder having a reactivity is used and the molecular weight of the crosslinked layer increases, the layer has low crosslinking density. Namely, it is difficult to prepare a layer having-a combination of high charge transport material bonding density and high crosslinking density. Therefore, it is difficult to impart a good combination of electric properties and abrasion resistance to the photoreceptor.

JP-A 2000-66425 discloses a photoreceptor having a photosensitive layer which is prepared by crosslinking a positive hole transport compound having two or more chain polymerization functional groups in a molecule. The photosensitive layer has a high hardness because of having a high crosslinking density. However, since the positive hole transport compound is bulky and has two or more chain polymerization functional groups, the crosslinked layer tends to be distorted, resulting in increase of stress in the layer. Therefore, a problem in that the crosslinked layer causes cracks and/or peeling occurs when the photoreceptor is repeatedly used for a long period of time.

Thus, the above-mentioned photoreceptors having a crosslinked charge transport layer having a charge transport structure are not satisfactory.

JP-A 2002-251032 discloses a photoreceptor which hardly causes the streak image problem even when a low temperature fixable toner is used in combination therewith. The photoreceptor has an outermost layer including a particulate alumina (i.e., an inorganic filler) and a tetrafluoroethylene powder (i.e., an organic filler) to improve the mechanical strength of the surface of the photoreceptor and to decrease the friction coefficient of the surface. However, when an inorganic filler is included in an outermost layer, a problem in that a silica, which is used as an external additive and which is hard, sticks in a binder resin, which is located between a filler particle and another filler particle in the surface portion of the outermost layer and which is soft. This often results in occurrence of the streak image problem. When the filler content of the outermost layer is increased to solve the problem, the layer becomes brittle, resulting in deterioration of the mechanical properties of the layer. In addition, the layer has poor electric properties because of having a high residual potential due to the inorganic filler. In this case, when the photoreceptor is repeatedly used, the filler particles in the surface portion are exposed without covered with a binder resin and thereby a problem in that undesired black spot images are produced is caused.

As mentioned above, a photoreceptor having a good combination of low temperature fixability and durability (i.e., electric durability, mechanical durability and chemical durabililty) has not yet developed. Therefore, an image forming apparatus (or method) which fulfills the energy saving requirement and which is so durable as to be able to produce images with hardly replacing the image bearing member is not yet developed.

SUMMARY OF THE INVENTION

Accordingly, an object of the present invention is to provide an image forming method, an image forming apparatus and a process cartridge by which high quality images can be produced without causing undesired images such as streak images, black spot images and blurred images even when images are produced for a long period of time or even when images are produced under high temperature and high humidity conditions.

Briefly this object and other objects of the present invention as hereinafter will become more readily apparent can be attained by an image forming method including:

forming an electrostatic latent image on an image bearing member;

developing the electrostatic latent image with a developer including a toner to form a toner image on the image bearing member;

transferring the toner image onto a receiving material; and fixing the toner image on the receiving material, wherein the image bearing member includes a substrate, and a charge generation layer, a charge transport layer and a crosslinked charge transport layer, which are located overlying the substrate in this order, wherein the crosslinked charge transport layer includes a compound obtained by polymerizing radical polymerizable monomers including a first monomer having three or more radical polymerizable functional groups and no charge transport structure and a second monomer having one radical polymerizable functional group and a charge transport structure, and wherein the toner includes at least a binder resin, a colorant, and a release agent, wherein tetrahydrofuran(THF)-soluble components included in the binder resin have a molecular weight distribution such that at least one peak is observed in a range of from 1,000 to 10,000 and the half-width of the molecular weight distribution curve is not greater than 15,000, and preferably not greater than 10,000, when the molecular weight distribution is determined by gel permeation chromatography.

The thickness of the crosslinked charge transport layer is preferably from 2 to 8 μm.

Each of the first and second monomers preferably has at least one of an acryloyloxy group and a methacryloyloxy group as the radical polymerizable functional group.

The THF-soluble components include components having a molecular weight not less than $10^5$ in an amount not greater than 10% by weight.

The binder resin of the toner preferably includes a polyester resin which preferably has an acid value of from 8 to 45 mgKOH/g, and a hydroxyl value not greater than 50 mgKOH/g.

It is preferable that the weight of chloroform-insoluble components included in the binder resin is less than that of chloroform-soluble components included therein. The content of chloroform-insoluble components is preferably from 5 to 40% by weight based on the weight of the binder resin. It is preferable that the binder resin has an island-sea structure such that a first resin component is dispersed as islands in a sea of a second resin component wherein the first resin component has a higher molecular weight than the second resin component.

It is preferable that the binder resin includes at least two resins, wherein the softening point of one of the two resins is not less than 25° C. higher than that of the other of the two resins. Each of the two resins preferably includes components having a molecular weight of not less than $10^5$ in an amount of not greater than 10% by weight. It is preferable that the content of chloroform-insoluble components included in one of the two resins, which has a higher softening point, is preferably higher than the content of chloroform-soluble components in the resin. The content of chloroform-insoluble components in the binder resin having a higher softening point is preferably from 5 to 40% by weight based on the weight of the binder resin. Each of the two resins is preferably a polyester resin.

It is preferable that one of the two polyester resins is obtained from monomers including a first polybasic carboxylic acid selected from the group consisting of benzenecarboxylic acids, benzenecarboxylic acid anhydrides, unsaturated dicarboxylic acids and unsaturated dicarboxylic acid anhydrides while having a softening point of from 120 to 160° C., and the other resin is obtained from monomers including a second polybasic carboxylic acid which is selected from the group consisting of benzenecarboxylic acids, benzenecarboxylic acid anhydrides, unsaturated dicarboxylic acids and unsaturated dicarboxylic acid anhydrides and which is different from the first polybasic carboxylic acid the while having a softening point of from 90 to 110° C.

The release agent is preferably selected from the group consisting of carnauba waxes from which free fatty acids are removed, montan waxes, and oxidized rice waxes.

The toner preferably includes a salicylic acid metal compound. The metal preferably has a tri- or more-valence while having a coordination number of 6.

The toner preferably has a volume-average particle diameter of from 5 to 10 μm.

As another aspect of the present invention, an image forming apparatus is provided which includes an image bearing member configured to bear an electrostatic latent image thereon: a developing device configured to develop the electrostatic latent image with a developer including a toner to form a toner image on the image bearing member; a transfer device configured to transfer the toner image onto a receiving material; and a fixing device configured to fix the toner image on the receiving material, wherein the photoreceptor is the photoreceptor mentioned above and the toner is the toner mentioned above.

As yet another aspect of the present invention, a process cartridge is provided which includes at least an image bearing member configured to bear an electrostatic latent image thereon; and a developing device configured to develop the electrostatic latent image with a developer including a toner to form a toner image on the image bearing member, wherein the photoreceptor is the photoreceptor mentioned above and the toner is the toner mentioned above.

These and other objects, features and advantages of the present invention will become apparent upon consideration of the following description of the preferred embodiments of the present invention taken in conjunction with the accompanying drawings.

DETAILED DESCRIPTION OF THE INVENTION

Figure 1:
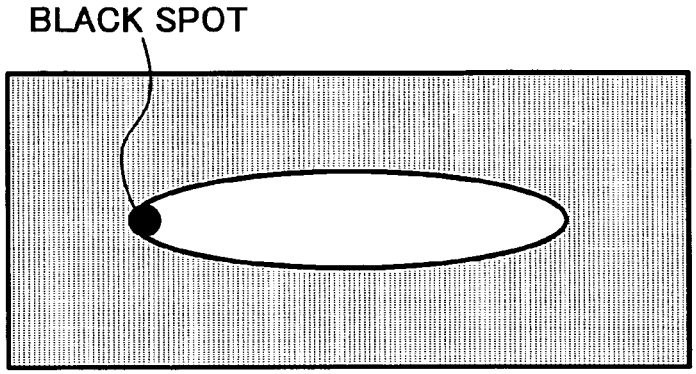
FIG. 1 is a schematic view illustrating a rice-fish form white streak image.

At first, the image forming method of the present invention will be explained.

The image forming method includes:

forming an electrostatic latent image on an image bearing member;

developing the electrostatic latent image with a developer including a toner to form a toner image on the image bearing member;

transferring the toner image onto a receiving material; and fixing the toner image on the receiving material.

The image bearing member includes a substrate, and a charge generation layer, a charge transport layer and a crosslinked charge transport layer, which are located overlying the substrate in this order, wherein the crosslinked charge transport layer includes a compound obtained by polymerizing radical polymerizable monomers including a first monomer having three or more polymerizable monomer functional groups and no charge transport structure and a second monomer having one radical polymerizable functional group and a charge transport structure.

The toner includes a binder resin, a colorant, and a release agent, wherein tetrahydrofuran(THF)-soluble components included in the binder resin have a molecular weight distribution such that at least one peak is observed in a range of from 1,000 to 10,000 and the molecular weight distribution curve has a half width not greater than 15,000 and more preferably not greater than 10,000, when the molecular weight distribution is determined by gel permeation chromatography.

By using this image forming method, high quality images can be produced for a long period of time with hardly producing undesired images such as blurred images, black spots, and rice-fish form streak images even when a low temperature fixable toner and the photoreceptor has good durability.

The mechanism of blurred images is as follows. When image forming operations are repeated, ionic compounds such as NOx, and ozone caused by charging an image bearing member (hereinafter referred to as a photoreceptor) are adhered to the surface of the photoreceptor, resulting in deposition of the ionic compounds thereon. The ionic compounds decrease the surface resistivity of the photoreceptor particularly under high temperature and high humidity conditions, resulting in formation of blurred images. In order to prevent formation of blurred images, it is preferable that a surface of the photoreceptor is slightly abraded so that image formation is always performed on a newly formed surface of the photoreceptor. However, if the surface of the photoreceptor is excessively abraded, the photoreceptor has a short life. Therefore, it is preferable that the surface of the photoreceptor is properly abraded.

In addition, when image forming operations are performed for a long period of time, the surface of the photoreceptor is scratched or pitted. The scratches and pits are typically caused by paper jamming and free particles of the external additive of the toner released from the toner particles. For example, when a free external additive particle is supplied to a cleaning blade and thereby a scratch or a pit is formed on the surface of a photoreceptor, toner particles are adhered to such a recessed portion particularly when a low temperature fixable toner, which typically includes a binder resin having a low softening point, is used. If the toner particles are adhered to a receiving material, the toner particles are observed as a black spot.

The photoreceptor use in the present invention has a hard outermost layer (i.e., a crosslinked charge transport layer) because the outermost layer is a photo-crosslinked acrylic layer having a high crosslinking density. Therefore, such a recessed portion is hardly formed on the outermost layer, and the photoreceptor maintains a very smooth surface for a long period of time. Therefore, occurrence of black spot images can be prevented.

As mentioned above, low temperature fixable toners typically include a binder resin having a low softening point. Therefore, it is difficult to stably fix an external additive on the surface of the toner particles. Even when the external additive is released from the surface of the toner particles, the outermost layer of the photoreceptor for use in the present invention is hardly stuck with the released external additive. Therefore, the rice-fish form streak image problem can be avoided.

In order to form images, a photoreceptor is repeatedly contacted with image forming devices such as charging, developing, transferring, cleaning, and discharging (quenching) devices. Conventional photoreceptors are typically abraded and/or scratched by these devices, and thereby the photoreceptors have to be replaced with new photoreceptors even when the life thereof does not expire.

The causes of the abrasion are as follows:

(1) the surface portion of the photoreceptor is chemically damaged by acidic gasses such as NOx and ozone generated in charging and discharging processes or the material constituting the surface portion is decomposed due to charging in the processes;

(2) carrier particles are adhered to the surface of the photoreceptor in the developing process;

(3) friction between the surface of the photoreceptor and receiving material in a transfer process; and (4) the surface of the photoreceptor is rubbed with a cleaning blade with or without toner particles and carrier particles therebetween in a cleaning process.

In order to prepare a photoreceptor having good resistance to these stresses, it is preferable that the surface of the photoreceptor has high hardness and high elasticity. From this point of view, it is preferable that the outermost layer has a dense and uniform three-dimensional network structure.

The crosslinked charge transport layer (i.e., the outermost layer) of the photoreceptor for use in the present invention has a three-dimensional network structure prepared by crosslinking a radical polymerizable monomer having tri- or more-valence. In addition, the outermost layer has high hardness and high elasticity because of having high crosslinking density. Therefore, the photoreceptor has a good combination of abrasion resistance and scratch resistance. Thus, it is important to increase the crosslinking density, i.e., to increase the number of crosslinking bonds per unit area of the outermost layer. However, when a large number of crosslinking bonds are formed at the same time in the crosslinking process, an internal stress is generated in the layer due to shrinkage of the layer. In particular, when the outermost layer is thick, the internal stress is seriously large and therefore the layer causes cracks and/or peeling. This problem tends to be frequently caused when the photoreceptor is repeatedly subjected to image forming operations such as charging, developing, transferring and cleaning and receives heat from the fixing device.

In attempting to prevent occurrence of such a problem, the following methods have been proposed and used:

(1) a crosslinked layer including a polymer is used as the outermost layer;

(2) a large amount of radical polymerizable mono- or di-functional monomer is used; and (3) a polyfunctional monomer having a group which imparts softness to the resultant crosslinked resin is used.

However, the crosslinked layers prepared by these methods have low crosslinking density, and thereby good abrasion resistance cannot be imparted to the layers.

The photoreceptor for use in the present invention has a crosslinked charge transport layer with a thickness of from 2 to 8 μm which is located overlying a charge transport layer and which has a three dimensional network structure having a high crosslinking density. Therefore the photoreceptor hardly causes cracks and peeling while having good abrasion resistance. The reason why the photoreceptor does not cause cracks and peeling is that the internal stress generated in the layer is low because the layer is relatively thin, and the charge transport layer located below the crosslinked charge transport layer can decrease the internal stress of the crosslinked charge transport layer. Therefore, the amount of a polymer to be added to the crosslinked charge transport layer can be reduced. Therefore, the photoreceptor hardly causes a problem in that scratches and/or a toner film are formed on weak and soft portions of surface of the crosslinked charge transport layer, which portions are formed due to uneven mixing of the polymer with the crosslinked resin obtained from radical polymerizable trifunctional monomers and radical polymerizable compounds having a charge transport structure.

In addition, when a thick crosslinked charge transport layer is prepared using a photo-crosslinking method, a problem in that light used for crosslinking the layer cannot irradiate the bottom portion of the layer because of being absorbed by the charge transport groups included in the layer, resulting in incomplete crosslinking of the layer, occurs. However, the thickness of the crosslinked charge transport layer is not greater than 8 μm, such a problem is not caused. Namely, the entire of the outermost layer is completely crosslinked, and therefore not only the surface portion but also the inner portion of the layer have good abrasion resistance.

The crosslinked charge transport layer of the photoreceptor for use in the present invention is prepared using not only a tri- or more-functional radical polymerizable monomer but also a monofunctional radical polymerizable monomer having a charge transport structure. Therefore, the charge transport structure is incorporated in the crosslinked structure. In contrast, in a crosslinked outermost layer including a low molecular weight charge transport material, the low molecular weight charge transport material is separated from the crosslinked resin because of having poor compatibility with such a crosslinked resin, resulting in formation of a layer in which constituents are unevenly distributed, and thereby the layer has a low mechanical strength. In addition, the resultant photoreceptor has a low photosensitivity and a high residual potential, resulting in deterioration of image qualities.

When a di- or more-functional charge transport compound is used instead of a mono-functional charge transport compound, the crosslinking density increases but the resultant layer has a large internal stress because the crosslinked resin has a bulky structure, resulting in occurrence of the crack/peeling problem.

In contrast, the photoreceptor for use in the present invention has good electric properties, and therefore high quality images can be stably produced for a long period of time. This is because a charge transport group is incorporated in the crosslinked resin as a pendant as a result of radical polymerization of the radical polymerizable mono-functional charge transport compound. When a di- or more-functional charge transport compound is used instead of a mono-functional charge transport compound, the charge transport group is fixed between two molecular chains of the crosslinked resin, and thereby a cation radical (i.e., an intermediate form) of the charge transport material cannot be stably maintained, resulting in deterioration of photosensitivity and increase of residual potential due to charge trapping. Therefore, the resultant images have low image density and poor reproducibility (i.e., the line images are narrowed).

Even if the crosslinked charge transport layer has a drawback in electric properties, it is possible to remedy the drawback by imparting high mobility to the charge transport layer located below the crosslinked charge transport layer.

As mentioned above, the crosslinked charge transport layer is prepared by crosslinking a mixture including a radical polymerizable tri- or more-functional monomer and a radical polymerizable monofunctional monomer having a charge transport structure. Therefore, the resultant layer has a three dimensional network structure having a high crosslinking density. However, when other compounds (such as other mono- or di-functional monomers, polymer binders, antioxidants, additives (e.g., leveling agents) and materials migrated from the lower layer) are included therein or the crosslinking conditions are improper, there is a case where the crosslinking density of the resultant crosslinked layer is locally low, or aggregates of highly-crosslinked materials are formed. Such a layer is easily dissolved in an organic solvent because of having weak bonding force. In addition, problems in that the layer is easily abraded and a part of the crosslinked resin is released from the layer occur.

Therefore, in order to prepare a layer having a three dimensional network structure having a high crosslinking density, it is important to control the chain reaction such that the reaction proceeds in any portions of the layer and the resultant polymer has a high molecular weight, and to properly control the added amounts of the other compounds mentioned above.

Then the image forming apparatus of the present invention will be explained.

The image forming apparatus includes an image bearing member configured to bear an electrostatic latent image thereon; a latent image forming device configured to form the electrostatic latent image on the image bearing member; a developing device configured to develop the electrostatic latent image with a developer including a toner to form a toner image on the image bearing member; a transferring device configured to transfer the toner image onto a receiving material; and a fixing device configured to fix the toner image on the receiving material. The image bearing member is the image bearing member mentioned above, and the toner is the toner mentioned above.

By using this image forming apparatus, high quality images can be produced for a long period of time with hardly producing undesired images such as blurred images, black spots, and rice-fish form streak images while using a low temperature fixable toner and a durable photoreceptor.

Then the process cartridge of the present invention will be explained.

The process cartridge includes at least an image bearing member configured to bear an electrostatic latent image thereon; and a developing device configured to develop the electrostatic latent image with a developer including a toner to form a toner image on the image bearing member, wherein the photoreceptor is the photoreceptor mentioned above and the toner is the toner mentioned above.

The process cartridge uses the above-mentioned image bearing member having good abrasion resistance and the toner mentioned above. Therefore, high resolution and high quality images can be produced. In addition, when blade cleaning is performed on the image bearing member, the surface of the image bearing member is well cleaned while abraded very slightly.

Figure 2:
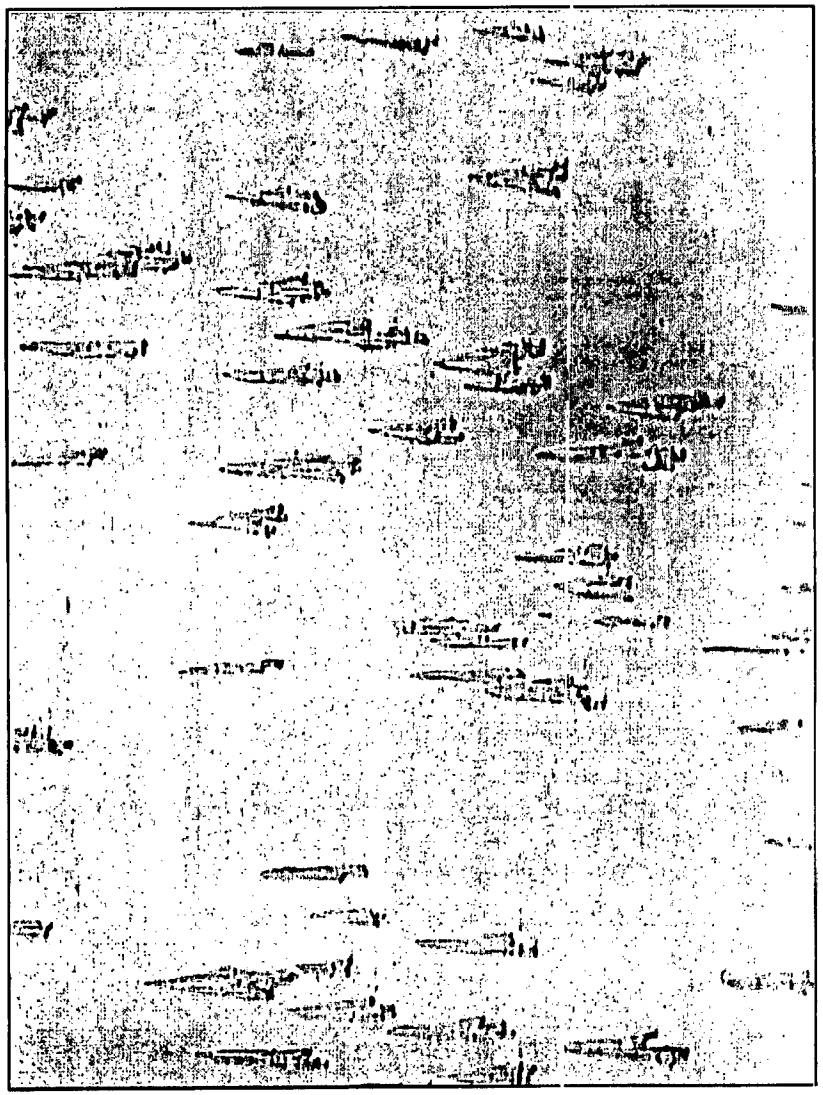
FIG. 2 is a photograph showing scratches formed on a surface of a photoreceptor, which correspond to rice-fish form white streak images.

FIG. 1 is a schematic view illustrating a rice-fish form streak image, and FIG. 2 is a photograph showing scratches formed on a photoreceptor, which correspond to rice-fish form streak images. The rice-fish form streak image (hereinafter simply referred to as the streak image) is a white streak image on a (black) solid image or a half tone image, which is located so as to be parallel to the rotation direction of the image bearing member. As illustrated in FIG. 1, the streak image has a black spot like an eye of a rice-fish. The black spot is formed on a pit of surface of a photoreceptor.

Figure 3A:
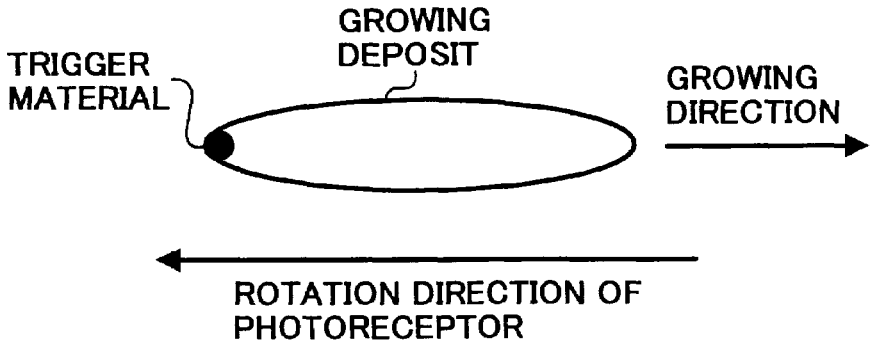
FIGS. 3A, 3B and 3C are schematic views for explaining how the rice-fish form white streak image is formed.
Figure 3B:
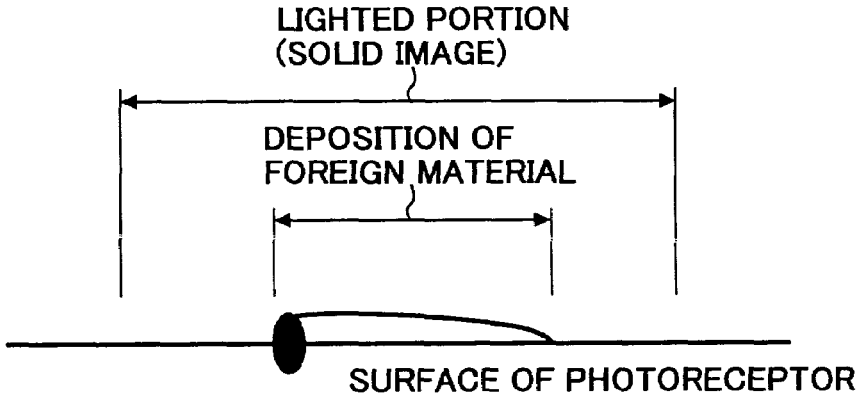
Figure 3C:
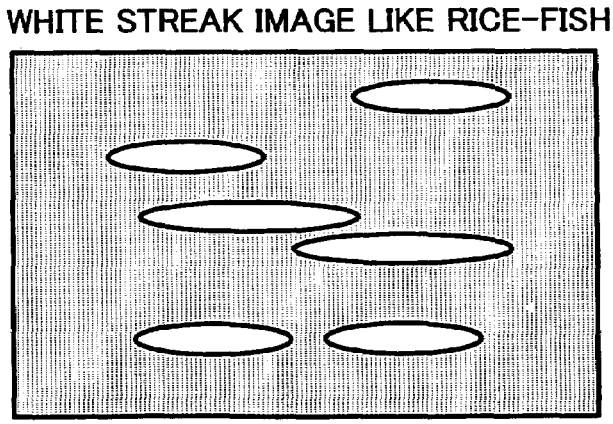

The mechanism of formation of the streak image is considered to be as follows. Referring to FIG. 3A, a trigger material such as fillers in receiving paper and waxes in toner is adhered to a surface of an image bearing member. The material thus adhered to the surface grows in the rotation direction of the image bearing member as illustrated in FIG. 3B. The trigger material is typically a large particle of a free external additive of the toner used, which sticks into the surface. When the surface of such an image bearing member is charged and then exposed to imagewise light, the portion on which the material is adhered has a residual negative potential (−V) which is much higher than the other lighted portions. Therefore, when the resultant electrostatic latent image is reversely developed using a negatively-charged toner, the toner is not adhered to the portion on which a foreign material is adhered, resulting in formation of a white streak image as illustrated in FIG. 3C.

The image forming method and apparatus, and the process cartridge of the present invention use an image bearing member which has an outermost layer including a compound obtained by polymerizing radical polymerizable monomers including at least a first monomer having three or more radical polymerizable functional groups and no charge transport structure, and a second monomer having one radical polymerizable functional group and a charge transport structure and which has good abrasion resistance. In addition, the toner used therefore has sharp molecular weight distribution while the content of low molecular weight components is increased as much as possible. Therefore, high quality images can be stably produced for a long period of time with hardly causing undesired images such as streak images, blurred images and black spot images.

Then the toner for use in the present invention will be explained.

The toner includes at least a binder resin, a colorant and a release agent, and optionally includes additives.

The binder resin has a sharp molecular weight distribution such that at least one peak is observed in a range of from 1,000 to 10,000 and the half width of the molecular weight distribution curve is not greater than 15,000, and preferably not greater than 10,000, when the molecular weight distribution is determined by subjecting the THF-soluble components in the binder resin to gel permeation chromatography (GPC). In addition, the toner preferably includes components having a molecular weight not less than $10^5$ in an amount not greater than 10% by weight.

When such a toner as including a binder resin, which has a sharp molecular weight distribution and includes a large amount of low molecular weight components is used, toner images can be fixed at a low temperature. Namely, the toner has a low temperature fixability much better than that of conventional toners.

The fixability of the toner largely depends on the content of THF-soluble components therein. Specifically, by properly controlling the molecular weight distribution of THF-soluble components in the toner, the toner has good low temperature fixability.

Known resins can be used as the binder resin. Specific examples of the resins are mentioned below. Among the resins, polyester resins are preferably used as the binder resin. In this regard, it is preferable to use at least two kinds of polyester resins, wherein the difference in softening point between the two polyester resins is preferably 25° C. or more. In addition, it is preferable that each of the two polyester resins has the molecular weight distribution mentioned above.

When two kinds of polyester resins having different softening points are used, better low temperature fixability can be imparted to the toner than in a case where only one polyester resin is used as the binder resin. The reason therefor is to be that by including two kinds of resins in the toner, the molecular weight distribution of low molecular weight components can be easily controlled. Therefore, it becomes possible to impart good low temperature fixability to a toner while maintaining good hot offset resistance of the toner.

The present inventors discover that the hot offset resistance and high temperature preservability of a toner largely depend on the content of chloroform-soluble components in the toner. Specifically, when the amount (weight) of chloroform-insoluble components in a toner is less than the amount of chloroform-soluble components, a good combination of hot offset resistance and high temperature preservability can be imparted to the toner. In addition, it is found that when the content of chloroform-insoluble components in the toner is from 5 to 40% by weight, a good combination of hot offset resistance and high temperature preservability can be imparted to the toner. By using this method, change of molecular weight distribution of a binder resin in a kneading process, in which the binder resin, a colorant, a release agent and other additives are heated and kneaded to mix the materials, due to cut of molecular chains of the binder resin can be prevented. Therefore, the toner has an island-sea structure such that the high molecular weight components are present as islands in a sea of the low molecular weight components. Since the toner has such an island-sea structure, the molecular chains of high molecular weight components therein are hardly cut in the fixing process. Therefore the toner has good hot offset resistance. When two kinds of polyester resins are present in the toner, the island-sea structure is stably formed, and thereby good hot offset resistance can be imparted to the toner.

Conventionally it has been considered that the softening point (i.e., melting property) of a binder resin is influenced by the chemical structure or conformation of the resin more largely than the molecular weight of the resin. However, as a result of the present inventors' study, the thermal properties such as hot offset resistance and high temperature preservability of a toner can be improved by using a resin having a proper molecular weight distribution as the binder resin of the toner. As mentioned above, when the content of low molecular weight components in a toner increases, the toner has an island-sea structure such that high molecular weight resin components are present as islands in a sea of low molecular weight resin components. Therefore, even when such a mixture is heated kneaded in the kneading process, the molecular chains of the high molecular weight resin components are hardly cut in the process and therefore the resin components can maintain their molecular weight. Therefore, the toner has good hot offset resistance.

In addition, since the binder resin of the toner for use in the present invention has a sharp the molecular weight distribution, the toner has a high heat response property. Therefore, the toner for use in the present invention has a good combination of hot offset resistance, high temperature preservability and low temperature fixability.

In order to impart a good combination of low temperature fixability and hot offset resistance to a toner, a technique in that the molecular weight of the binder resin is controlled so as to be in a middle range molecular weight (i.e., from about $10^5$ to $10^7$) has been conventionally used. However, the current requirement for low temperature fixability is raised to a level much higher than ever. The present inventors discover that a toner having a further improved low temperature fixability cannot be prepared using a resin having such a middle range molecular weight, and such a toner can be prepared by improving the heat response property of the binder resin by using a resin having a sharp molecular weight distribution therefor. However, when only a resin having a low molecular weight is used, good hot offset resistance cannot be imparted to the toner even when a release agent is used in combination therewith. As a result of the present inventors' study, it is found that by adding a resin component, which is a chloroform-insoluble gel fraction, instead of a resin having a middle range of molecular weight, a good combination of hot offset resistance and low temperature fixability can be imparted to the toner.

As mentioned above, the toner for use in the present invention preferably includes at least two kinds of polyester resins. In this regard, it is preferably that one of the polyester resins (hereinafter referred to as polyester (1)) is a polyester resin prepared by polymerizing monomers including a benzene carboxylic acid, a benzene carboxylic acid anhydride, an unsaturated dicarboxylic acid or an unsaturated dicarboxylic acid anhydride as a polycarboxylic acid component and having a softening point of from 90 to 120° C. (preferably from 90 to 110° C.); and the other polyester resin (hereinafter referred to as polyester (2)) is a polyester resin prepared by polymerizing monomers including a benzene carboxylic acid, a benzene carboxylic acid anhydride, an unsaturated dicarboxylic acid or an unsaturated dicarboxylic acid anhydride, which is different from that used for the polyester resin (1), as a polycarboxylic acid component, and having a softening point of from 120 to 160° C.

In order to impart good combination of hot offset resistance and high temperature preservability to a toner, it is preferable to use a polyester resin having a softening point not lower than 90° C. as the polyester resin (1). In addition, in order to impart good low temperature fixability to a toner, it is preferable to use a polyester resin having a softening point not higher than 120° C. as the polyester resin (1). In order to impart good hot offset resistance to a toner, it is preferable to use a polyester resin having a softening point not lower than 120° C. as the polyester resin (2). In addition, in order to impart good low temperature fixability to a toner, it is preferable to use a polyester resin having a softening point not higher than 160° C. as the polyester resin (2).

In addition, in order to impart good low temperature fixability to the toner, it is preferable to use a polyester resin having an acid value not less than 8 mgKOH/g. Further, in order to impart good hot offset resistance to the toner, it is preferable to use a polyester resin having an acid value not greater than 45 mgKOH/g. Furthermore, in order to impart good combination of low temperature fixability and charge properties to the toner, it is preferable to use a polyester resin having a hydroxyl value not greater than 50 mgKOH/g.

As mentioned above, it is preferable that the polycarboxylic acid unit of the polyester resin (1) is different from that of the polyester resin (2) because the resins are slightly incompatible with each other and thereby the island-sea structure can be stably prepared, resulting in impartment of good combination of hot offset resistance and low temperature fixability to the resultant toner. In particular, when a metal complex including a metal having tri- or more-valence and a coordination number of 6 is used, the metal complex is reacted with the binder resin and a wax serving as a release agent, and thereby a weak crosslinked structure is formed. Therefore, the metal complex can import good hot offset resistance to the toner while serving as a charge controlling agent.

The volume average particle diameter of the toner is not particularly limited. However, in order to produce high quality images having good fine line reproducibility, the toner preferably has a volume average particle diameter of from 5 to 10 μm. The volume average particle diameter of a toner can be determined by, for example, COULTER COUNTER TA II manufactured by Beckman Coulter Inc.

The molecular weight of a resin is determined by a GPC (Gel Permeation Chromatography) method using tetrahydrofuran (THF) as a solvent. The measuring method is as follows.

At first, the column is stabilized in a heat chamber at 40° C. The solvent (i.e., THF) is flown through the column at a speed of 1 ml/minute. On the other hand, a resin to be measured is dissolved in THF to prepare a THF solution of the resin having a resin content of from 0.05 to 0.6% by weight. Then 50 to 200 μl of the THF solution of the resin is injected into the column to obtain a GPC spectrum.

The molecular weight of the resin is determined while comparing the molecular distribution curve thereof with the working curve which is previously prepared using several polystyrene standard samples each having a single molecular weight peak. Specific examples of the polystyrene standard samples include standard polystyrenes which are manufactured by Pressure Chemical Co. or Tosoh Corporation and each of which has a molecular weight of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$.

It is preferable to prepare a working curve using at least ten standard polystyrenes. A refractive index (RI) detector is used as the detector.

The content of chloroform-insoluble components in a toner (or a resin) can be determined by the following method:

(1) a toner (or a resin) of about 1.0 gram is precisely weighed;

(2) the sample is mixed with about 50 g of chloroform;

(3) the mixture is subjected to a centrifugal treatment, followed by filtration using a filter paper 5C specified in JIS P3801; and (5) the filtrate is dried by a vacuum drying method to determine the weight of the chloroform-soluble components in the toner (or resin).

The chloroform-insoluble component content of the toner (or resin) can be determined by the following equation:

$$\text{Chloroform-insoluble content (\%)}=(B/A)\times100$$

wherein A represents the weight of the toner (resin) sample, and B represents the weight of the chloroform-insoluble components.

In general, other toner constituents included in the toner such as colorants and release agents also include chloroform-insoluble components. Therefore, it is necessary to previously determine the weight (W1) of the chloroform-insoluble materials included in the toner constituents by any known method such as thermogravimetry.

In the present application, the glass transition temperature of a binder resin is determined using an instrument THERMOFLEX TG8110 manufactured by Rigaku Corporation. In this regard, the temperature rising speed is 10° C./min.

The acid value and hydroxyl value of a resin are determined by the method specified in JIS K0070. If the sample is not dissolved by the solvent, dioxane or tetrahydrofuran is used as the solvent.

The softening point of a resin is determined using an instrument FLOW TESTER CFT-500 manufactured by Shimadzu Corporation. Measurements are performed under the following conditions:

(1) diameter of die: 1 mm (2) pressure: 20 kgf/cm$^2$ (3) temperature rising speed: 10° C./min Specifically, a sample (resin) is heated and melted under the conditions of 1 mm in diameter of die, 20 kg/cm$^2$ in pressure, and 6° C./min in temperature rising speed while the melt flow property is graphed to determine the ½ temperature (F½ temperature) which is the midpoint of the flow starting point and the flow ending point. The F½ temperature is defined as the softening point.

Polyester resins for use as the binder resin of the toner for use in the present invention are prepared by subjecting an alcohol and a carboxylic acid to condensation polymerization. Specific examples of the alcohols include glycols such as ethylene glycol, diethylene glycol, triethylene glycol, and propylene glycol; etherified bisphenols such as 1,4-bis(hydroxymethyl)cyclohexane, and bisphenl A; and other dihydric alcohols and polyhydric alcohols having three or more hydroxyl groups.

Specific examples of the carboxylic acids include dibasic organic acids such as maleic acid, fumaric acid, phthalic acid, isophthalic acid, terephthalic acid, succinic acid, and moronic acid; and polycarboxylic acids having three or more carboxyl groups such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

It is preferable to use a polyester resin having a glass transition temperature (Tg) not lower than 55° C., and more preferably not lower than 60° C.

The toner for use in the present invention preferably includes one or more polyester resins, but other resins can be used alone or in combination of one or more polyester resins as long as the resins satisfy the molecular weight distribution requirement mentioned above and the desired properties mentioned above (such as low temperature fixability, hot offset resistance and high temperature preservability) can be imparted to the toner.

Specific examples of such resins include homopolymers and copolymers of styrene and its derivatives such as polystyrene resins, polychlorostyrene resins, poly-α -methyl styrene resins, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate copolymers (e.g., styrene-methyl acrylate copolymers, styrene-ethyl acrylate copolymers, styrene-buthyl acrylate copolymers, styrene-octyl acrylate copolymers, and styrene-phenyl acrylate copolymers), styrene-methacrylate copolymers (e.g., styrene-methyl methacrylate copolymers, styrene-ethyl methacrylate copolymers, styrene-buthyl methacrylate copolymers, and styrene-phenyl methacrylate copolymers), styrene-methyl α-chloroacrylate copolymers, and styrene-acrylonitrile—acrylate copolymers; vinyl chloride resins, rosin-modified maleic acid resins, phenolic resins, epoxy resins, polyethylene resins, polypropylene resins, ionomer resins, polyurethane resins, silicone resins, ketone resins, ethylene—ethyl acrylate resins, xylene resins, polyvinyl butyral resins, petroleum resins, hydrogenated petroleum resins, etc.

These resins can be used alone or in combination.

The method for manufacturing the resins used as the binder resin of the toner for use in the present invention is not particularly limited, and any known polymerization methods such as bulk polymerization methods, solution polymerization methods, emulsion polymerization methods, and suspension polymerization methods can be used. The glass transition temperature (Tg) of the resins is preferably not lower than 55° C. and more preferably not lower than 60° C.

The toner for use in the present invention includes a colorant. Suitable materials for use as the colorant include known dyes and pigments.

Specific examples of the dyes and pigments include carbon black, Nigrosine dyes, black iron oxide, NAPHTHOL YELLOW S (C.I. 10316), HANSA YELLOW 10G (C.I. 11710), HANSA YELLOW 5G (C.I. 11660), HANSA YELLOW G (C.I. 11680), Cadmium Yellow, yellow iron oxide, loess, chrome yellow, Titan Yellow, polyazo yellow, Oil Yellow, HANSA YELLOW GR (C.I. 11730), HANSA YELLOW A (C.I. 11735), HANSA YELLOW RN (C.I. 11740), HANSA YELLOW R (C.I. 12710), PIGMENT YELLOW L (C.I. 12720), BENZIDINE YELLOW G (C.I. 21095), BENZIDINE YELLOW GR (C.I. 21100), PERMANENT YELLOW NCG (C.I. 20040), VULCAN FAST YELLOW 5G (C.I. 21220), VULCAN FAST YELLOW R (C.I. 21135), Tartrazine Lake, QUINOLINE YELLOW LAKE, ANTHRAZANE YELLOW BGL (C.I. 60520), isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, BRILLIANT CARMINE BS, PERMANENT RED F2R (C.I. 12310), PERMANENT RED F4R (C.I. 12335), PERMANENT RED FRL (C.I. 12440), PERMANENT RED FRLL (C.I. 12460), PERMANENT RED F4RH (C.I. 12420), Fast Scarlet VD, VULCAN FAST RUBINE B (C.I. 12320), BRILLIANT SCARLET G, LITHOL RUBINE GX (C.I. 12825), PERMANENT RED F5R, BRILLIANT CARMINE 6B, Pigment Scarlet 3B, Bordeaux 5B, Toluidine Maroon, PERMANENT BORDEAUX F2K (C.I. 12170), HELIO BORDEAUX BL (C.I. 14830), BORDEAUX 10B, BON MAROON LIGHT (C.I. 15825), BON MAROON MEDIUM (C.I. 15880), Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS (C.I. 69800), INDANTHRENE BLUE BC (C.I. 69825), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green; chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of the colorant in the toner is preferably from 1 to 30 parts by weight, and more preferably from 3 to 20 parts by weight, per 100 parts by weight of the resins included in the toner.

Any known release agents can be used as the release agent of the toner for use in the present invention. Among the release agents, carnauba waxes from which free fatty acids are removed (hereinafter referred to as free fatty acid eliminated carnauba waxes), montan waxes, and oxidized rice waxes are preferably used.

Among the free fatty acid eliminated carnauba waxes, fatty acid eliminated microcrystalline carnauba waxes which have an acid value not greater than 5 mgKOH/g and which have a particle diameter not greater than 1 μm when dispersed in a toner binder resin are preferably used.

The montan waxes are defined as montan waxes which are prepared by-refining waxes included in minerals, and microcrystalline montan waxes which have an acid value of from 5 to 14 mgKOH/g are preferably used.

The oxidized rice waxes are prepared by air-oxidizing rice bran waxes. Oxidized rice waxes having an acid value of from 10 to 30 mgKOH/g are preferably used.

Other known release agents such as solid silicone varnishes, higher fatty acids, higher alcohols, montan ester waxes and low molecular weight polypropylene waxes can be used in combination with the above-mentioned waxes.

The content of the release agent in the toner is preferably from 1 to 20 parts by weight, and more preferably from 3 to 10% by weight, per 100 parts by weight of the resin components included in the toner.

The toner for use in the present invention can include other additives such as charge controlling agents, and fluidity improving agents.

One or more of any known charge controlling agents such as Nigrosine dyes, metal complex dyes, and quaternary ammonium salts can be used as the charge controlling agent. The content of the charge controlling agent in the toner is preferably from 0.1 to 10 parts by weight, and more preferably from 1 to 5 parts by weight, per 100 parts by weight of the resin components included in the toner. Among these charge controlling agents, salicylic acid metal salt compounds are preferably used. More preferably, salicylic acid metal salt compounds including a metal having tri- or more-valence and a coordination number of six (such as Al, Fe, Cr and Zr) are used.

Suitable fluidity improving agents include silicon oxide, titanium oxide, silicon carbide, aluminum oxide, barium titanate, etc. The content of the fluidity improving agent in the toner is preferably from 0.1 to 5 parts by weight, and more preferably from 0.5 to 2 parts by weight, per 100 parts by weight of the toner.

When a magnetic material is included in the toner for use in the present invention, the toner can be used as a magnetic toner. Specific examples of the magnetic materials include iron oxides such as magnetite, hematite, and ferrites; and metals such as iron, cobalt, and nickel, and alloys of these metals with a metal such as aluminum, cobalt, copper, lead, magnesium, tin, zinc, antimony, beryllium, bismuth, cadmium, calcium, manganese, selenium, titanium, tungsten, and vanadium. These materials can be used alone or in combination. Among these materials, magnetic is preferably used in view of magnetic properties.

The magnetic materials preferably have an average particle diameter of from 0.1 to 2 μm. In addition, the added amount of a magnetic material is generally from 15 to 200 parts by weight, and preferably from 20 to 100 parts by weight, per 100 parts by weight of the resin components included in the toner.

The toner for use in the present invention can be prepared by any known methods such as kneading/pulverization methods in which toner composition mixture is melted and kneaded, followed by cooling, pulverization and classification, and other methods such as polymerization methods.

One example of the kneading/pulverization methods is as follows.

(1) toner constituents such as binder resins, colorants and release agents are mechanically mixed (mixing process);.

(2) the mixture is heated and kneaded (kneading process);

(3) the kneaded mixture is cooled and then pulverized (pulverization process); and (4) the pulverized mixture is classified (classification process).

Particles which are produced in the pulverization and classification processes but which cannot be used for a final product such as fine or large particles can be reused for the mixing process and kneading process. The added amount of such a by-product to the raw materials is preferably from 1 to 20 parts by weight per 100 parts by weight of the raw materials.

Known mixers having a blade can be used for the mixing process. Mixing conditions are not particularly limited, and operations are performed under normal conditions.

The kneading operation is performed using, for example, a kneader such as batch kneaders (e.g., two roll mills and BUMBURY'S MIXERS), continuous double-axis extruders (e.g., KTK double-axis extruders manufactured by Kobe Steel, Ltd., TEM double-axis extruders manufactured by Toshiba Machine Co., Ltd., TEX double-axis extruders manufactured by Japan Steel Works, Ltd., PCM double-axis extruders manufactured by Ikegai Corp., and KEX double-axis extruders manufactured by Kurimoto, Ltd.), and continuous single-axis kneaders (e.g., KO-KNEADER manufactured by Buss AG).

It is preferable that the kneading operation is performed while controlling the kneading temperature such that the molecular chain of the binder resin used is not cut. Specifically, when the kneading temperature is too low, the molecular chain is seriously cut. In contrast, when the kneading temperature is too high, the dispersion operation cannot be well performed.

When the kneaded mixture is pulverized, it is preferable that the kneaded mixture is crushed at first, followed by pulverization. In the pulverization process, a method in which particles are collided to a plate using jet air; a method in which particles are collided to each other using jet air; and a method in which particles are pulverized at a narrow gap between a rotor and a stator are preferably used.

Then the pulverized particles are classified utilizing centrifugal force to prepare toner particles having an average particle diameter of from 5 to 20 μm.

Then the developer for use in the image forming apparatus of the present invention will be explained.

The developer for use in the present invention includes at least the toner mentioned above, and optionally includes a carrier, etc. The developer may be a one component developer including no carrier or a two component developer including a carrier. When the developer is used for high speed image forming apparatus, a two component developer is preferably used because of having a long life.

When the toner mentioned above is used as a one component developer while a fresh toner is replenished, the average particle diameter of the toner hardly changes. In addition, the toner hardly causes a fusion problem in that the toner adheres to the surface of a developing roller and/or a blade which is used for forming a toner layer on the surface of the developing roller. Therefore, the one component developer (i.e., the toner) can stably produce high quality images even when used for a long period of time. When the toner mentioned above is used for a two-component developer for a long period of time while a fresh toner is replenished, the particle diameter of the toner hardly changes. Therefore, the toner can stably produce high quality images even when used for a long period of time.

The carrier for use in the two component developer for use in the present invention is not particularly limited, and one or more proper carriers are chosen while considering the application of the developer. However, it is preferable to use a carrier which is prepared by coating a core material with a resin.

Suitable materials for use as the core material include manganese-strontium materials and manganese-magnesium materials, which have a saturation magnetization of from 50 to 90 $Am^2/kg$ (90 emu/g). In view of image density, iron powders (having a a saturation magnetization not less than 100 $Am^2/kg$ (100 emu/g) and magnetite having a saturation magnetization of from 75 to 120 $Am^2/kg$ (75 to 120 emu/g) are preferably used. In addition, copper-zinc materials having a saturation magnetization of from 30 to 80 $Am^2/kg$ (30 to 80 emu/g) can be preferably used because the impact of the magnetic brush against the photoreceptor is relatively weak and high quality images can be produced.

These carrier materials can be used alone or in combination.

The core material of the carrier preferably has a volume average particle diameter ($D_{50}$) of from 10 to 150 μm, and more preferably from 40 to 100 μm. When the volume average particle diameter is too small, a carrier scattering problem tends to occur because the particles have weak magnetization. When the particle diameter is too large, the surface area of the carrier per unit weight decreases and thereby a toner scattering problem tends to occur. In addition, another problem in that uneven solid images are formed tends to occur particularly when the carrier is used for forming color images.

Specific examples of such resins to be coated on the carriers include amino resins, vinyl or vinylidene resins, polystyrene resins, halogenated olefin resins, polyester resins, polycarbonate resins, polyethylene resins, polyvinyl fluoride resins, polyvinylidene fluoride resins, polytrifluoroethylene resins, polyhexafluoropropylene resins, vinylidenefluoride-acrylate copolymers, vinylidenefluoride-vinylfluoride copolymers, copolymers of tetrafluoroethylene, vinylidenefluoride and other monomers including no fluorine atom, silicone resins, epoxy resins.

Specific examples of the amino resins include urea-formaldehyde resins, melamine resins, benzoguanamine resins, urea resins, and polyamide resins. Specific examples of the vinyl or vinylidene resins include acrylic resins, polymethylmethacrylate resins, polyacrylonitirile resins, polyvinyl acetate resins, polyvinyl alcohol resins, polyvinyl butyral resins, etc. Specific examples of the polystyrene resins include polystyrene resins and styrene-acrylic copolymers. Specific examples of the halogenated olefin resins include polyvinyl chloride resins. Specific examples of the polyester resins include polyethyleneterephthalate resins and polybutyleneterephthalate resins.

If desired, an electroconductive powder can be included in the resin layer of the carrier. Specific examples of such electroconductive powders include metal powders, carbon blacks, titanium oxide, tin oxide, and zinc oxide. The average particle diameter of such electroconductive powders is preferably not greater than 1 μm. When the particle diameter is too large, it is hard to control the resistance of the coating layer.

The resin layer can be formed by coating a resin solution which is prepared by dissolving a resin in a solvent on a core material using any known coating method, followed by drying and baking. Suitable coating methods include dip coating methods, spray coating methods, brush coating methods, etc.

Specific examples of the solvent include toluene, xylene, methyl ethyl ketone, methyl isobutyl ketone, cellosolve butyl acetate, etc.

The method for baking is not particularly limited, and external heating methods and internal heating methods can be used. For example, methods using a heating device such as fixed electric furnaces, fluid electric furnaces, rotary electric furnaces, and burner furnaces, and methods using microwave, are preferably used.

The coated amount of the resin is preferably 0.01 to 5.0% by weight based on the weight of the carrier. When the coated amount is too small, a uniform resin layer cannot be formed. When the coated amount is too large, the carrier particles aggregates, and thereby the toner cannot be uniformly charged.

The weight ratio of the toner to the carrier in the two component developer is from 10/90 to 2/98, and preferably from 7/93 to 3/97.

Since the developer uses the toner for use in the present invention, high quality images can be stably produced for a long period of time because the toner has good combination of chargeability and fixability.

The developer can be used for known developing methods such as magnetic one component developing methods, non-magnetic one component developing methods, and two component developing methods. The toner and developer can be used for the toner container, the process cartridge and the image forming apparatus mentioned below.

Toner Container

The toner container of the present invention contains the toner or the developer mentioned above. The form of the container is not particularly limited, and a proper container is used depending on the image forming apparatus for which the toner is used. For example, combinations of a toner container and a cap are preferably used.

The shape of the toner container is not particularly limited, and cylindrical containers, etc. can be used. The containers can include a spiral groove on the inner surface of the container to smoothly discharge the toner contained therein when rotated. Containers with a groove which can be folded like an accordion can be preferably used.

The toner container for use in the present invention is set in the process cartridge and image forming apparatus of the present invention. The container has such a shape as to be suitably set in the image forming apparatus and the process cartridge for which the toner is used.

Suitable materials for use as the toner container and toner cartridge include resins having good dimension stability. Specific examples thereof include polyester resins, polyethylene resins, polypropylene resins, polystyrene resins, polyvinyl chloride resins, acrylic resins, polycarbonate resins, ABS resins, polyacetal resins, etc.

The toner container has good preservation property, transporting property, and handling property, and is used by being detachably set in the image forming apparatus and process cartridge of the present invention. The toner contained in the toner container is supplied to the developing device of the process cartridge and image forming apparatus of the present invention.

Process Cartridge

The process cartridge of the present invention includes at least an image bearing member configured to bear an electrostatic latent image thereon, and a developing device configured to develop the electrostatic latent image with a developer including the toner mentioned above to form a toner image on the image bearing member. The process cartridge optionally includes other devices, such as chargers and cleaners.

The image bearing member includes a substrate, and a charge generation layer, a charge transport layer and a crosslinked charge transport layer, which are located overlying the substrate in this order, wherein the crosslinked charge transport layer includes a compound obtained by polymerizing radical polymerizable monomers including a first monomer having three or more functional groups and no charge transport structure and a second monomer having one functional group and a charge transport structure.

The developing device includes at least a developer container configured to contain the developer mentioned above, a developer bearing member configured to bear and transport the developer contained in the developer container, and optionally includes a regulating member configured to form a thin developer layer on the surface of the developer bearing member. The process cartridge of the present invention can be detachably set in an electrophotographic image forming apparatus, and is preferably set in the image forming apparatus of the present invention.

Figure 4:
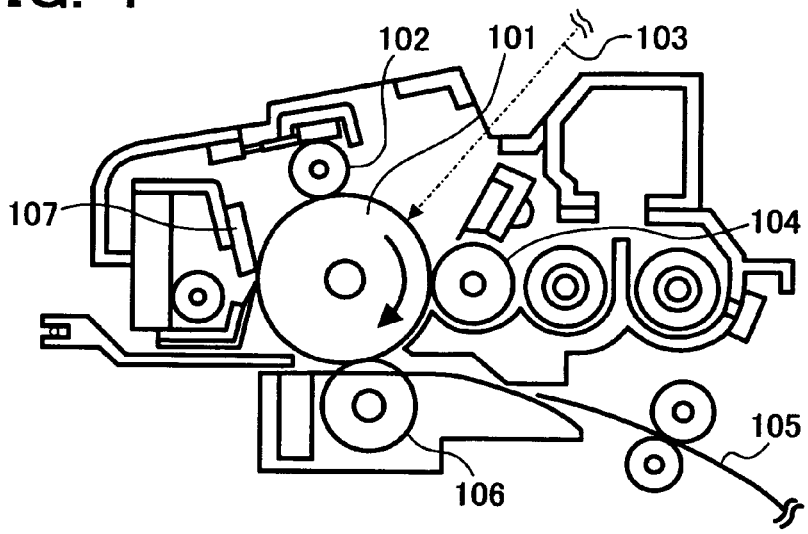
FIG. 4 is a schematic view illustrating an embodiment of the process cartridge of the present invention.

One embodiment of the process cartridge of the present invention is illustrated in FIG. 4. The process cartridge includes a photoreceptor 101 serving as an image bearing member, a charger 102 configured to charge the photoreceptor 101, a light irradiator configured to irradiate the charged photoreceptor with imagewise light 103 to form an electrostatic latent image, a developing device 104 configured to develop the electrostatic latent image with the developer mentioned above to prepare a toner image on the image bearing member, and a cleaner 107 configured to clean the surface of the photoreceptor 101.

A transfer device 106 transfers the toner image formed on the photoreceptor 101 to a receiving material 105 which is timely fed to the transfer device 106.

The photoreceptor 101 includes a substrate, and a charge generation layer, a charge transport layer and crosslinked charge transport layer, which are located overlying the substrate.

Known chargers can be used as the charger 102.

Light sources which can perform optical writing with high resolution are preferably used as the light irradiator emitting the imagewise light 103.

Then the image forming method and apparatus of the present invention will be explained.

The image forming apparatus of the present invention includes at least an image bearing member, an electrostatic latent image forming device, a developing device, a transfer device, a fixing device and a cleaning device, and optionally includes other devices such as discharging device (i.e., a quenching device), a toner recycling device and a controller.

The image forming method of the present invention includes at least the following steps:

forming an electrostatic latent image on an image bearing member;

developing the electrostatic latent image with a developer including a toner to form a toner image;

transferring the toner image to a receiving material; and fixing the toner image on the receiving material.

The image forming method optionally includes the following steps:

discharging a potential remaining on the image bearing member after the transferring step;

recycling toner particles collected from the surface of the image bearing member after the transferring step; and controlling the image forming operations mentioned above.

The image forming method of the present invention can be preferably performed by the image forming apparatus of the present invention. Specifically, the electrostatic latent image forming process is performed by the electrostatic latent image forming device, the developing process is performed by the developing device, the transferring process is performed by the transferring device, and the fixing process is performed by the fixing device. The discharging, recycling and controlling processes are performed by the discharging device, recycling device and controller, respectively.

Then each of the image forming processes and devices will be explained in detail.

Electrostatic Latent Image Forming Processes and Devices

In the electrostatic latent image forming process, an electrostatic latent image is formed on the image bearing member. The image bearing member is not particularly limited with respect to the constitutional materials, shape, and dimension, and any known image bearing members can be used. However, drum-form image bearing members are preferably used.

The image bearing member includes at least a substrate, and a photosensitive layer which is located overlying the substrate and includes at least a charge generation layer, a charge controlling layer and a crosslinked charge transport layer, which are overlaid in this order. The image bearing member may include one or more other layers, and/or another member.

Figure 5:
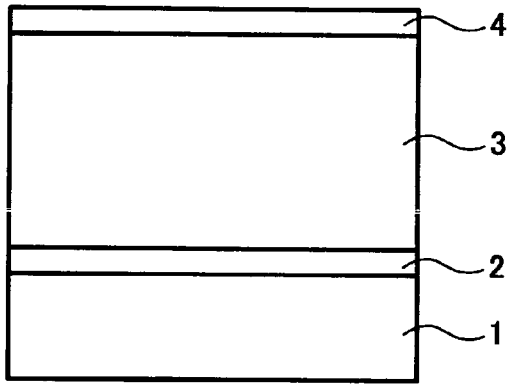
FIG. 5 is a schematic view illustrating the cross-section of an example of the image bearing member for use in the image forming apparatus of the present invention.

FIG. 5 is a schematic view illustrating a cross-section of an example of the image bearing member for use in the image forming apparatus of the present invention. The image bearing member has an electroconductive substrate 1, a charge generation layer (CGL) 2 located on the substrate 1 and having a charge generation function, a charge transport layer (CTL) 3 located on the charge generation layer 2 and having a charge transport function, and a crosslinked charge transport layer (CCTL) 4 located on the charge transport layer 3 and having a charge transport function. An undercoat layer can be formed between the substrate 1 and the charge generation layer 2 for the purpose of improving adhesion of the charge generation layer to the substrate or other purposes.

Substrate of Image Bearing Member

Suitable materials for use as the electroconductive substrate 1 include materials having a volume resistivity not greater than $10^{10}\Omega\cdot$cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is formed by deposition or sputtering. In addition, a plate of a metal such as aluminum, aluminum alloys, nickel and stainless steel can be used. A metal cylinder can also be used as the substrate 1, which is prepared by tubing a metal such as aluminum, aluminum alloys, nickel and stainless steel by a method such as impact ironing or direct ironing, and then treating the surface of the tube by cutting, super finishing, polishing and the like treatments. Further, endless belts of a metal such as nickel, stainless steel and the like can also be used as the substrate 1.

Furthermore, substrates, in which a coating liquid including a binder resin and an electroconductive powder is coated on the supports mentioned above, can be used as the substrate 401. Specific examples of such an electroconductive powder include carbon black, acetylene black, powders of metals such as aluminum, nickel, iron, nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins.

Such an electroconductive layer can be formed by coating a coating liquid in which an electroconductive powder and a binder resin are dispersed or dissolved in a proper solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins (such as TEFLON), with an electroconductive material, can also be used as the substrate 1.

Photosensitive Layer

The photosensitive layer includes at least a charge generation layer (hereinafter referred to as a CGL) having a charge generation function, a charge transport layer (hereinafter referred to as a CTL) having a charge transport function and a crosslinked charge transport layer (hereinafter referred to as a CCTL), which are overlaid in this order.

The CGL 2 includes a charge generation material (hereinafter referred to as a CGM) as a main component, and optionally includes a binder resin and other components. For the CGL 2, known CGMs such as inorganic CGMs and organic CGMs can be used. Specific examples of the inorganic CGMs include crystalline selenium, amorphous selenium, selenium-tellurium, selenium-tellurium-halogen, selenium-arsenic compound, amorphous silicon, etc. In addition, amorphous silicon in which a dangling bond is terminated with a hydrogen atom or a halogen atom or in which a boron atom, a phosphorous atom is doped can be preferably used.

Specific examples of the organic CGMs include phthalocyanine pigments such as metal phthalocyanine and metal-free phthalocyanine; azulenium salt type pigments; squaric acid methyne pigments; azo pigments having a carbazole skeleton; azo pigments having a triphenyl amine skeleton; azo pigments having a diphenyl amine skeleton; azo pigments having a dibenzothiophene skeleton; azo pigments having a fluorenone skeleton; azo pigments having an oxadiazole skeleton; azo pigments having a bisstilbene skeleton; azo pigments having a distyryloxadiazole skeleton; azo pigments having a distyrylcarbazole skeleton; perylene pigments; anthraquinone pigments, polycyclic quinone pigments, quinone imine pigments, diphenylmethane pigments, triphenylmethane pigments, benzoquinone pigments, naphthoquinone pigments, cyanine pigments, azomethine pigments, indigoide pigments, benzimidazole pigments, and the like organic pigments.

These CGMs are used alone or in combination.

Among these CGMs, oxytitanium phthalocyanine compounds having the following formula (1) are preferably used.

(1)

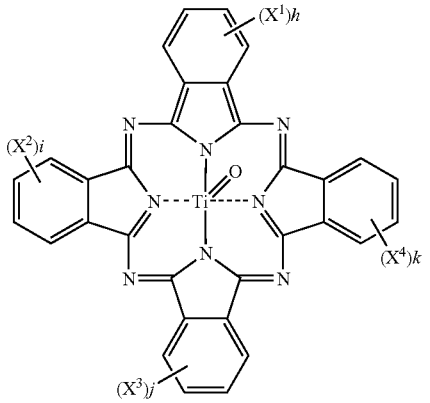

In formula (1), $X^1$, $X^2$, $X^3$ and $X^4$ independently represent a chlorine atom or a bromine atom; and each of h, i, j and k is 0 or an integer of from 1 to 4.

Among the oxytitanium phthalocyanine compounds, oxytitanium phthalocyanine compounds having an X-ray diffraction spectrum such that strong peaks are observed at least at Bragg (2) angles of 9.0°, 14.2°, 23.9° and 27.1° (±0.2°) or oxytitanium phthalocyanine compounds having an X-ray diffraction spectrum such that strong peaks are observed at least at Bragg (2) angles of 9.6° and 27.3° (±0.2°) are preferably used because of having high photosensitivity.

Suitable binder resins, which are optionally included in the CGL, include polyamide, polyurethane, epoxy resins, polyketone, polycarbonate, polyarylate, silicone resins, acrylic resins, polyvinyl butyral, polyvinyl formal, polyvinyl ketone, polystyrene, poly-N-vinylcarbazole, polyacrylamide, and the like resins. These resins can be used alone or in combination.

In addition, charge transport polymers having a charge transport function such as polycarbonates, polyesters, polyurethanes, polyethers, polysiloxanes, and acrylic resins, which have an arylamine skeleton, a benzidine skeleton, a hydrazone skeleton, a carbazole skeleton, a stilbene skeleton, and/or a pyrazoline skeleton, and polymers having a polysilane skeleton can also be used alone or in combination as the binder resin.

Specific examples of the polymers are described in published unexamined Japanese patent applications Nos. 01-001728, 01-009964, 01-013061, 01-019049, 01-241559, 04-011627, 04-175337, 04-183719, 04-225014, 04-230767, 04-320420, 05-232727, 05-310904, 06-234836, 06-234837, 06-234838, 06-234839, 06-234840, 06-234841, 06-236050, 06-236051, 06-295077, 07-056374, 08-176293, 08-208820, 08-211640, 08-253568, 08-269183, 09-062019, 09-043883, 09-71642, 09-87376, 09-104746, 09-110974, 09-110976, 09-157378, 09-221544, 09-227669, 09-235367, 09-241369, 09-268226, 09-272735, 09-302084, 09-302085, and 09-328539. Specific examples of the polysilylene polymers are described in published unexamined Japanese patent applications Nos. 63-285552, 05-19497, 05-70595 and 10-73944.

The CGL can include a low molecular weight CTM. Low molecular weight CTMs are broadly classified into electron transport materials and positive hole transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, diphenoxy derivatives, etc. These electron transport materials can be used alone or in combination.

Specific examples of the positive hole transport materials include electron donating materials such as oxazole derivatives, oxadiazole derivatives, imidazole derivatives, monoarylamine derivatives, diarylamine derivatives, triphenylamine derivatives, stilbene derivatives, α-phenylstilbene derivatives, benzidine derivatives, diarylmethane derivatives, triarylmethane derivatives, 9-styrylanthracene derivatives, pyrazoline derivatives, divinylbenzene derivatives, hydrazone derivatives, indene derivatives, butadiene derivatives, pyrene derivatives, bisstilbene derivatives, enamine derivatives, etc. These positive hole transport materials can be used alone or in combination.

Suitable methods for forming the CGL 2 include vacuum thin film forming methods and casting methods.

Specific examples of such vacuum thin film forming methods include vacuum evaporation methods, glow discharge decomposition methods, ion plating methods, sputtering methods, reaction sputtering methods, CVD (chemical vapor deposition) methods, and the like methods. A layer of the above-mentioned inorganic and organic materials can be formed by one of these methods.

The casting methods useful for forming the CGL 2 include, for example, the following steps;

(1) preparing a coating liquid by mixing one or more inorganic or organic charge generation materials mentioned above with a solvent such as tetrahydrofuran, dioxane, dioxolan, toluene, dichloromethane, monochlorobenzene, dichloroethane, cyclohexanone, cyclopentanone, anisole, xylene, methyl ethyl ketone, acetone, ethyl acetate, butyl acetate, etc.;

(2) coating on a substrate the coating liquid, which is diluted if necessary, by a dip coating method, a spray coating method, a bead coating method, a ring coating method or the like method, wherein the coating liquid optionally includes a leveling agent such as dimethylsilicone oils, and methyl phenyl silicone oils; and (3) drying the coated liquid to form a CGL.

The thickness of the CGL 2 is preferably from 0.01 to 5 μm, and more preferably from 0.05 to 2 μm.

Charge Transport Layer (CTL) The CTL 3 has a charge transporting function. The CTL 3 is typically prepared by coating a coating liquid, which is prepared by dissolving or dispersing a CTM and a binder resin in a solvent, on the CGL 2 and then drying the coated liquid. Suitable CTMs for use in the CTL 3 include electron transporting materials and positive hole transporting materials mentioned above for use in the CGL 2. Charge transport polymers can be preferably used for the CTL 3 because the resultant CTL 3 is hardly dissolved by a coating liquid for the crosslinked charge transport layer 4 to be formed on the CTL 3.

Specific examples of the binder resin include thermoplastic resins, thermosetting resins and photo-crosslinking resins such as polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, poly-N-vinylcarbazole resins, acrylic resins, silicone resins, epoxy resins, melamine resins, urethane resins, phenolic resins, alkyd resins and the like resins.

The added amount of a CTM in the CTL 3 is preferably from 20 to 300 parts by weight, and more preferably from 40 to 150 parts by weight, per 100 parts by weight of the binder resin included in the CTL 3.

Charge transport materials can be used alone or in combination with a binder resin.

Suitable solvents for use in the CTL coating liquid include the solvents mentioned above for use in the CGL coating liquid. Among these solvents, solvents which can well dissolve the binder resin and CTM to be included in the CTL 2. Solvents can be used alone or in combination.

When the CTL coating liquid is coated, one of the coating methods mentioned above for use in preparing the CGL can be used.

The CTL 3 can optionally include one or more additives such as plasticizers and leveling agents.

Suitable plasticizers for use in the CTL 3 include known plasticizers such as dibutyl phthalate, and dioctyl phthalate, which have been used as plasticizers for popular resins. The added amount of a plasticizer in the CTL 3 is preferably from 0 to 30 parts by weight per 100 parts by weight of the binder resin included in the CTL 3.

Suitable leveling agents for use in the CTL 3 include silicone oils such as dimethylsilicone oils and methylphenylsilicone oils; and polymers and oligomers having a perfluoroalkyl group in a side chain thereof. The added amount of a leveling agent in the CTL 3 is preferably from 0 to 1 part by weight per 100 parts by weight of the binder resin included in the CTL 3.

The thickness of the CTL 3 is not particularly limited, and is preferably from 5 to 40 μm, and more preferably from 10 to 30 μm.

Crosslinked Charge Transport Layer (CCTL)

The CCTL 4 is formed on the CTL 3 by coating a coating liquid (followed by optional drying), and heating or light-irradiating the coated layer to crosslink the layer.

The CCTL 4 is a crosslinked layer having a charge transport function and is prepared by a coating liquid which is prepared by dissolving or dispersing in a proper solvent at least a radical polymerizable monomer which has tri- or more-functional groups (hereinafter referred to as trifunctional monomers) and which does not have a charge transport structure and a radical polymerizable monofunctional monomer, followed by drying and crosslinking.

Suitable trifunctional monomers include monomers which have three or more radical polymerizable groups and which do not have a charge transport structure (such as positive hole transport structure (e.g., triarylamine, hydrazone, pyrazoline and carbazole); and electron transport structure (e.g., condensed polycyclic quinone, diphenoquinone, a cyano group and a nitro group)). As the radical polymerizable groups, any radical polymerizable groups having a carbon-carbon double bond can be used. Suitable radical polymerizable groups include 1-substituted ethylene groups having the below-mentioned formula (2) and 1,1-substituted ethylene groups having the below-mentioned formula (3).

$$CH_2{=}CH{-}X^1{-} \quad (2)$$

wherein $X^1$ represents an arylene group (such as a phenylene group and a naphthylene group), which optionally has a substituent, a substituted or unsubstituted alkenylene group, a —CO— group, a —COO— group, a —CON($R^{10}$) group ($R^{10}$ represents a hydrogen atom, an alkyl group (e.g., a methyl group, and an ethyl group), an aralkyl group (e.g., a benzyl group, a naphthylmethyl group and a phenetyl group), or an aryl group (e.g., a phenyl group and a naphthyl group)) or a S— group.

Specific examples of the groups having formula (2) include a vinyl group, a stylyl group, 2-methyl-1,3-butadienyl group, a vinylcarbonyl group, acryloyloxy group, acryloylamide, vinyl thio ether, etc.

$$CH_2{=}C(Y){-}(X^2)n- \quad (3)$$

wherein Y represents a substituted or unsubstituted alkyl group, a substituted or unsubstituted aralkyl group, a substituted or unsubstituted aryl group (such as phenyl and naphthyl groups), a halogen atom, a cyano group, a nitro group, an alkoxyl group (such as methoxy and ethoxy groups), or a —COOR$^{11}$ group (wherein $R^{11}$ represents a hydrogen atom, a substituted or unsubstituted alkyl group (such as methyl and ethyl groups), a substituted or unsubstituted aralkyl group (such as benzyl and phenethyl groups), a substituted or unsubstituted aryl group (such as phenyl and naphthyl groups) or a —CONR$^{12}$R$^{13}$ group (wherein each of $R^{12}$ and $R^{13}$ represents a hydrogen atom, a substituted or unsubstituted alkyl group (such as methyl and ethyl groups), a substituted or unsubstituted aralkyl group (such as benzyl, naphthylmethyl and phenethyl groups), a substituted or unsubstituted aryl group (such as phenyl and naphthyl groups))); $X^2$ represents a group selected from the groups mentioned above for use in $X^1$ and an alkylene group, wherein at least one of Y and $X^2$ is an oxycarbonyl group, a cyano group, an alkenylene group or an aromatic group; and n is 0 or 1.

Specific examples of the groups having formula (3) include an α-chloroacryloyloxy group, a methacryloyloxy group, an α-cyanoethylene group, an α-cyanoacryloyloxy group, an α-cyanophenylene group, a methacryloylamino group, etc.

Specific examples of the substituents for use in the groups X and Y include halogen atoms, a nitro group, a cyano group, alkyl groups (such as methyl and ethyl groups), alkoxy groups (such as methoxy and ethoxy groups), aryloxy groups (such as a phenoxy group), aryl groups (such as phenyl and naphthyl groups), aralkyl groups (such as benzyl and phenethyl groups), etc.

Among these radical polymerizable tri- or more-functional groups, acryloyloxy groups and methacryloyloxy groups having three or more functional groups are preferably used. Compounds having three or more acryloyloxy groups can be prepared by subjecting (meth)acrylic acid (salts), (meth) acrylhalides and (meth)acrylates, which have three or more hydroxyl groups, to an ester reaction or an ester exchange reaction. The three or more radical polymerizable groups included in the radical polymerizable monomers are the same as or different from the others.

Specific examples of the radical polymerizable tri- or more-functional monomers include trimethylolpropane triacrylate (TMPTA), trimethylolpropane trimethacylate, trimethylolpropane alkylene-modified triacrylate, trimethylolpropane ethyleneoxy-modified triacrylate, trimethylolpropane propyleneoxy-modified triacrylate, trimethylolpropane caprolactone-modified triacrylate, trimethylolpropane alkylene-modified trimethacrylate, pentaerythritol triacrylate, pentaerythritol tetraacrylate (PETTA), glycerol triacrylate, glycerol epichlorohydrin-modified triacrylate, glycerol ethyleneoxy-modified triacrylate, glycerol propyleneoxy-modified triacrylate, tris(acryloxyethyl)isocyanurate, dipentaerythritol caprolactone-modified hexaacrylate, dipentaerythritol hydroxypentaacrylate, alkylated dipentaerythritol tetraacrylate, alkylated dipentaerythritol triacrylate, dimethylolpropane tetraacrylate (DTMPTA), pentaerhythritol ethoxytriacrylate, ethyleneoxy-modified triacryl phosphate, 2,2,5,5-tetrahydroxymethylcyclopentanone tetraacrylate, etc. These monmers are used alone or in combination.

In order to form a dense crosslinked network in the crosslinked charge transport layer, the ratio (Mw/F) of the molecular weight (Mw) of the tri- or more-functional monomer to the number of functional groups (F) included in a molecule of the monomer is preferably not greater than 250. When the number is too large, the resultant CCTL becomes soft and thereby the abrasion resistance of the layer slightly deteriorates. In this case, it is not preferable to use only one monomer having a functional group having a long chain group such as ethylene oxide, propylene oxide and caprolactone.

The content of the unit obtained from the tri- or more-functional monomers in the CCTL is preferably from 20 to 80% by weight, and more preferably from 30 to 70% by weight based on the total weight of the CCTL. When the content is too low, the three dimensional crosslinking density is low, and thereby good abrasion resistance cannot be imparted to the CCTL. In contrast, when the content is too high, the content of the charge transport compound decreases, good charge transport property cannot be imparted to the CCTL. In order to balance the abrasion resistance and charge transport property of the CCTL, the content of the unit obtained from the tri- or more-functional monomers in the CCTL is preferably from 30 to 70% by weight.

Suitable radical polymerizable monofunctional monomers having a charge transport structure for use in preparing the CCTL include compounds having one radical polymerizable functional group and a charge transport structure such as positive hole transport groups (e.g., triarylamine, hydrazone, pyrazoline and carbazole groups) and electron transport groups (e.g., electron accepting aromatic groups such as condensed polycyclic quinine, diphenoquinone, cyano and nitro groups). As the functional group of the radical polymerizable monofunctional monomers, acryloyloxy and methacryloyloxy groups are preferably used. Among the charge transport groups, triarylamine groups are preferably used. Among the triarylamine groups, compounds having the following formula (4) or (5) are preferably used because of having good electric properties (i.e., high photosensitivity and low residual potential)

formula (4)

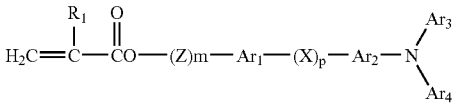

formula (5)

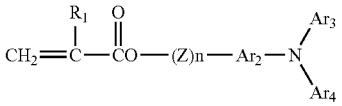

In formulae (4) and (5), $R^1$ represents a hydrogen atom, a halogen atom, a substituted or unsubstituted alkyl group, a substituted or unsubstituted aralkyl group, a substituted or unsubstituted aryl group, a cyano group, a nitro group, an alkoxy group, a —$COOR^7$ group (wherein $R^7$ represents a hydrogen atom, a substituted or unsubstituted alkyl group, a substituted or unsubstituted aralkyl group and a substituted or unsubstituted aryl group) a halogenated carbonyl group or a —$CONR^8R^9$ (wherein each of $R^8$ and $R^9$ represents a hydrogen atom, a substituted or unsubstituted alkyl group, a substituted or unsubstituted aralkyl group and a substituted or unsubstituted aryl group); each of $Ar^1$ and $Ar^2$ represents a substituted or unsubstituted arylene group; each of $Ar^3$ and $Ar^4$ represents a substituted or unsubstituted arylene group; X represents a substituted or unsubstituted alkylene group, a substituted or unsubstituted cycloalkylene group, a substituted or unsubstituted alkylene ether group, an oxygen atom, a sulfur atom or a vinylene group; Z represents a substituted or unsubstituted alkylene group, a substituted or unsubstituted divalent alkylene ether group, or a substituted or unsubstituted divalent alkyleneoxy carbonyl group; each of m and n is 0 or an integer of from 1 to 3; and p is 0 or 1.

In formulae (4) and (5), specific examples of the alky, aryl, aralkyl, and alkoxy groups for use in $R^1$ include the following.

Alkyl Group

Methyl, ethyl, propyl and butyl groups.

Aryl Group

Phenyl and naphthyl groups, etc.

Aralkyl Group

Benzyl, phenethyl and naphthylmethyl groups.

Alkoxy Group

Methoxy, ethoxy and propoxy groups.

These groups may be substituted with a halogen atom, a nitro group, a cyano group, an alkyl group (such as methyl and ethyl groups), an alkoxy group (such as methoxy and ethoxy groups), an aryloxy group (such as a phenoxy group), an aryl group (such as phenyl and naphthyl groups), an aralkyl group (such as benzyl and phenethyl groups), etc.

Among these substituents, a hydrogen atom and a methyl group are preferable.

Suitable substituted or unsubstituted aryl group for use as $Ar^3$ and $Ar^4$ include condensed polycyclic hydrocarbon groups, non-condensed cyclic hydrocarbon groups, and heterocyclic groups.

Specific examples of the condensed polycyclic hydrocarbon groups include compounds in which 18 or less carbon atoms constitute one or more rings, such as pentanyl, indecenyl, naphthyl, azulenyl, heptalenyl, biphenilenyl, as-indacenyl, s-indacenyl, fluorenyl, acenaphthylenyl, preiadenyl, acenaphthenyl, phenarenyl, phenanthoryl, anthoryl, fluorantenyl, acephenanthorylenyl, aceanthorylenyl, triphenylenyl, pyrenyl, chrysenyl, and naphthasenyl groups.

Specific examples of the non-condensed cyclic hydrocarbon groups include monovalent groups of benzene, diphenyl ether, polyethylene diphenyl ether, diphenyl thioether, and diphenyl sulfone; monovalent groups of non-condensed polycyclic hydrocarbon groups such as biphenyl, polyphenyl, diphenyl alkans, diphenylalkenes, diphenyl alkyne, triphenyl methane, distyryl benzene, 1,1-diphenylcycloalkanes, polyphenyl alkans, polyphenyl alkenes; and ring aggregation hydrocarbons such as 9,9-diphenyl fluorenone.

Specific examples of the heterocyclic groups include monovalent groups of carbazole, dibenzofuran, dibenzothiophene, oxadiazole, and thiadiazole.

The aryl groups for use as $Ar^3$ and $Ar^4$ may be substituted with the following groups.

(1) Halogen atoms, and cyano and nitro groups.

(2) Linear or branched alkyl groups which preferably have from 1 to 12 carbon atoms, more preferably from 1 to 8 carbon atoms and even more preferably from 1 to 4 carbon atoms. These alkyl groups can be further substituted with another group such as a fluorine atom, a hydroxyl group, a cyano group, an alkoxy group having 1 to 4 carbon atoms, and a phenyl group which may be further substituted with a halogen atom, an alkyl group having 1 to 4 carbon atoms, or an alkoxy group having 1 to 4 carbon atoms. Specific examples of the alkyl groups include methyl, ethyl, n-propyl, iso-propyl, n-butyl, sec-butyl, t-butyl, trifluoromethyl, 2-hydroxyethyl, 2-ethoxyethyl, 2-cyanoethyl, 2-methoxyethyl, benzyl, 4-chlorobenzyl, 4-methylbenzyl and 4-phenylbenzyl groups.

(3) Alkoxy groups (i.e., —$OR_2$). R2 represents one of the alkyl groups defined above in paragraph (2). Specific examples of the alkoxy groups include methoxy, ethoxy, n-propoxy, iso-propoxy, t-butoxy, n-butoxy, s-butoxy, iso-butoxy, 2-hydroxyethoxy, benzyloxy and trifluoromethoxy groups.

(4) Aryloxy groups. Specific examples of the aryl group of the acryloxy groups include phenyl and naphthyl groups. The aryloxy groups may be substituted with an alkoxy group -having from 1 to 4 carbon atoms, an alkyl group having from 1 to 4 carbon atoms, or a halogen atom. Specific examples of the groups include phenoxy, 1-naphthyloxy, 2-naphthyloxy, 4-methoxyphenoxy, and 4-methylphenoxy groups.

(5) Alkylmercapto or arylmercapto group. Specific examples of the groups include methylthio, ethylthio, phenylthio, and p-methylphenylthio groups (6) Groups having the following formula (6).

formula (6)

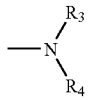

In formula (6), each of $R_3$ and $R_4$ represents a hydrogen atom, one of the alkyl groups defined in paragraph (2) or an aryl group (such as phenyl, biphenyl, and naphthyl groups). These groups may be substituted with another group such as an alkoxy group having from 1 to 4 carbon atoms, an alkyl group having from 1 to 4 carbon atoms, and a halogen atom. In addition, $R_3$ and $R_4$ optionally share bond connectivity to form a ring.

Specific examples of the groups having formula (6) include amino, diethylamino, N-methyl-N-phenylamino, N,N-diphenylamino, N,N-di(tolyl)amino, dibenzylamino, piperidino, morpholino, and pyrrolidino groups.

(7) Alkylenedioxy or alkylenedithio groups such as methylenedioxy and methylenedithio groups.

(8) Substituted or unsubstituted styryl groups, substituted or unsubstituted β-phenylstyryl groups, diphenylaminophenyl groups, and ditolylaminophenyl groups.

As the arylene groups for use in $Ar^1$ and $Ar^2$, divalent groups delivered from the aryl groups mentioned above for use in $Ar^3$ and $Ar^4$ can be used.

The group X is a substituted or unsubstituted alkylene group, a substituted or unsubstituted cycloalkylene group, a substituted or unsubstituted alkylene ether, an oxygen atom, a sulfur atom, and a vinylene group.

Suitable groups for use as the substituted or unsubstituted alkylene group include linear or branched alkylene groups which preferably have from 1 to 12 carbon atoms, more preferably from 1 to 8 carbon atoms and even more preferably from 1 to 4 carbon atoms. These alkylene groups can be further substituted with another group such as a fluorine atom, a hydroxyl group, a cyano group, an alkoxy group having 1 to 4 carbon atoms, and a phenyl group which may be further substituted with a halogen atom, an alkyl group having 1 to 4 carbon atoms, or an alkoxy group having 1 to 4 carbon atoms. Specific examples of the alkylene groups include methylene, ethylene, n-propylene, iso-propylene, n-butylene, sec-butylene, t-butylene, trifluoromethylene, 2-hydroxyethylene, 2-ethoxyethylene, 2-cyanoethylene, 2-methoxyethylene, benzylidene, phenylethylene, 4-chlorophenylethylene, 4-methylphenylethylene and 4-biphenylethylene groups.

Suitable groups for use in the substituted or unsubstituted cycloalkylene groups include cyclic alkylene groups having from 5 to 7 carbon atoms, which may be substituted with a fluorine atom or another group such as a hydroxyl group, alkyl groups having from 1 to 4 carbon atoms, and alkoxy groups having 1 to 4 carbon atoms. Specific examples of the substituted or unsubstituted cycloalkylene groups include cyclohexylidene, cyclohexylene, and 3,3-dimethylcyclohexylidene groups.

Specific examples of the substituted or unsubstituted alkylene ether groups include ethyleneoxy, propyleneoxy, ethylene glycol, propylene glycol, diethylene glycol, tetraethylene glycol, and tripropylene glycol groups. The alkylene group of the alkylene ether groups may be substituted with another group such as hydroxyl, methyl and ethyl groups.

As the vinylene group, groups having one of the following formulae can be preferably used.

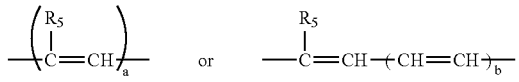

In the above-mentioned formulae, $R_5$ represents a hydrogen atom, one of the alkyl groups mentioned above for use in paragraph (2), or one of the aryl groups mentioned above for use in $Ar^3$ and $Ar^4$, wherein a is 1 or 2, and b is 1, 2 or 3.

In formulae (4) and (5), Z represents a substituted or unsubstituted alkylene group, a substituted or unsubstituted divalent alkylene ether group, a divalent alkyleneoxycarbonyl group. Specific examples of the substituted or unsubstituted alkylene group include the alkylene groups mentioned above for use as X. Specific examples of the substituted or unsubstituted alkylene ether group include the divalent alkylene ether groups mentioned above for use as X. Specific examples of the divalent alkyleneoxycarbonyl group include divalent groups modified by caprolactone.

More preferably, monomers having the following formula (7) are used as the radical polymerizable monofunctional monomer having a charge transport structure.

formula (7)

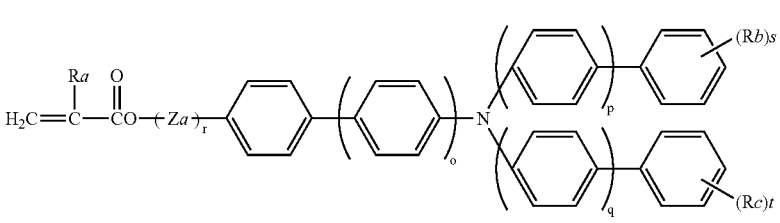

In formula (7), each of o, p and q is 0 or 1; Ra represents a hydrogen atom, or a methyl group; each of Rb and Rc represents an alkyl group having from 1 to 6 carbon atoms, wherein each of Rb and Rc can include plural groups which are the same as or different from each other; each of s and t is 0, 1, 2 or 3; r is 0 or 1; Za represents a methylene group, an ethylene group or a group having one of the following formulae.

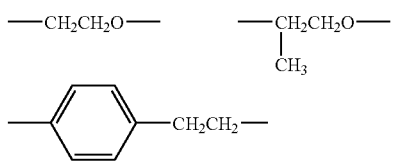

In formula (7), each of Rb and Rc is preferably a methyl group or an ethyl group.

The radical polymerizable monofunctional monomers having formula (4) or (5) (preferably formula (7)), have the following property. Namely, a monofunctional monomer is polymerized while the double bond of a molecule is connected with the double bonds of other molecules. Therefore, the monomer is incorporated in a polymer chain, i.e., in a main chain or a side chain of the crosslinked polymer chain which is formed by the monomer and a radical polymerizable tri- or more-functional monomer. The side chain of the unit obtained from the monofunctional monomer is present between two main polymer chains which are connected by crosslinking chains. In this regard, the crosslinking chains are classified into intermolecular crosslinking chains and intramolecular crosslinking chains.

In any of these case, the triarylamine group which is a pendant of the main chain of the unit obtained from the monofunctional monomer is bulky and is connected with the main chain with a carbonyl group therebetween while not being fixed (i.e., while being fairly free three-dimensionally). Therefore, the crosslinked polymer has little strain, and in addition the CCTL has good charge transport property.

Specific examples of the radical polymerizable monofunctional monomers include the following compounds Nos. 1-160, but are not limited thereto.

No. 1

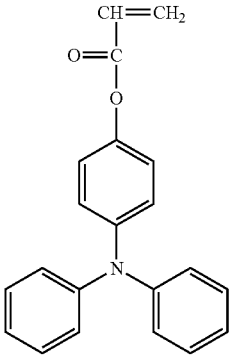

No. 2

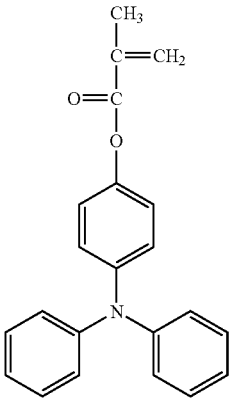

-continued

No. 3

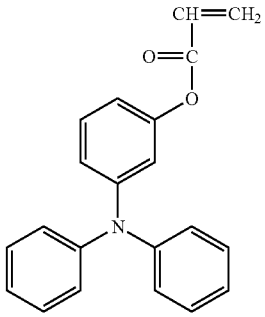

No. 4

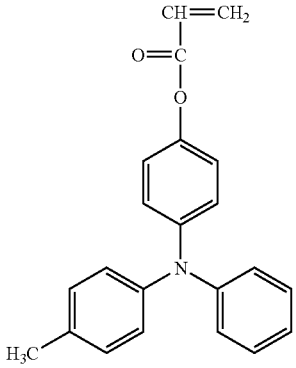

No. 5

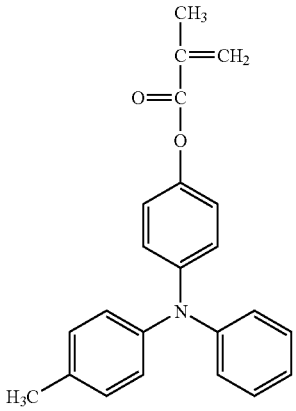

No. 6

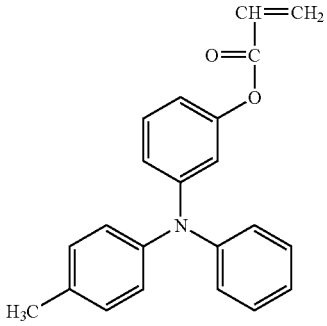

-continued
No. 7
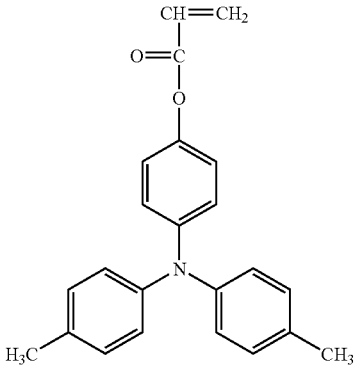
No. 8
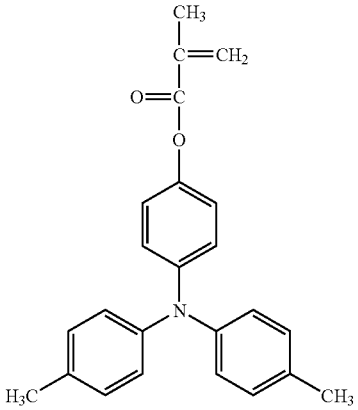
No. 9
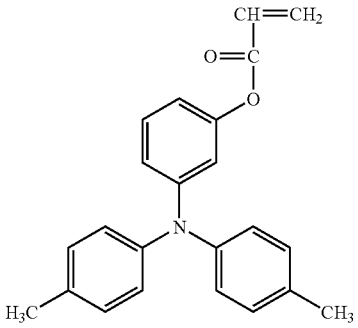
No. 10
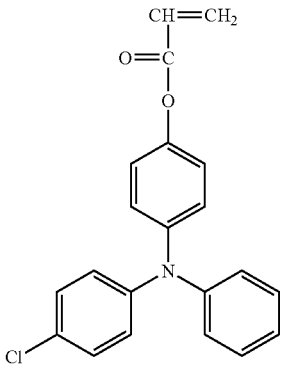
-continued
No. 11
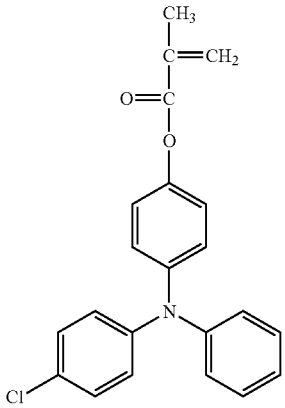
No. 12
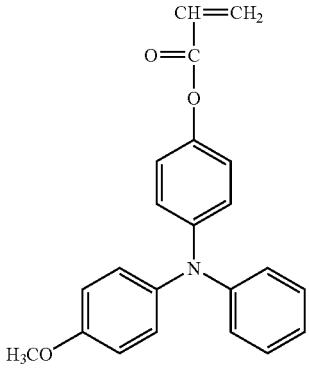
No. 13
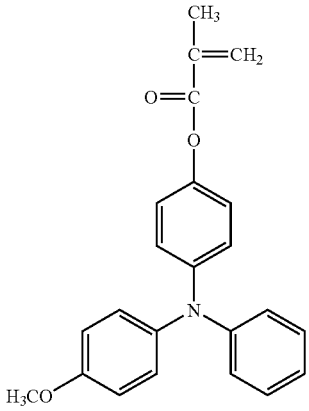
No. 14
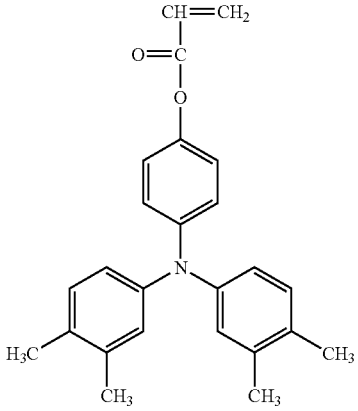

-continued
No. 15
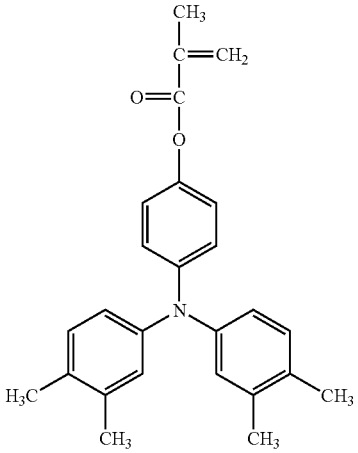
No. 16
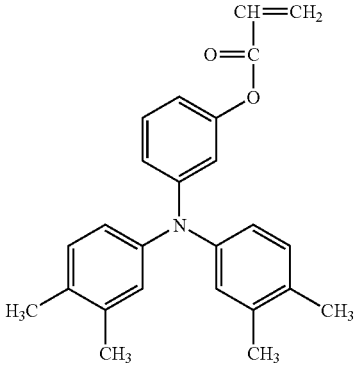
No. 17
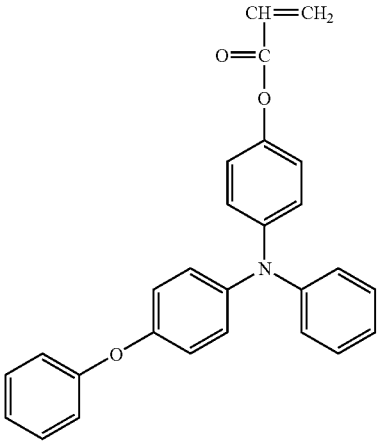
-continued
No. 18
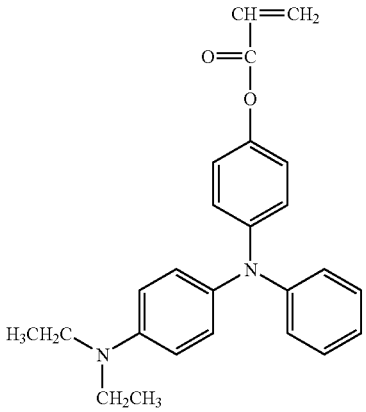
No. 19
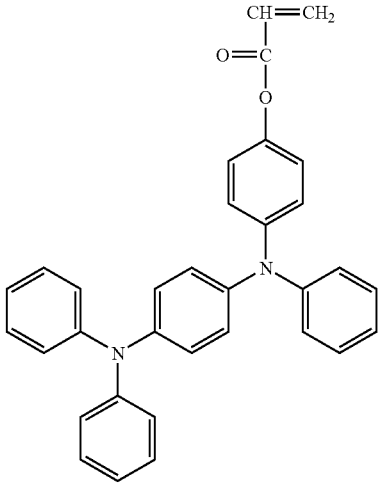
No. 20
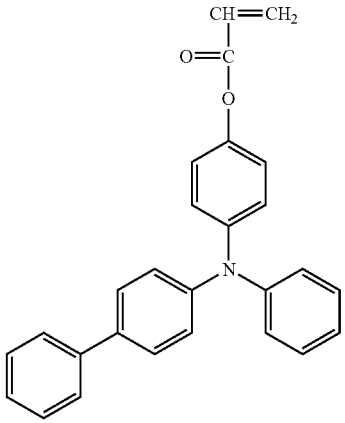

-continued
No. 21
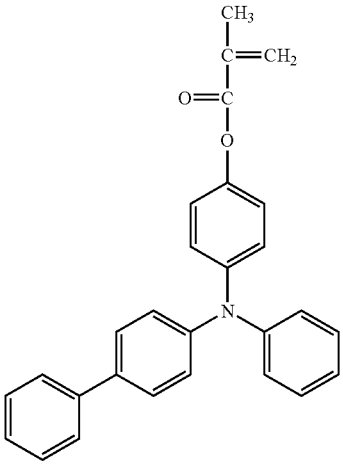
No. 22
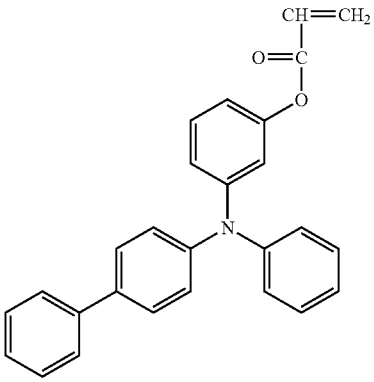
No. 23
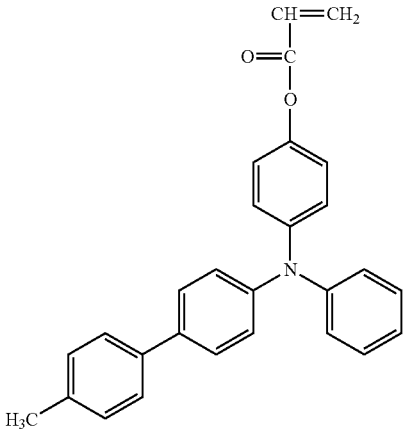
-continued
No. 24
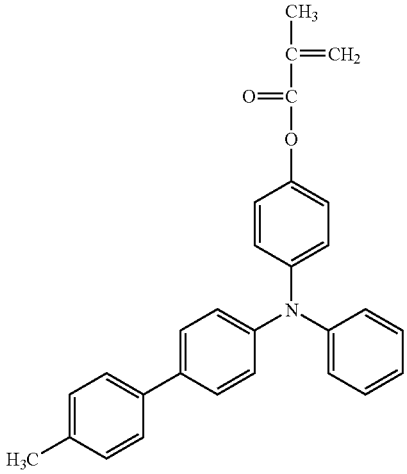
No. 25
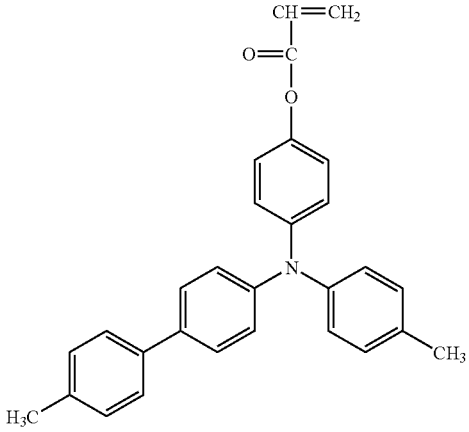
No. 26
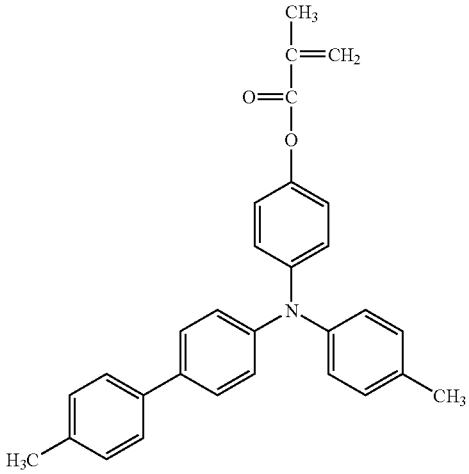

-continued
No. 27
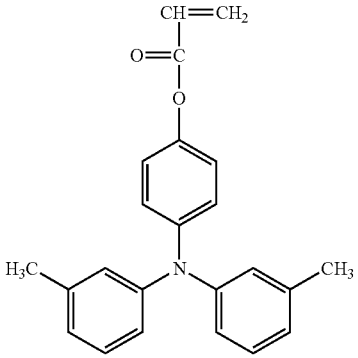
No. 28
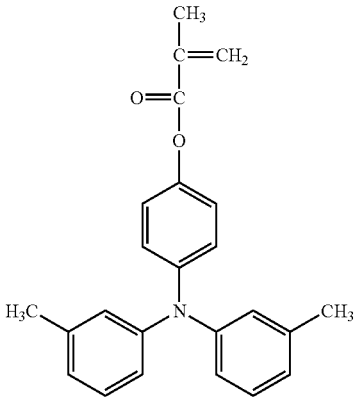
No. 29
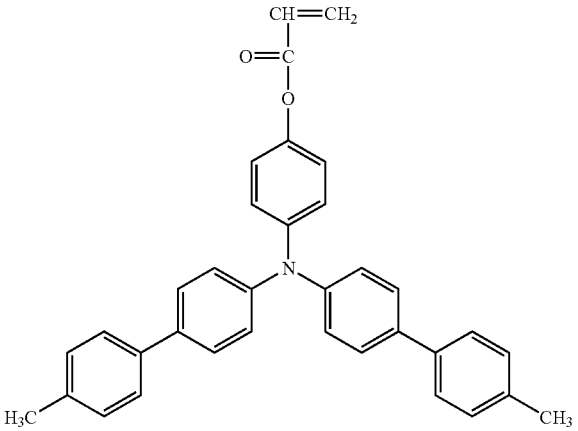
No. 30
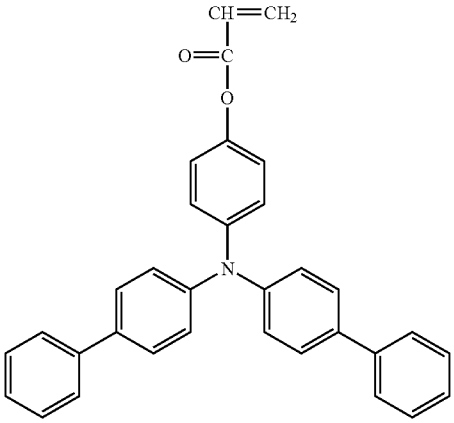
-continued
No. 31
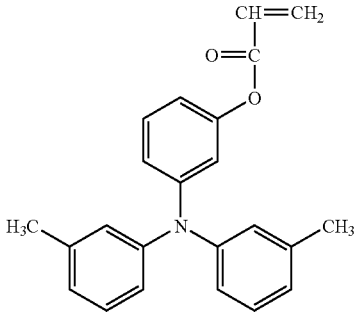
No. 32
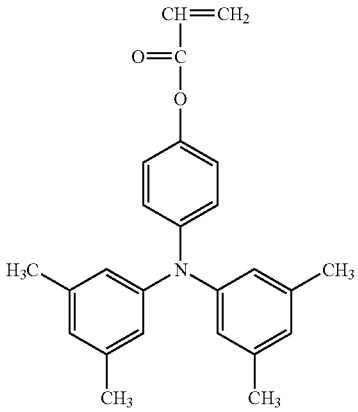
No. 33
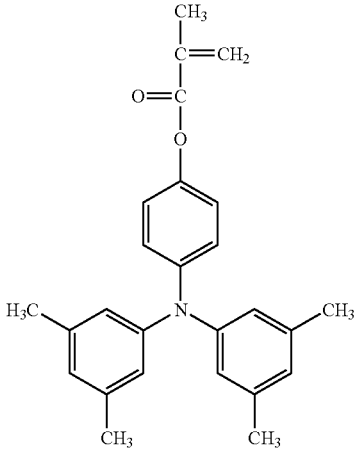
No. 34
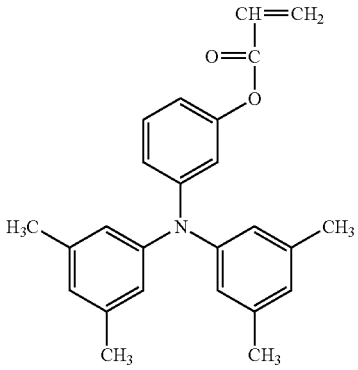

-continued
No. 35
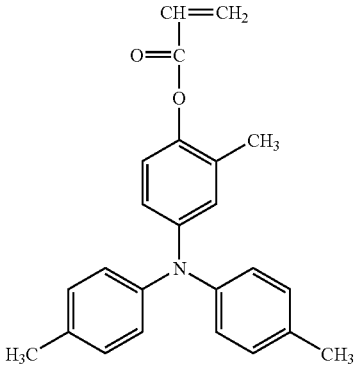
No. 36
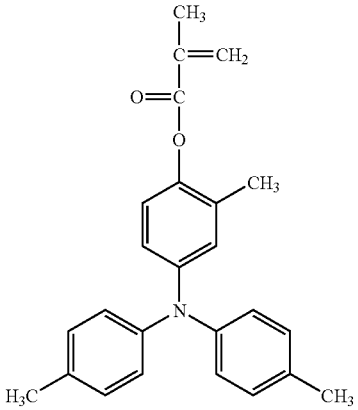
No. 37
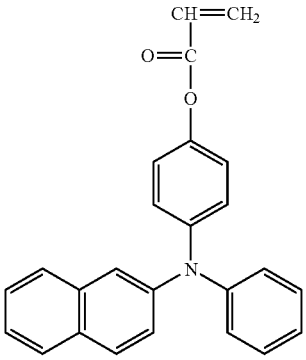
No. 38
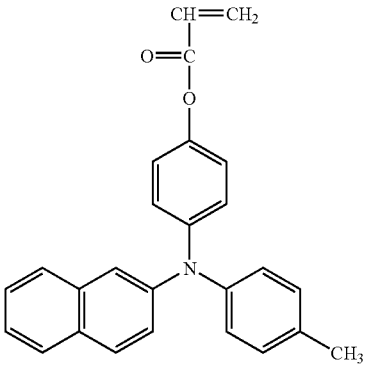
-continued
No. 39
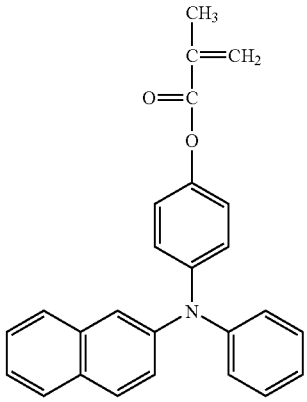
No. 40
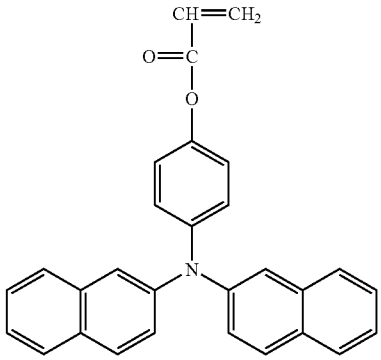
No. 41
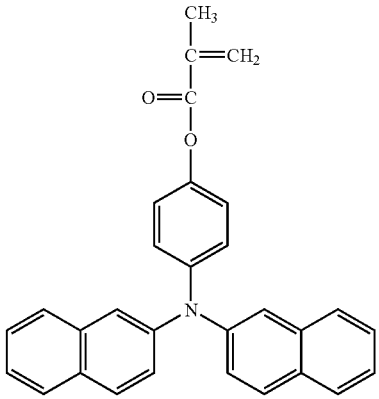

-continued
No. 42
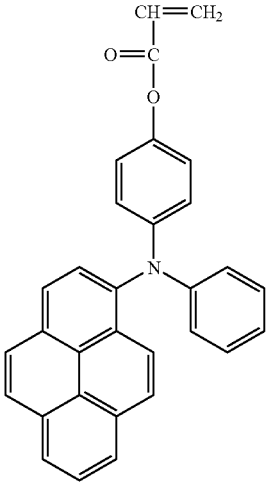
No. 43
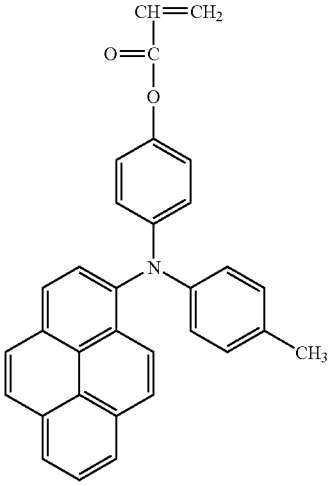
No. 44
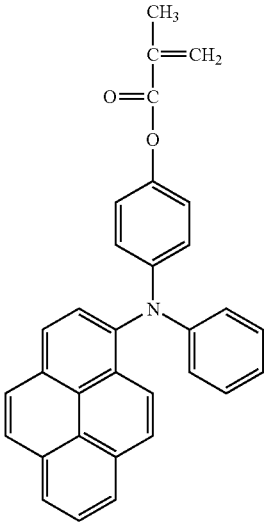
-continued
No. 45
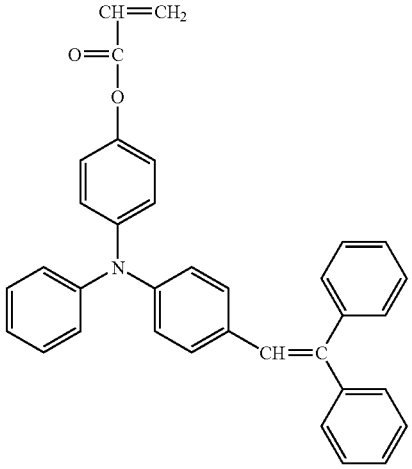
No. 46
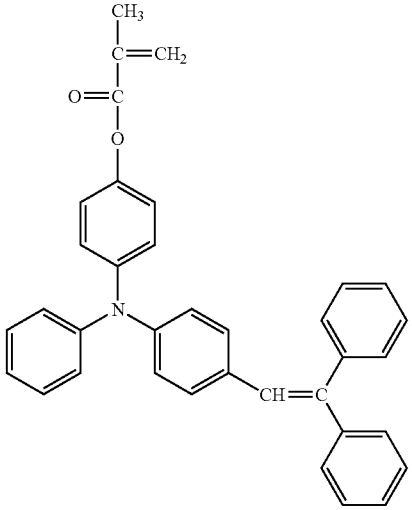
No. 47
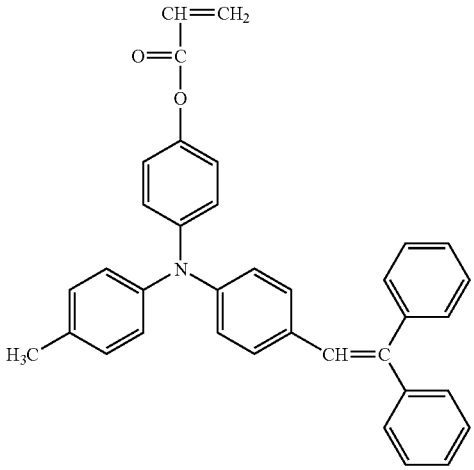

-continued
No. 48
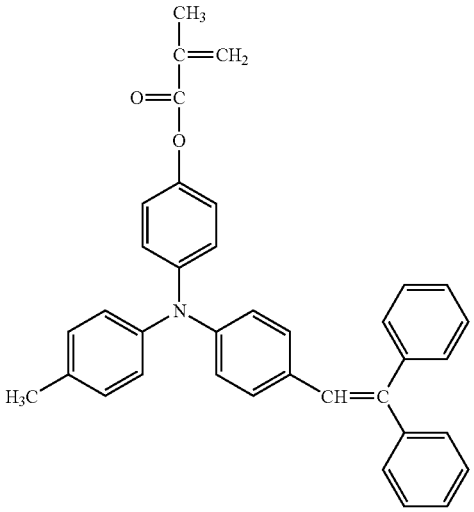
No. 49
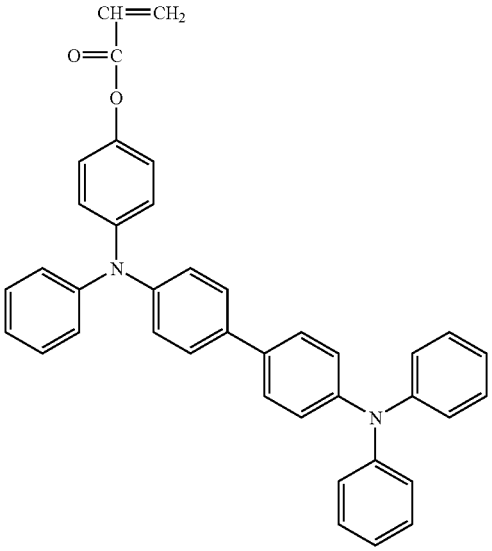
No. 50
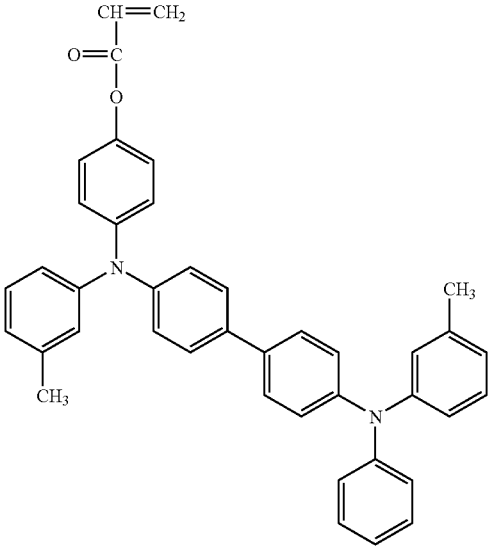
-continued
No. 51
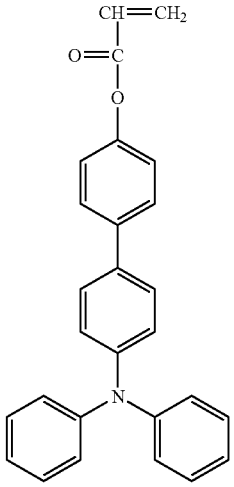
No. 52
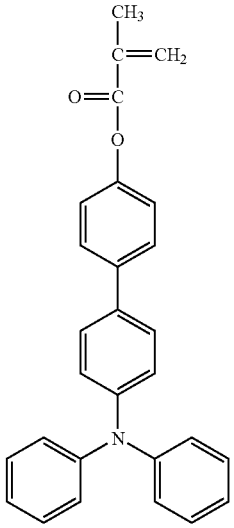
No. 53
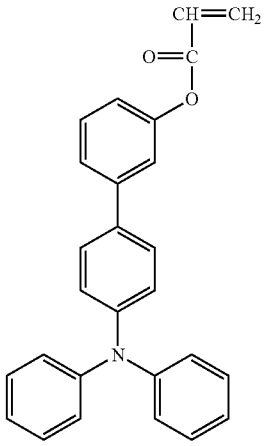

-continued
No. 54
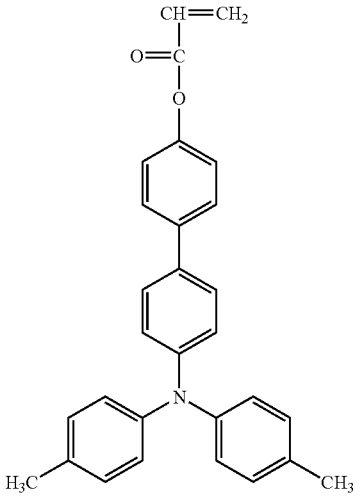
No. 55
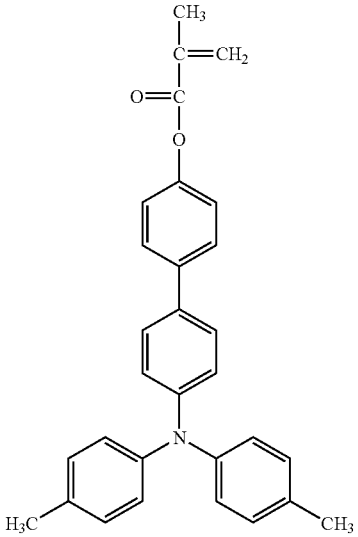
No. 56
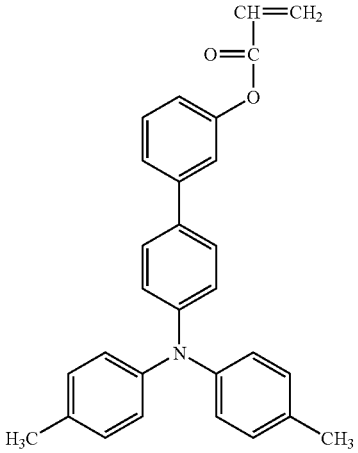
-continued
No. 57
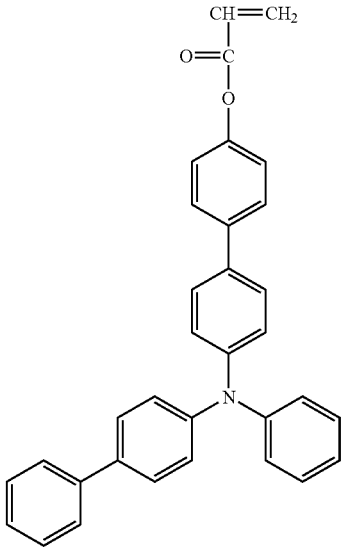
No. 58
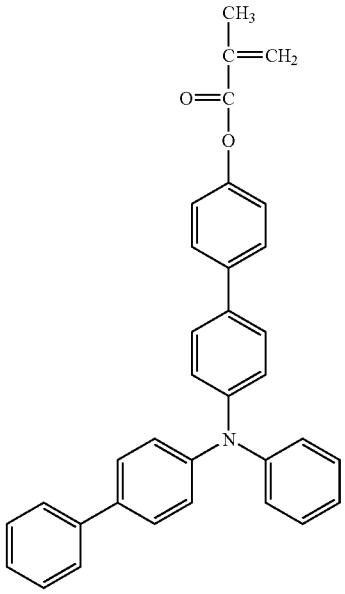

-continued
No. 59
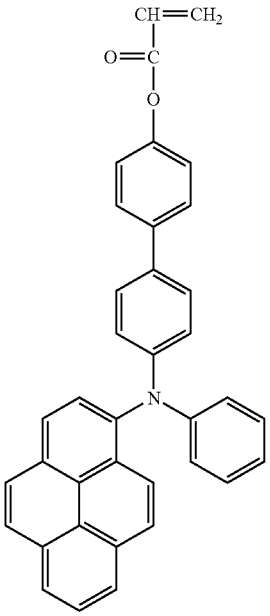
No. 60
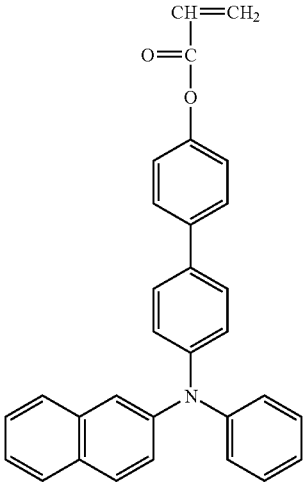
No. 61
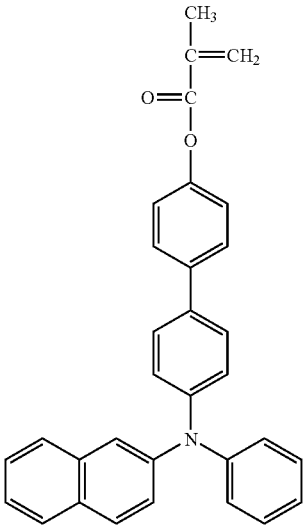
-continued
No. 62
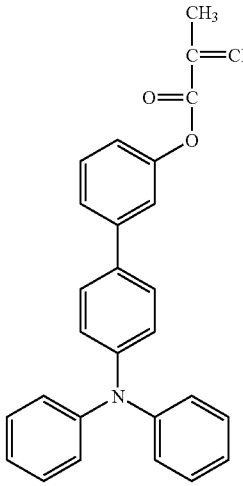
No. 63
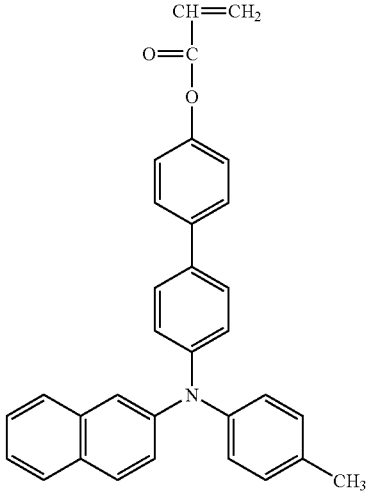
No. 64
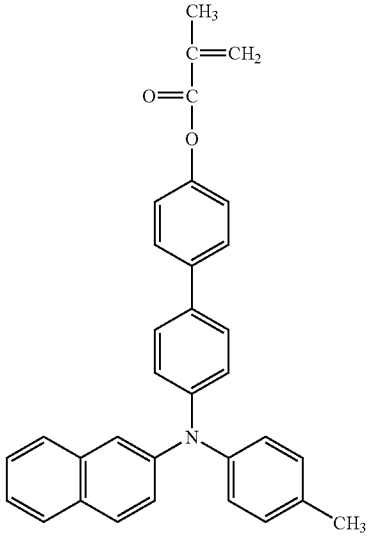

-continued
No. 65
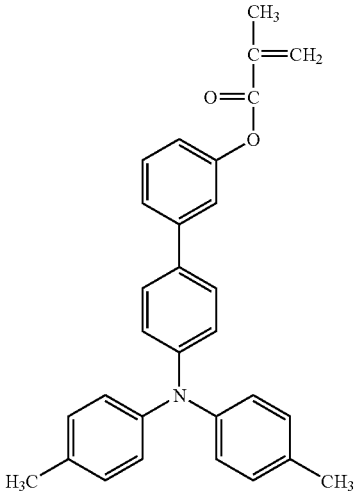
No. 66
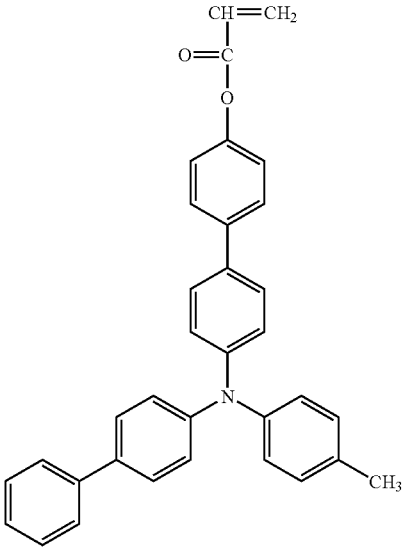
No. 67
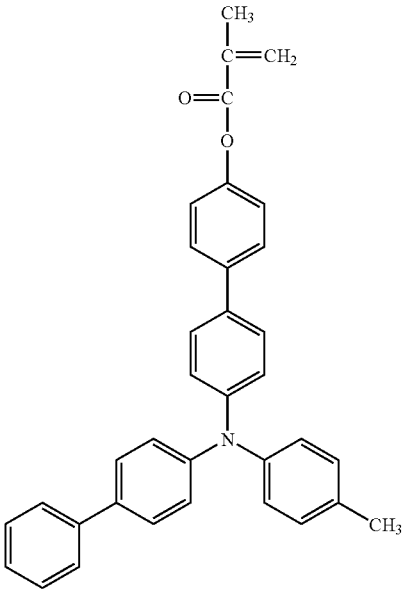
-continued
No. 68
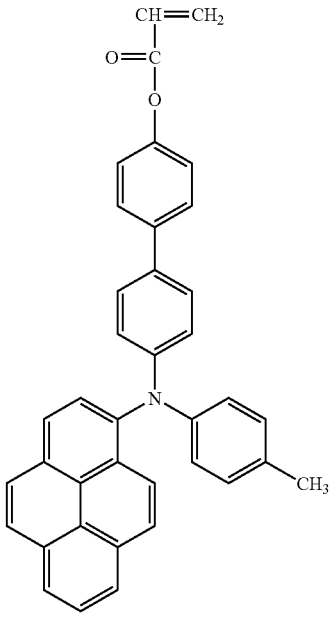
No. 69
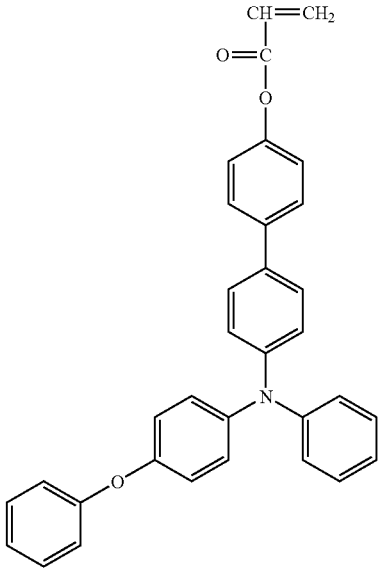

-continued
No. 70
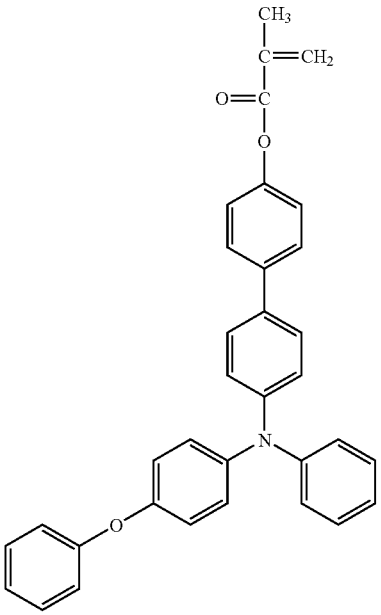
No. 71
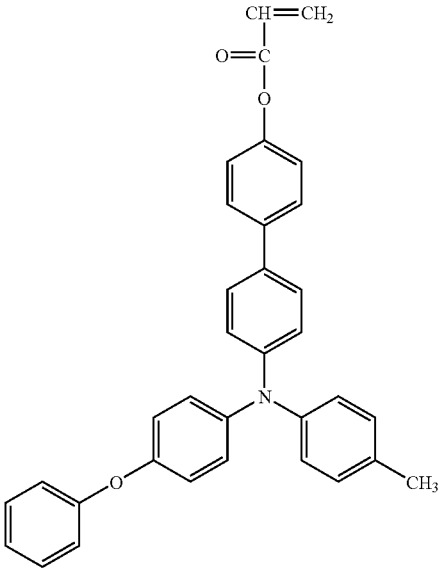
-continued
No. 72
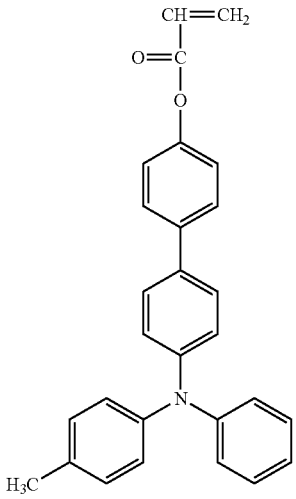
No. 73
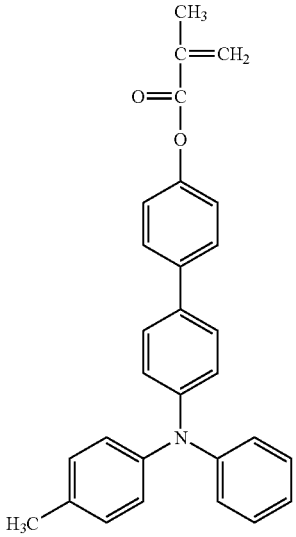
No. 74
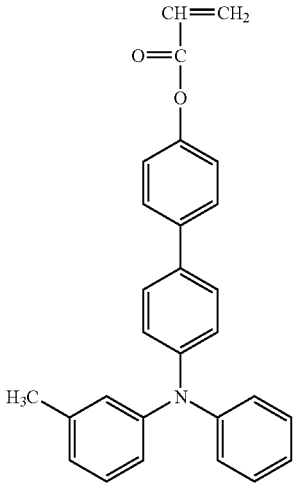

-continued
No. 75
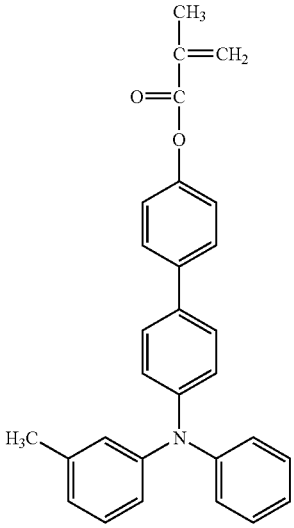
No. 76
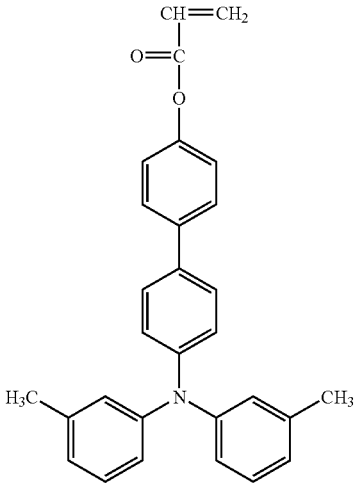
No. 77
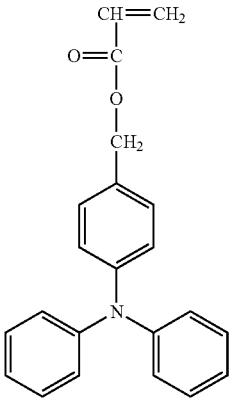
-continued
No. 78
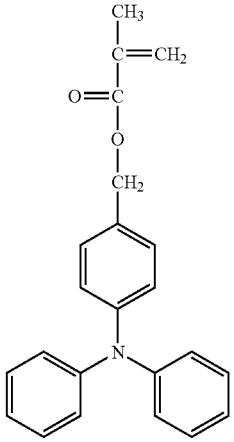
No. 79
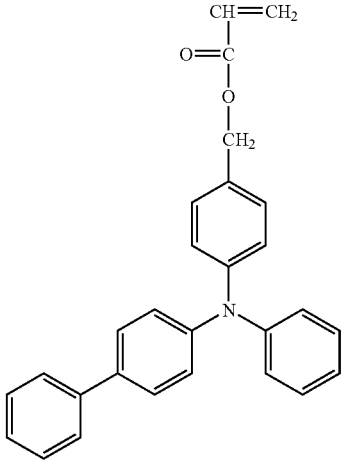
No. 80
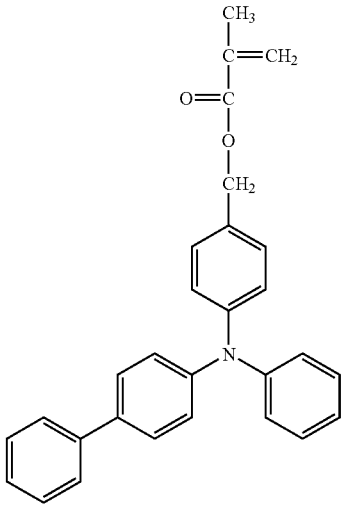

-continued
No. 81
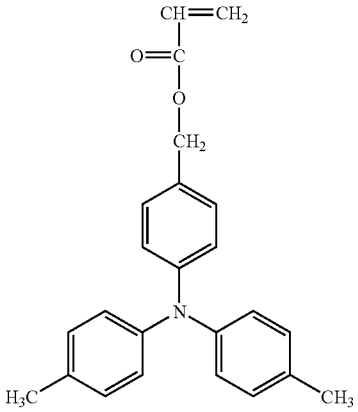
No. 82
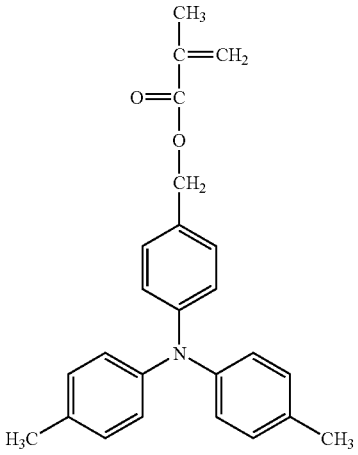
No. 83
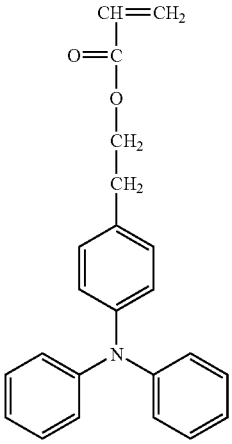
-continued
No. 84
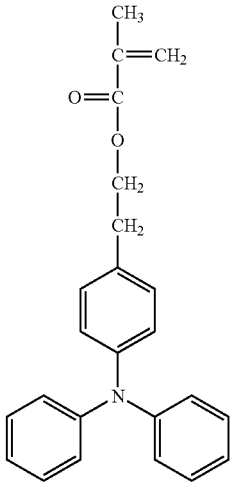
No. 85
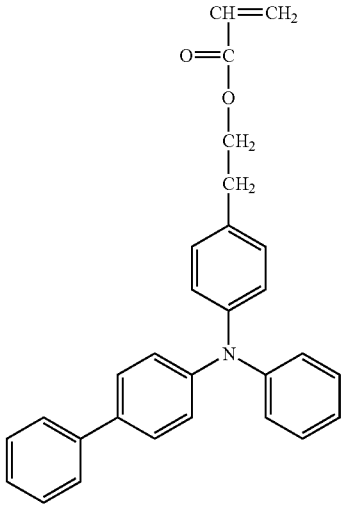
No. 86
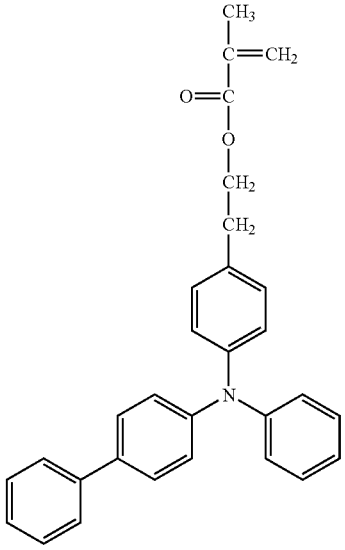

-continued
No. 87
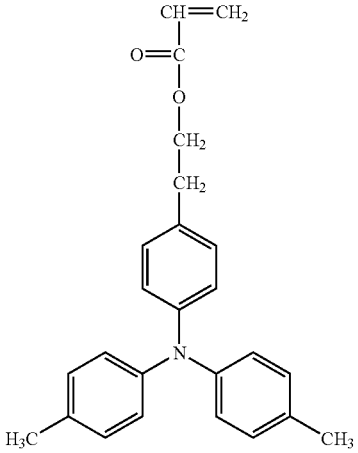
No. 88
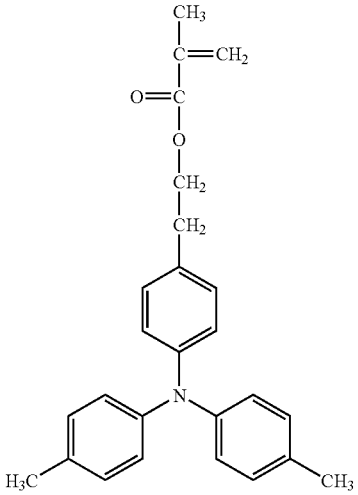
No. 89
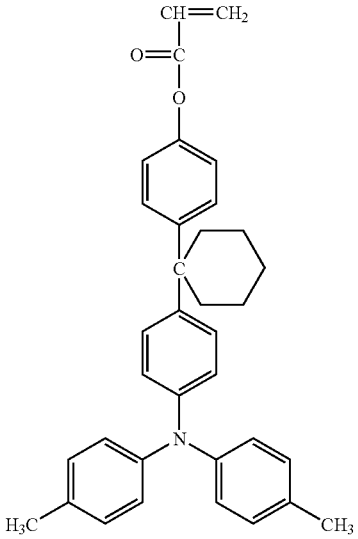
-continued
No. 90
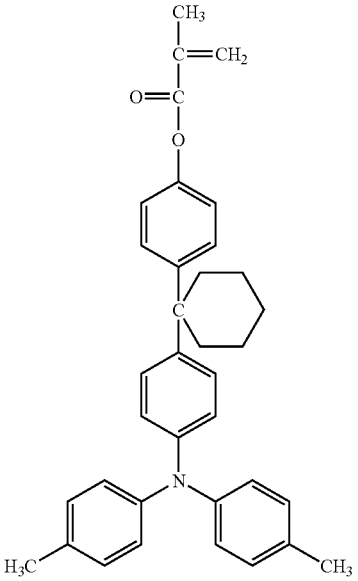
No. 91
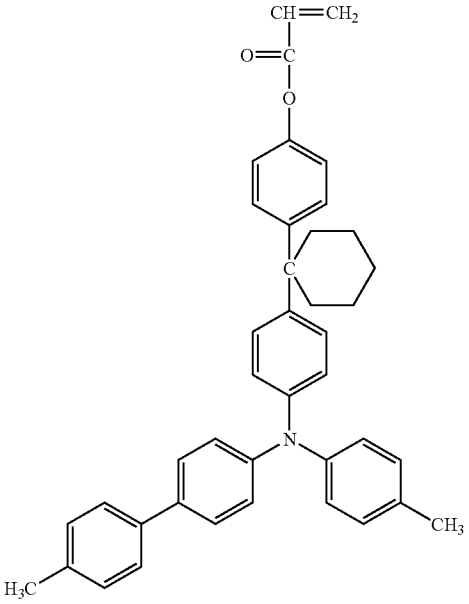

-continued
No. 92
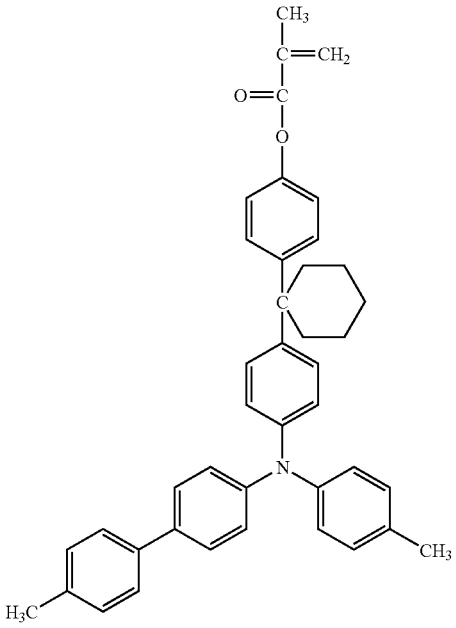
No. 93
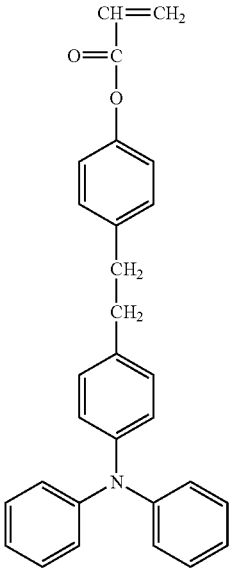
-continued
No. 94
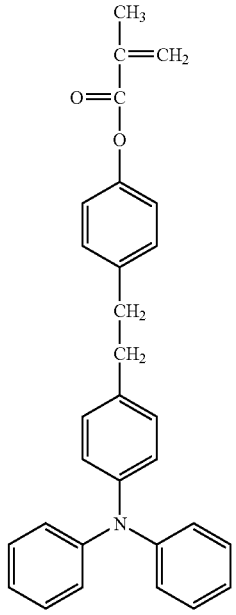
No. 95
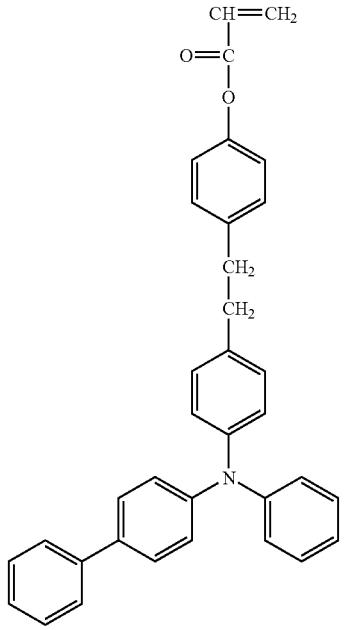

-continued
No. 96
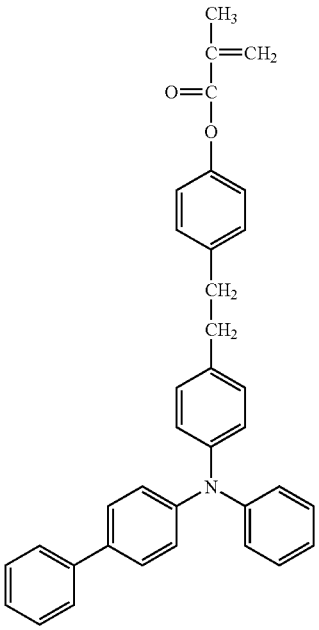
-continued
No. 98
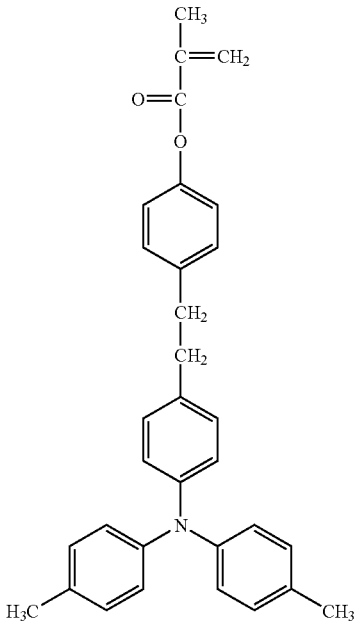
No. 97
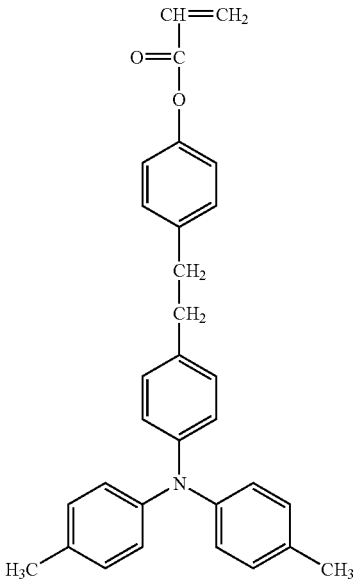
No. 99
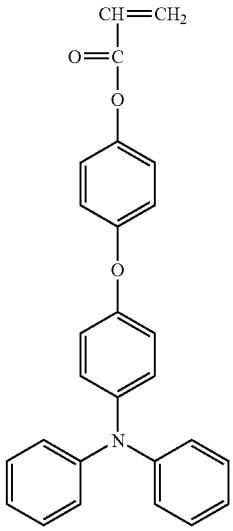

-continued
No. 100
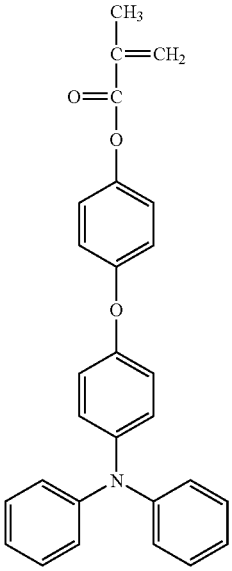
-continued
No. 102
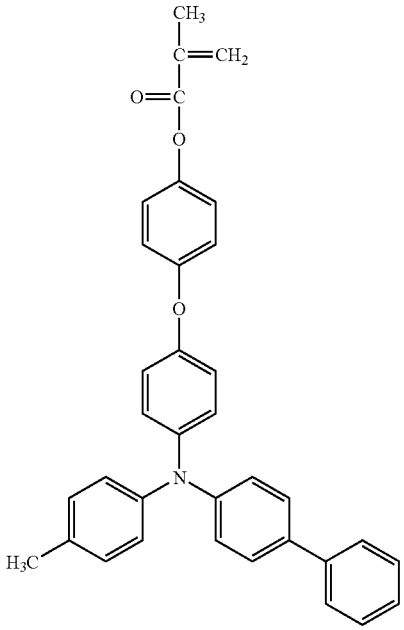
No. 101
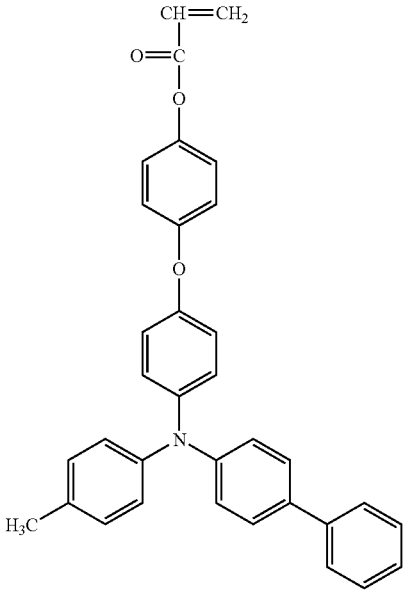
No. 103
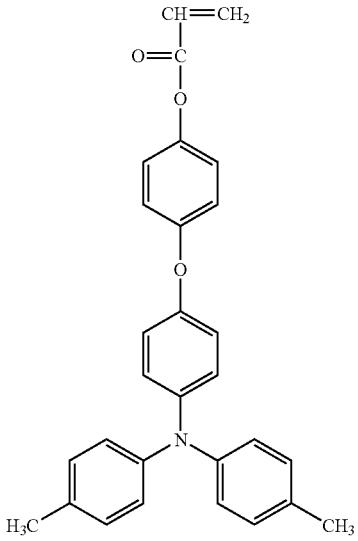

-continued
No. 104
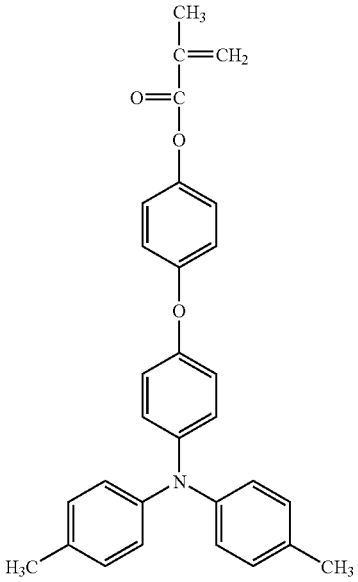
-continued
No. 106
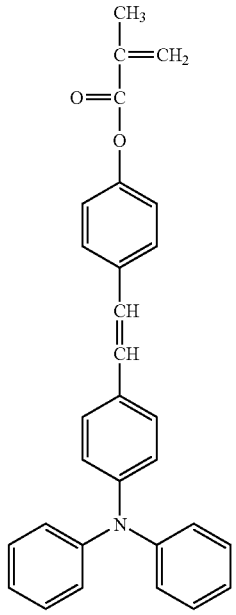
No. 105
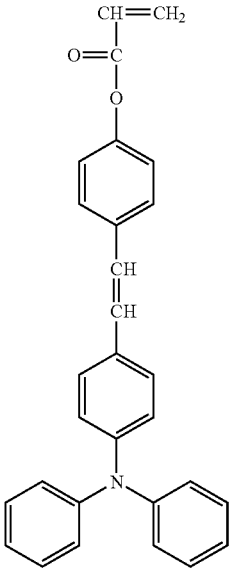
No. 107
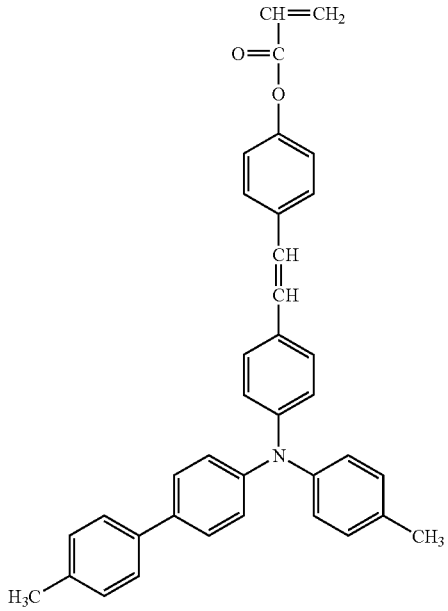

-continued
No. 108
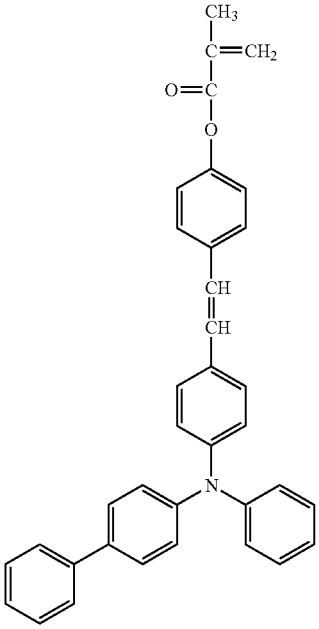
No. 109
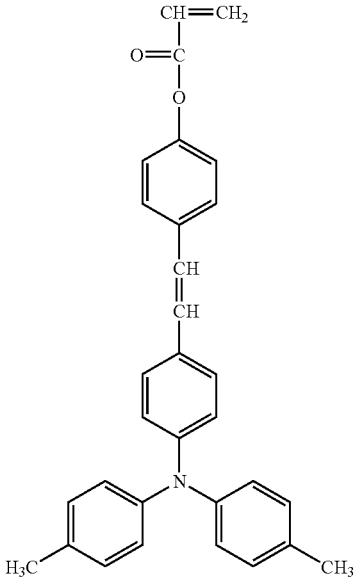
-continued
No. 110
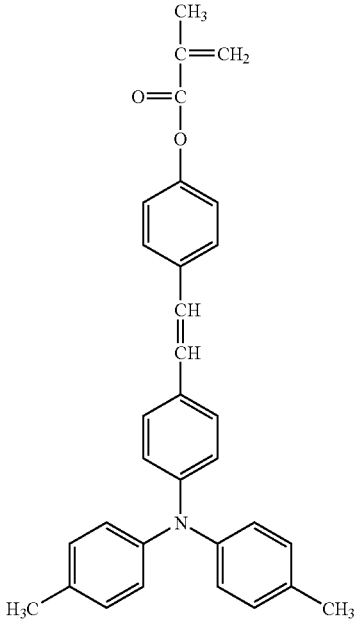
No. 111
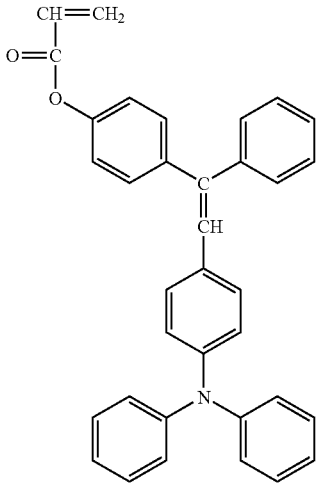
No. 112
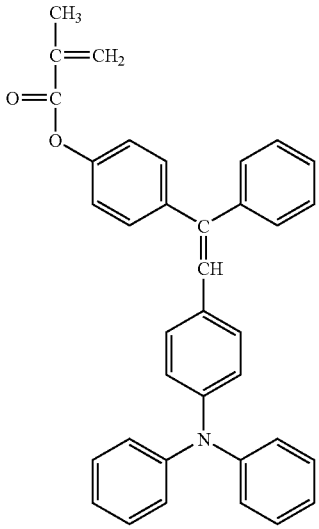

-continued
No. 113
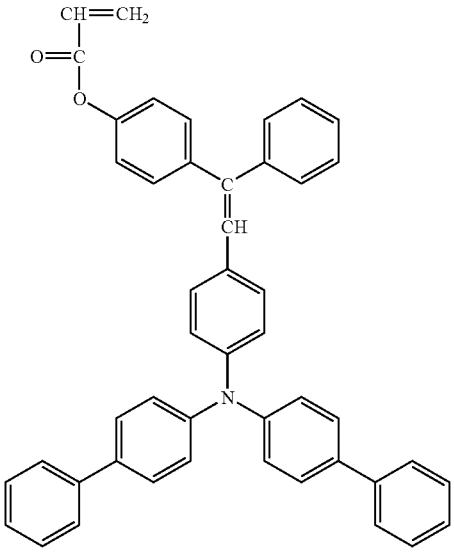
No. 114
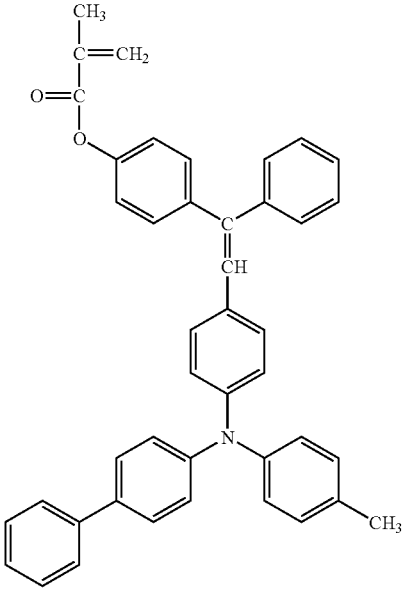
No. 115
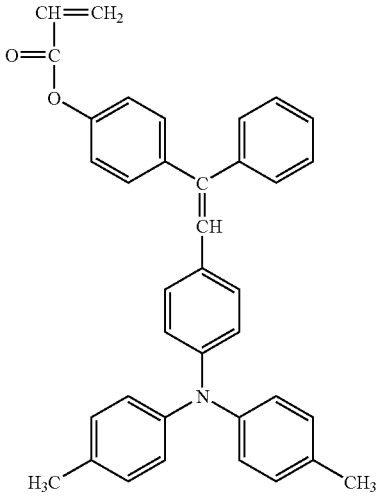
-continued
No. 116
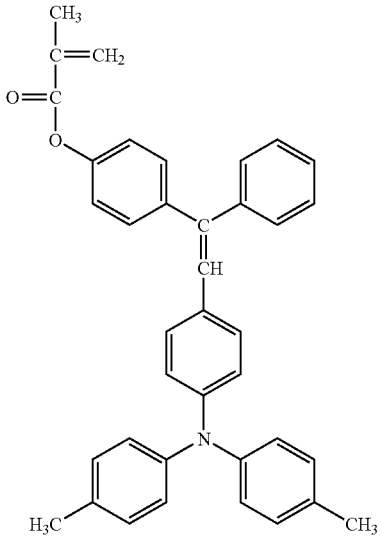
No. 117
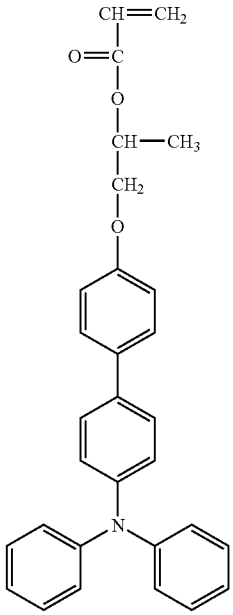

-continued
No. 118
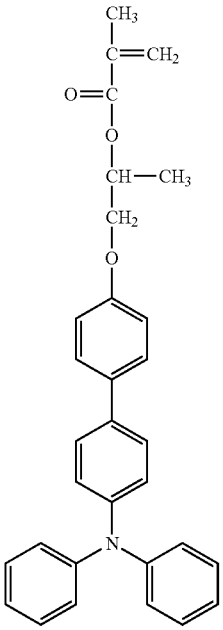
-continued
No. 120
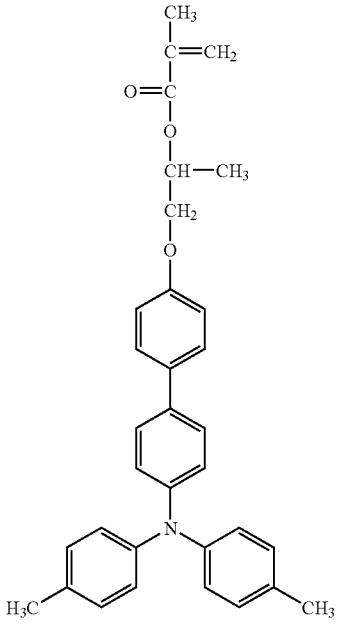
No. 119
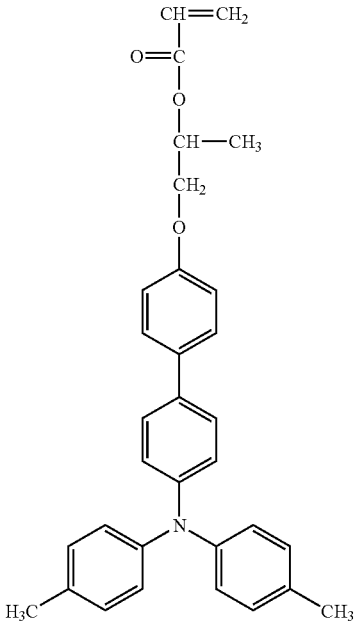
No. 121
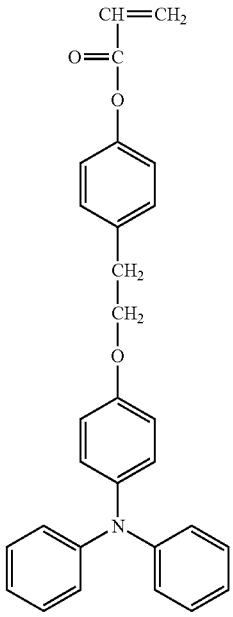

-continued
No. 122
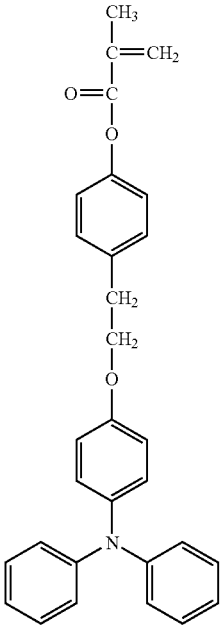
-continued
No. 124
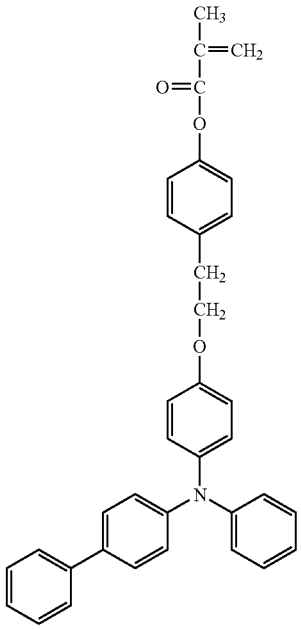
No. 123
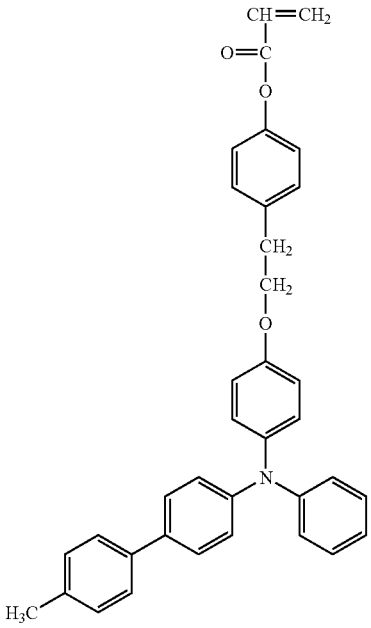
No. 125
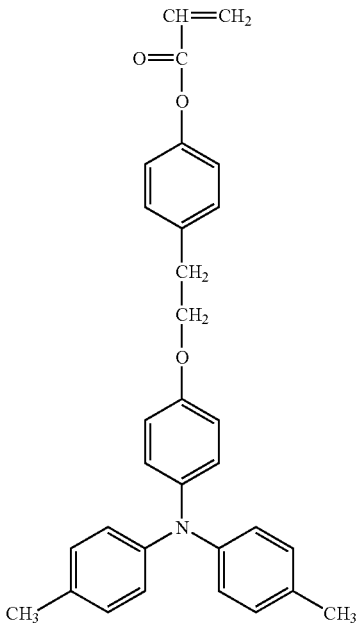

-continued
No. 126
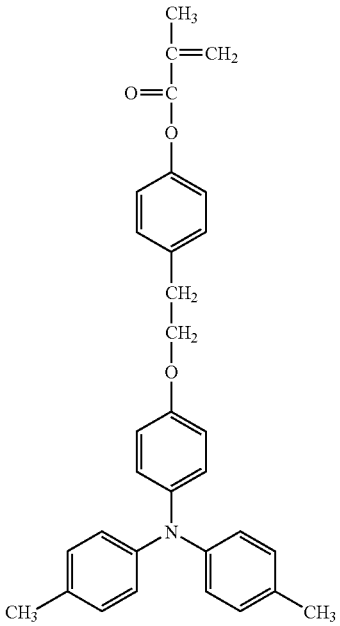
No. 127
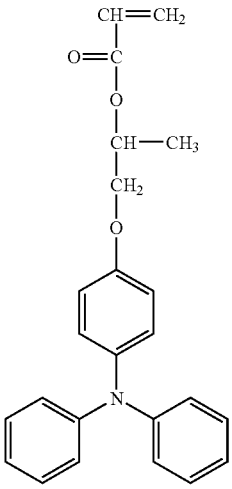
No. 128
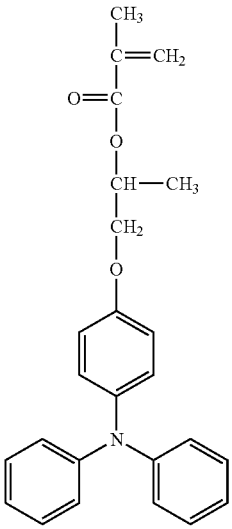
-continued
No. 129
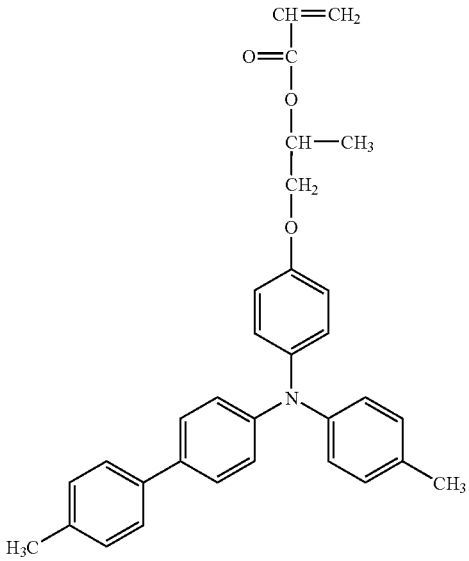
No. 130
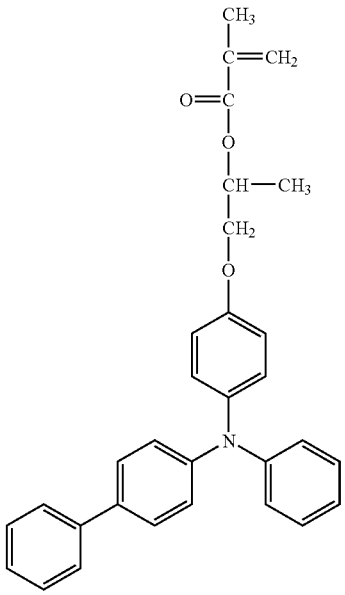

-continued
No. 131
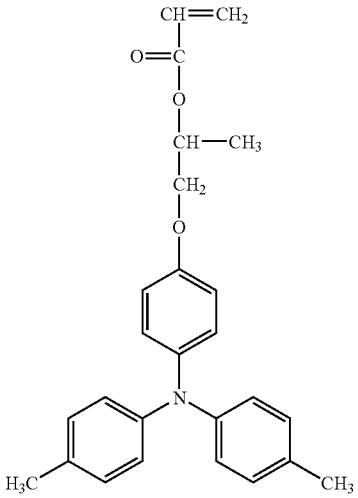
No. 132
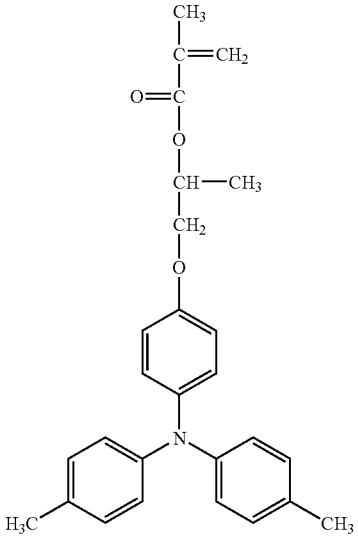
No. 133
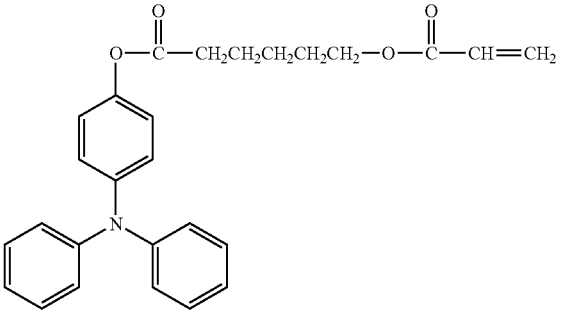
-continued
No. 134
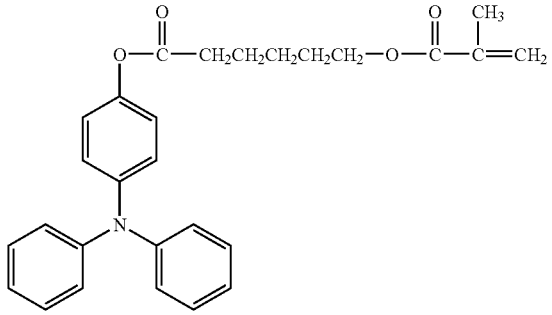
No. 135
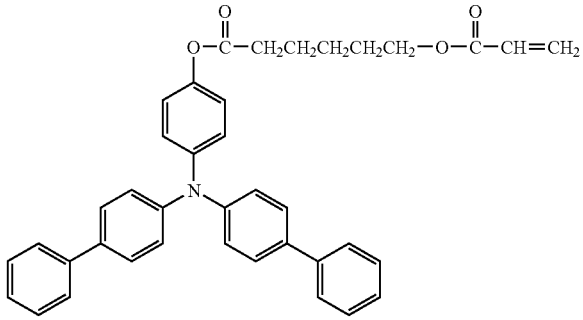
No. 136
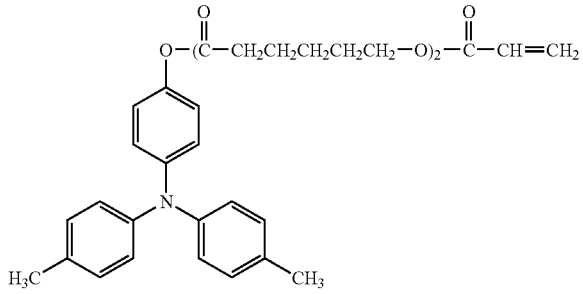
No. 137
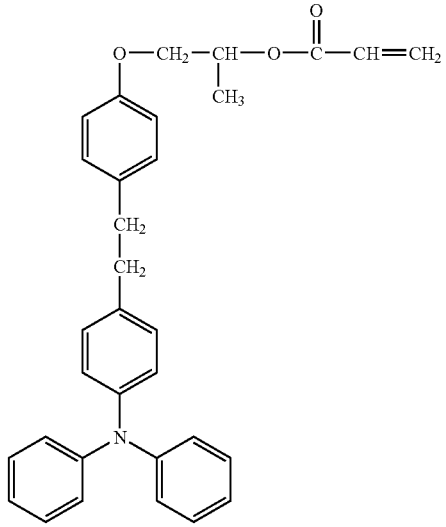

-continued
No. 138
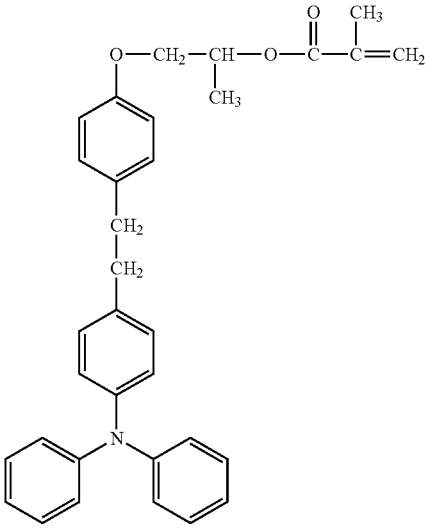
No. 139
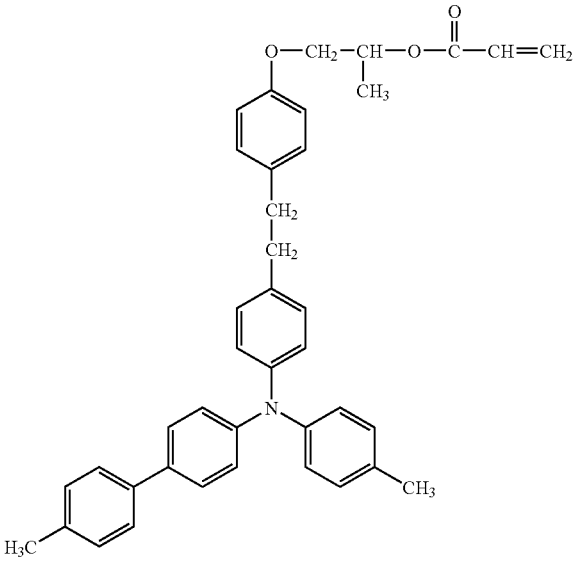
-continued
No. 140
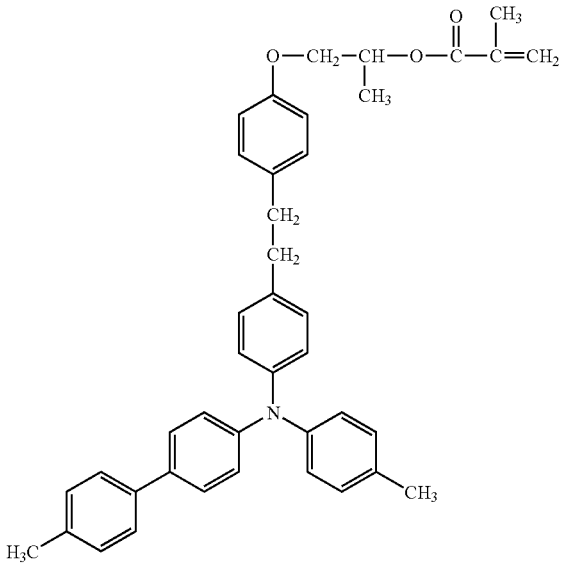
No. 141
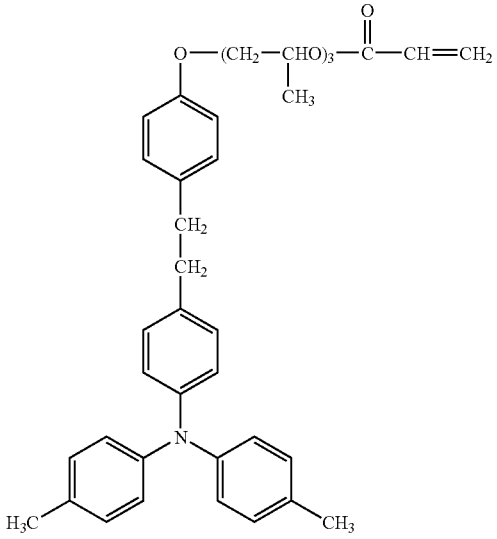

-continued
No. 142
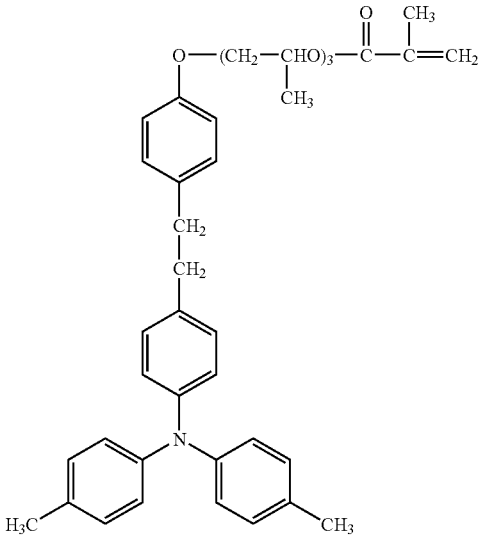
No. 143
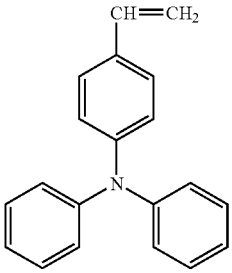
No. 144
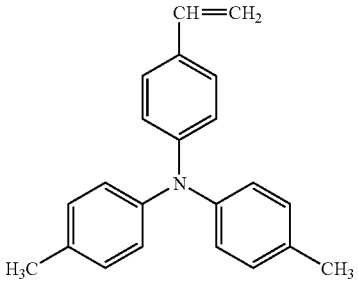
No. 145
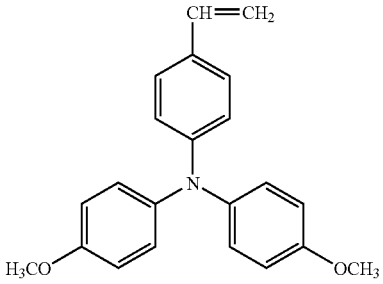
-continued
No. 146
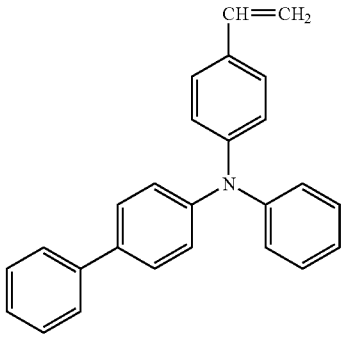
No. 147
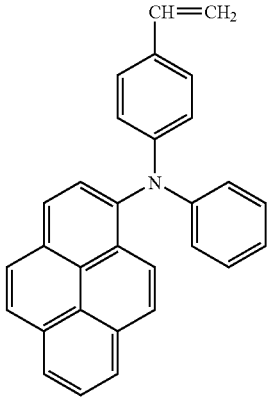
No. 148
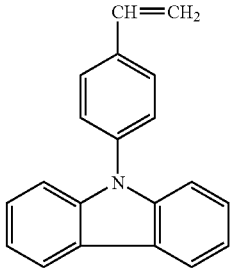
No. 149
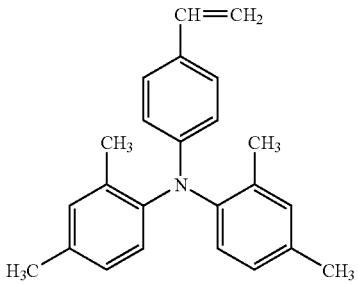
No. 150
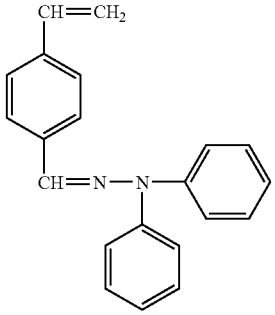

-continued
No. 151
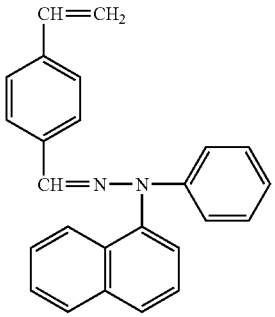
No. 152
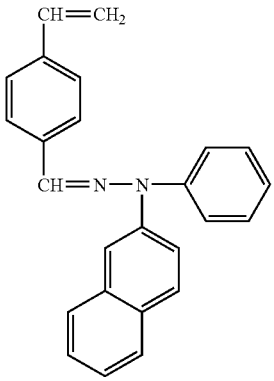
No. 153
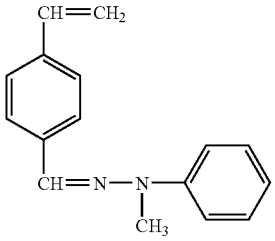
No. 154
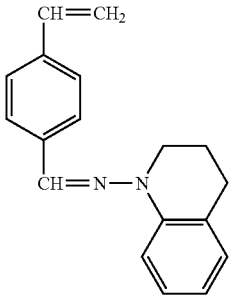
No. 155
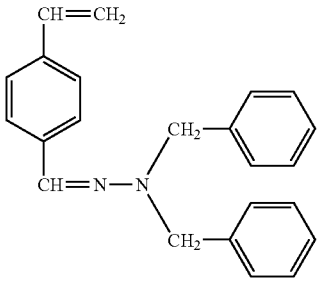
-continued
No. 156
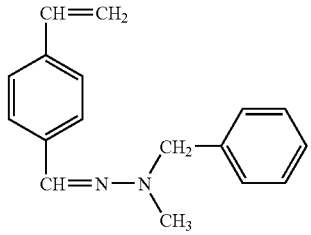
No. 157
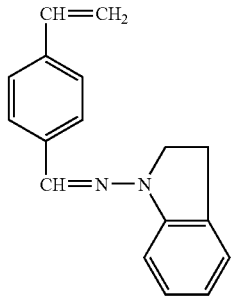
No. 158
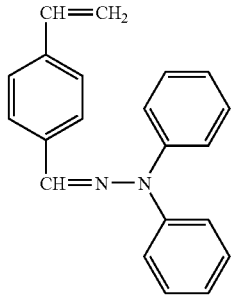
No. 159
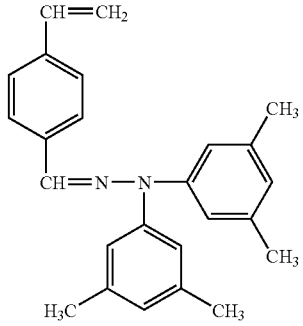
No. 160
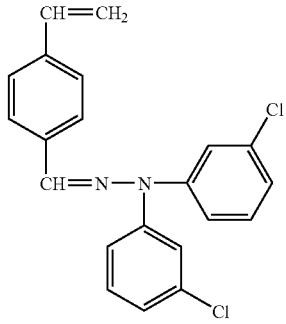
The radical polymerizable monofunctional monomers are used for imparting a charge transport property to the resultant polymer. The added amount of the radical polymerizable monofunctional monomers is preferably from 20 to 80% by weight. and more preferably from 30 to 70% by weight, based on the total weight of the CCTL. When the added amount is too small, good charge transport property cannot be imparted to the resultant polymer, and thereby the electric properties (such as photosensitivity and residual potential) of the resultant photoreceptor deteriorate. In contrast, when the added amount is too large, the crosslinking density of the resultant CCTL decreases, and thereby the abrasion resistance of the resultant photoreceptor deteriorates. From this point of view, the added amount of the monofunctional monomers is from 30 to 70% by weight.

The CCTL is typically prepared by reacting (crosslinking) at least a radical polymerizable tri- or more-functional monomer and a radical polymerizable monofunctional monomer. However, in order to reduce the viscosity of the coating liquid, to relax the stress of the CCTL, and to reduce the surface energy and friction coefficient of the CCTL, known radical polymerizable mon- or di-functional monomers and radical polymerizable oligomers having no charge transport structure can be used in combination therewith.

Specific examples of the radical polymerizable monofunctional monomers having no charge transport structure include 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxytriethyleneglycol acrylate, phenoxytetraethyleneglycol acrylate, cetyl acrylate, isostearyl acrylate, stearyl acrylate, styrene, etc.

Specific examples of the radical polymerizable difunctional monomers having no charge transport structure include 1,3-butanediol diacrylate, 1,4-butanediol diacrylate, 1,4-butanediol dimethacrylate, 1,6-hexanediol diacrylate, 1,6-hexanediol dimethacrylate, diethylene glycol diacryalte, neopentylglycol diacrylate, binsphenol A-ethyleneoxide-modified diacrylate, bisphenol F-ethyleneoxide-modified diacrylate, neopentylglycol diacryalte, etc.

Specific examples of the mon- or di-functional monomers for use in imparting a function such as low surface energy and/or low friction coefficient to the CCTL include flurine-containing monomers such as octafluoropentyl acrylate, 2-perfluorooctylethyl acrylate, 2-perfluorooctylethyl methacrylate, and 2-perfluoroisononylethyl acrylate; and vinyl monomers, acrylates and methacrylates having a polysiloxane group such as siloxane units having a repeat number of from 20 to 70 which are described in JP-B 05-60503 and 06-45770 (e.g., acryloylpolydimethylsiloxaneethyl, methacryloylpolydimethylsiloxaneethyl, acryloylpolydimethylsiloxanepropyl, acryloylpolydimethylsiloxanebutyl, and diacryloylpolydimethylsiloxanediethyl).

Specific examples of the radical polymerizable oligomers include epoxyacryalte oligomers, urethane acrylate oligomers, polyester acrylate oligomers, etc.

The added amount of such mono- and di-functional monomers is preferably not greater than 50 parts by weight, and more preferably not greater than 30 parts by weight, per 100 parts by weight of the tri- or more-functional monomers used. When the added amount is too large, the crosslinking density decreases, and thereby the abrasion resistance of the resultant CCTL deteriorates.

In addition, in order to efficiently crosslink the CCTL, a polymerization initiator can be added to the CCTL coating liquid. Suitable polymerization initiators include heat polymerization initiators and photo polymerization initiators. The polymerization initiators can be used alone or in combination.

Specific examples of the heat polymerization initiators include peroxide initiators such as 2,5-dimethylhexane-2,5-dihydroperoxide, dicumyl peroxide, benzoyl peroxide, t-butylcumyl peroxide, 2,5-dimethyl-2,5-di(peroxybenzoyl)hexyne-3, di-t-butylperoxide. t-butylhydronperoxide, cumenehydroperoxide, lauroyl peroxide, and 2,2-bis(4,4-di-t-butylperoxycyclohexy)propane; and azo type initiators such as azobisisobutyronitrile, azobiscyclohexanecarbonitrile, azobisbutyric acid methyl ester, hydrochloric acid salt of azobisisobutylamidine, and 4,4'-azobis-cyanovaleric acid.

Specific examples of the photopolymerization initiators include acetophenone or ketal type photopolymerization initiators such as diethoxyacetophenone, 2,2-dimethoxy-1,2-diphenylethane-1-one, 1-hydroxy-cyclohexyl-phenyl-ketone, 4-(2-hydroxyethoxy)phenyl-(2-hydroxy-2-propyl) ketone, 2-benzyl-2-dimethylamino-1-(4-morpholinophenyl) butanone-1, 2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl) oxime; benzoin ether type photopolymerization initiators such as benzoin, benzoin methyl ether, benzoin ethyl ether, benzoin isobutyl ether, and benzoin isopropyl ether, benzophenone type photopolymerization initiators such as benzophenone, 4-hydroxybenzophenone, o-benzoylbenzoic acid methyl ester, 2-benzoyl naphthalene, 4-benzoyl biphenyl, 4-benzoyl phenyl ether, acryalted benzophenone, and 1,4-benzoyl benzene; thioxanthone type photopolymerization initiators such as 2-isopropylthioxanthone, 2-chlorothioxanthone, 2,4-dimethylthioxanthone, 2,4-diethylthioxanthone, and 2,4-dichlorothioxanthone; and other photopolymerization initiators such as ethylanthraquinone, 2,4,6-trimethylbenzoyldiphenylphosphineoxide, 2,4,6-trimethylbenzoylphenylethoxyphosphineoxide, bis(2,4,6-trimethylbenzoyl)phenylphosphineoxide, bis(2,4-dimethoxybenzoyl)-2,4,4-trimethylpentylphosphineoxide, methylphenylglyoxyester, 9,10-phenanthrene, acridine compounds, triazine compounds, imidazole compounds, etc.

Photopolymerization accelerators can be used alone or in combination with the above-mentioned photopolymerization initiators. Specific examples of the photopolymerization accelerators include triethanolamine, methyldiethanolamine, ethyl 4-dimethylaminobenzoate, isoamyl 4-dimethylaminobenzoate, 2-dimethylaminoethyl benzoate, 4,4'-dimethylaminobenzophenone, etc.

The added amount of the polymerization initiators is preferably from 0.5 to 40 parts by weight, and more preferably from 1 to 20 parts by weight, per 100 parts by weight of the total weight of the radical polymerizable monomers used.

In order to relax the stress of the CCTL and to improve the adhesion of the CCTL to the CTL, the CCTL coating liquid may include additives such as plasticizers, leveling agent, and low molecular weight charge transport materials having no radical polymerizability.

Specific examples of the plasticizers include known plasticizers for use in general resins, such as dibutyl phthalate, and dioctyl phthalate. The added amount of the plasticizers in the CCTL coating liquid is preferably not greater than 20% by weight, and more preferably not greater than 10% by weight, based on the total solid components included in the coating liquid.

Specific examples of the leveling agents include silicone oils (such as dimethylsilicone oils,and methylphenylsilicone oils), and polymers and oligomers having a perfluoroalkyl group in their side chains. The added amount of the leveling agents is preferably not greater than 3% by weight based on the total solid components included in the coating liquid.

The CCTL is typically prepared by coating a coating liquid including a radical polymerizable tri- or more-functional monomer and a radical polymerizable monofunctional monomer on the CTL and then crosslinking the coated layer. When the monomers are liquid, it may be possible to dissolve other components in the monomers, resulting in preparation of the CCTL coating liquid. The coating liquid can optionally include a solvent to well dissolve the other components and/or to reduce the viscosity of the coating liquid.

Specific examples of the solvents include alcohols such as methanol, ethanol, propanol, and butanol; ketones such as acetone, methyl ethyl ketone, methyl isobutyl ketone, and cyclohexanone; esters such as ethyl acetate, and butyl acetate; ethers such as tetrahydrofuran, dioxane, and propyl ether; halogenated solvents such as dichloromethane, dichloroethane, trichloroethane, and chlorobenzene; aromatic solvents such as benzene, toluene, and xylene; cellosolves such as methyl cellosolve, ethyl cellosolve and cellosolve acetate; etc. These solvents can be used alone or in combination.

The added amount of the solvents is determined depending on the solubility of the solid components, the coating method used, and the target thickness of the CCTL. Coating methods such as dip coating methods, spray coating methods, bead coating methods, and ring coating methods can be used for forming the CCTL.

After coating a CCTL coating liquid, energy such as heat energy, photo energy and radiation energy is applied to the coated layer to crosslink the layer. Specific examples of the method for applying energy are as follows:

(1) applying heated gas (such as air and nitrogen gas) thereto;
(2) contacting a heated material thereto; and
(3) irradiating the coated layer with light or electromagnetic waves.

The temperature at which the coated CCTL is heated is preferably from 100 to 170° C. When the temperature is too low, the crosslinking speed is too slow, and thereby a problem in that the coated layer is not sufficiently crosslinked is caused. When the temperature is too high, the crosslinking reaction is unevenly performed, and thereby a problem in that the resultant CCTL has a large strain or includes non-reacted functional groups is caused. In order to uniformly perform the crosslinking reaction, a method in which at first the coated layer is heated at a relatively low temperature (not higher than about 100° C.), followed by heating at a relatively high temperature (not lower than about 100° C.) is preferably used.

Specific examples of the light source for use in photocrosslinking the coated layer include ultraviolet light emitting devices such as high pressure mercury lamps and metal halide lamps. In addition, visible light emitting lamps can also be used if the radical polymerizable monomers and the photopolymerization initiators used have absorption in a visible region. The illuminance intensity is preferably from 50 to 1000 mW/cm$^2$. When the illuminance intensity is too low, it takes a long time until the coated layer is crosslinked. In contrast, when the illuminance intensity is too high, a problem in that the crosslinking reaction is unevenly performed, thereby forming wrinkles in the resultant CCTL, or the layer includes non-reacted reaction groups therein is caused. In addition, a problem in that due to rapid crosslinking, the resultant CCTL causes cracks or peeling occurs.

Specific examples of the radiation energy applying methods include methods using electron beams.

Among these methods, the methods using heat or light are preferably used because the reaction speed is high and the energy applying devices are simple.

The thickness of the CCTL is preferably from 2 to 8 μm. The reason therefore is as follows.

In general, radical polymerization reaction is obstructed by oxygen included in the air, namely, crosslinking is not well performed in the surface portion (from 0 to about 1 μm in the thickness direction) of the coated layer due to oxygen in the air, resulting in formation of unevenly-crosslinked layer. Therefore, if the CCTL is too thin (i.e., the thickness of the CCTL is less than about 1 μm), the layer has poor abrasion resistance. Further, when the CCTL coating liquid is coated directly on a CTL, the components included in the CTL tends to be dissolved by the coating liquid, resulting in migration of the components into the CCTL. If the CCTL is too thin, the components are migrated into the entire CCTL layer, resulting in occurrence of a problem in that crosslinking cannot be well performed or the crosslinking density is low.

From this point of view, the thickness of the CCTL is preferably not less than 2 μm. In this case, the CCTL has good abrasion resistance and scratch resistance and can produce high quality images.

When the CCTL is too thick, a problem in that the resultant layer causes cracks or peeling occurs. Therefore the thickness of the CCTL is preferably not greater than 8 μm.

In addition, the present inventors found that the CCTL having a thickness of from 2 to 8 μm can produce an unexpected effect such that pin holes are hardly caused in the surface of the photoreceptor even when the photoreceptor is used for a long period of time under high temperature and high humidity conditions. The reason therefor is not determined yet, but is considered to be that the CCTL has good mechanical strength while having good elasticity. Specifically, in conventional photoreceptors, pin holes are formed by a mechanism such that a micro scratch is formed on the surface of the photoreceptors by external additives such as silica, and then the micro scratch becomes a pinhole when the photoreceptors are used under high temperature and high humidity conditions. When a photoreceptor having a high hardness is used and a scratch is unexpectedly formed on the surface thereof, the scratch grows if the layer does not have elasticity. However, as mentioned above, the photoreceptor for use in the present invention has good mechanical strength and good elasticity, and therefore the photoreceptor hardly causes the pin hole problem.

The CCTL coating liquid can include additives such as binder resins having no radical polymerizable group, antioxidants and plasticizers.

Since the added amount of these additives is too large, the crosslinking density decreases and the CCTL causes a phase separation problem in that the crosslinked polymer is separated from the additives, and thereby the resultant CCTL becomes soluble in an organic solvent. Therefore, the added amount of the additives is preferably not greater than 20% by weight based on the total weight of the solid components included in the CCTL coating liquid. In addition, in order not to decrease the crosslinking density, the total added amount of the mono- or di-functional monomers, reactive oligomers and reactive polymers in the CCTL coating liquid is preferably not greater than 20% by weight based on the weight of the radical polymerizable tri- or more-functional monomers. In particular, when the added amount of the di-functional monomers is too large, units having a bulky structure are incorporated in the CCTL while the units are connected with plural chains of the CCTL, thereby generating strain in the CCTL, resulting in formation of aggregates of micro crosslinked materials in the CCTL. Such a CCTL is soluble in an organic solvent. The added amount of a radical polymerizable di- or more-functional monomer having a charge transport structure is determined depending on the species of the monomer used, but is generally not greater than 10% by weight based on the weight of the radical polymerizable monofunctional monomer having a charge transport structure included in the CCTL.

In a photoreceptor having a structure as illustrated in FIG. 5, the CCTL, which is the outermost layer, is preferably insoluble in organic solvents. In this case, the CCTL has good combination of abrasion resistance and scratch resistance.

In order to prepare a CCTL having good resistance to organic solvents, the key points are as follows.

(1) to optimize the formula of the CCTL coating liquid, i.e., to optimize the content of each of the components included in the liquid;

(2) to choose a proper solvent for diluting the CCTL coating liquid, while properly controlling the solid content of the coating liquid;

(3) to use a proper method for coating the CCTL coating liquid;

(4) to crosslink the coated layer under proper crosslinking conditions; and (5) to form a CTL which is hardly insoluble in the solvent included in the CCTL coating liquid.

When an organic solvent having a low evaporating speed is used for the CCTL coating liquid, problems which occur are that the solvent remaining in the coated layer adversely affects crosslinking of the CCTL; and a large amount of the components included in the CTL is migrated into the CCTL, resulting in deterioration of crosslinking density or uneven crosslinking of the CCTL (i.e., the CCTL layer becomes soluble in organic solvents). Therefore, it is preferable to use solvents such as tetrahydrofliran, mixture solvents of tetrahydrofuran and methanol, ethyl acetate, methyl ethyl ketone, and ethyl cellosolve. It is preferable that one or more proper solvents are selected in consideration of the coating method used.

When the solid content of the CCTL coating liquid is too low, similar problems occur. The upper limit of the solid content is determined depending on the target thickness of the CCTL and the target viscosity of the CCTL coating liquid, which is determined depending on the coating method used, but in general, the solid content of the CCTL coating liquid is preferably from 10 to 50% by weight.

Suitable coating methods for use in preparing the CCTL include methods in which the weight of the solvent included in the coated layer is as low as possible, and the time during which the solvent in the coated layer contacts the CTL on which the coating liquid is coated is as short as possible. Specific examples of such coating methods include spray coating methods and ring coating methods in which the weight of the coated layer is controlled so as to be light. In addition, in order to control the amount of the components of the CTL migrating into the CCTL so as to be as small as possible, it is preferable to use a charge transport polymer for the CTL and/or to form an intermediate layer, which is hardly soluble in the solvent used for the CCTL coating liquid, between the CTL and the CCTL.

When the heating or irradiating energy is low in the crosslinking process, the coated layer is not completely crosslinked. In this case, the resultant layer becomes soluble in organic solvents. In contrast, when the energy is too high, uneven crosslinking is performed, resulting in increase of non-crosslinked portions or portions at which radical is terminated, or formation of aggregates of micro crosslinked materials. In this case, the resultant CCTL is soluble in organic solvents.

In order to make the CCTL insoluble in organic solvents, the crosslinking conditions are preferably as follows:

Heat Crosslinking Conditions

Temperature: 100 to 170° C.

Heating time: 10 minutes to 3 hours

UV Light Crosslinking Conditions

Illuminance intensity: 50 to 1000 mW/cm$^2$

Irradiation time: 5 seconds to 5 minutes

Temperature rise: 50° C. or less

In order to make the CCTL layer insoluble in organic solvents in a case where an acrylate monomer having three acryloyloxy group and a triarylamine compound having one acryloyloxy group are used for the CCTL coating liquid, the weight ratio (A/T) of the acrylate monomer (A) to the triarylamine compound (T) is preferably 7/3 to 3/7. The added amount of a polymerization initiator is preferably from 3 to 20% by weight based on the total weight of the acrylate monomer (A) and the triarylamine compound (T). In addition, a proper solvent is preferably added to the coating liquid. Provided that the CTL, on which the CCTL coating liquid is coated, is formed of a triarylamine compound (serving as a CTM) and a polycarbonate resin (serving as a binder resin), and the CCTL layer is coated by a spray coating method, the solvent of the CCTL coating liquid is preferably selected from tetrahydrofuran, 2-butanone, and ethyl acetate. The added amount of the solvent is preferably from 300 to 1000 parts by weight per 100 parts by weight of the acrylate monomer (A).

After the CCTL coating liquid is prepared, the coating liquid is coated on a peripheral surface of a drum, which includes, for example, an aluminum cylinder and an undercoat layer, a CGL and a CTL which are formed on the aluminum cylinder, by a spray coating method. Then the coated layer is naturally dried, followed by drying for a short period of time (from 1 to 10 minutes) at a relatively low temperature (from 25 to 80° C.). Then the dried layer is heated or exposed to UV light to be crosslinked.

When crosslinking is performed using UV light, the illuminance intensity of UV light is preferably from 50 mW/cm$^2$ to 1000 mW/cm$^2$. Provided that plural UV lamps emitting UV light of 200 mW/cm$^2$ are used, it is preferable that the coated layer is uniformly exposed to the UV light, for about 30 seconds. In this case, the temperature of the drum is controlled so as not exceed 50° C. When heat crosslinking is performed, the temperature is preferably from 100 to 170° C., and the heating device is preferably an oven with an air blower. When the heating temperature is 150° C., the heating time is preferably from 20 minutes to 3 hours.

It is preferable that after the crosslinking operation, the thus prepared photoreceptor is heated for a time of from 10 minutes to 3 hours at a temperature of from 100 to 150° C. to remove the solvent remaining in the CCTL. Thus, a photoreceptor (i.e., an image bearing member) for use in the image forming apparatus of the present invention is prepared.

The photoreceptor can include an intermediate layer and/or an undercoat layer.

Intermediate Layer

In the photoreceptor for use in the present invention, an intermediate layer may be formed between the CTL and the CCTL to prevent the components in the CTL from migrating into the CCTL and/or to improve the adhesion of the CCTL to the CTL. The intermediate layer includes a resin as a main component which is insoluble or is hardly soluble in the solvent used for the CCTL coating liquid. Specific examples of the resin for use in the intermediate layer include polyamides, alcohol soluble nylons, water-soluble polyvinyl butyral, polyvinyl butyral, polyvinyl alcohol, and the like. The intermediate layer can be formed by one of the known coating methods mentioned above for use in preparing the CCTL. The thickness of the intermediate layer is preferably from 0.05 to 2 μm.

Undercoat Layer

The photoreceptor for use in the present invention may include an undercoat layer between the substrate and the photosensitive layer (i.e., the charge generation layer in FIG. 5). The undercoat layer includes a resin as a main component. Since a photosensitive layer is typically formed on the undercoat layer by coating a liquid including an organic solvent, the resin in the undercoat layer preferably has good resistance to general organic solvents.

Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like.

The undercoat layer may include a fine powder of metal oxides such as titanium oxide, silica, alumina, zirconium oxide, tin oxide and indium oxide to prevent occurrence of moire in the recorded images and to decrease residual potential of the photoreceptor.

The undercoat layer can be formed by coating a coating liquid using a proper solvent and a proper coating method mentioned above for use in the photosensitive layer.

The undercoat layer may be formed using a silane coupling agent, titanium coupling agent or a chromium coupling agent.

In addition, a layer of aluminum oxide which is formed by an anodic oxidation method and a layer of an organic compound such as polyparaxylylene or an inorganic compound such as SiO, $SnO_2$, $TiO_2$, ITO or $CeO_2$ which is formed by a vacuum evaporation method is also preferably used as the undercoat layer.

The thickness of the undercoat layer is preferably 0 to 5 μm.

In order to impart high stability to withstand environmental conditions to the resultant photoreceptor (particularly, to prevent deterioration of photosensitivity and increase of residual potential under high temperature and high humidity conditions), an antioxidant can be included in the above-mentined layers (i.e., the CCTL, CTL, CGL, intermediate layer and undercoat layer).

Suitable antioxidants for use in the layers include phenolic compounds, paraphenylenediamine compounds, hydroquinone compounds, sulfur containing organic compounds, phosphorous containing organic compounds, etc. These antioxidants can be used alone or in combination. Specific examples thereof are as follows.

Phenolic Compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4 '-hydroxyphenyl)propionate]methane, bis[3,3'-bis(4'-hydroxy-3'-t-butylphenyl)butyric acid]glycol ester, tocophenol compounds, and the like.

Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

Hydroquinone Compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

Sulfur Containing Organic Compounds dilauryl-3,3'-thiodipropionate, distearyl-3,3'-thiodipropionate, ditetradecyl-3,3'-thiodipropionate, and the like.

Phosphorus Containing Organic Compounds triphenylphosphine, tri(nonylphenyl)phosphine, tri(dinonylphenyl)phosphine, tricresylphosphine, tri(2,4-dibutylphenoxy)phosphine and the like.

These compounds are commercialized as antioxidants for rubbers, plastics, oil and fats.

The added amount of an antioxidant in a layer is not particularly limited, and is preferably from 0.01 to 10% by weight based on the weight of the layer to which the antioxidant is added.

Then an example of the method for synthesizing a radical polymerizable monofunctional monomer having a charge transport structure will be explained.

Such a radical polymerizable monofunctional monomer can be prepared, for example, by the method described in Japanese Patent No. 3,164,426, which is as follows.

(1) Synthesis of triarylamine Compound Substituted with hydroxyl Group (i.e., a Compound Having the Below-Mentioned Formula (9))

At first, 113.85 g (0.3 mol) of a triarylamine compound which is substituted with a methoxy group and which has the below-mentioned formula (8), 138 g (0.92 mol) of sodium iodide, and 240 ml of sulforane were mixed and heated at 60° C. under a nitrogen gas flow. Then, 99 g (0.91 mol) of trimethylchlorosilane was dropped thereto over 1 hour. The mixture was agitated for 4.5 hours at about 60° C. to complete the reaction. Then 1.5 liters of toluene was added to the reaction product, followed by cooling to room temperature. Further, the toluene solution of the reaction product was further washed using water, followed by washing using an aqueous solution of sodium carbonate. The washing treatment was repeated several times. Then toluene was removed from the toluene solution of the reaction product, and the reaction product was subjected to-column chromatography (absorbent: silica gel, solvent: toluene/ethyl acetate=20/1) to be refined. The thus prepared pale yellow oily material was mixed with cyclohexane to precipitate a crystal. Thus, 88.1 g of a white crystal having the below-mentioned formula (9) and a melting point of from 64.0 to 66.0° C. was prepared. In this reaction, the yield was 80.4%.

Then the crystal was subjected to an elementary analysis. The results (i.e., the amounts of the elements (C, H and N) in the crystal) are shown in Table 1.

TABLE 1

| | C | H | N |
|---|---|---|---|
| Actual measurement value | 85.06 | 6.41 | 3.73 |

TABLE 1-continued

| | C | H | N |
|---|---|---|---|
| Calculated value | 85.44 | 6.34 | 3.83 |

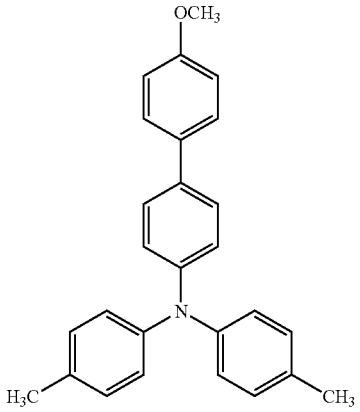

formula (8)

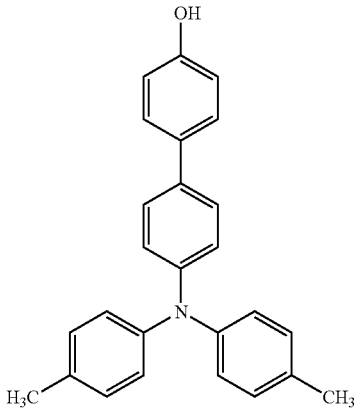

formula (9)

(2) Acrylate Compound Substituted with triarylamine Group Having Formula 54

At first, 82.9 g (0.227 mol) of the compound having formula (9) was dissolved in 400 ml of tetrahydrofuran. Then an aqueous solution of sodium hydroxide including 12.4 g of sodium hydroxide and 100 ml of water was dropped into the above-prepared solution. After the mixture was cooled to 5° C., 25.2 g (0.272 mol) of acrylic acid chloride was added thereto over 40 minutes. The mixture was agitated for 3 hours at 5° C. to complete the reaction. The reaction product was then added into water, and then subjected to extraction using toluene. The extraction liquid was subjected to washing using a sodium hydrogen carbonate aqueous solution, followed by washing using water. This washing treatment was performed several times.

After toluene was removed from the toluene solution of the reaction product, the reaction product was subjected to column chromatography (absorbent: silica gel, solvent: toluene) to be refined. The thus prepared colorless oily material was mixed with n-hexane to precipitate a crystal. Thus, 80.73 g of a white crystal which is the compound No. 54 mentioned above and a melting point of from 117.5 to 119.0° C. was prepared. In this reaction, the yield was 84.8%.

Then the crystal was subjected to an elementary analysis. The results (i.e., the amounts of the elements (C, H and N) in the crystal) are shown in Table 2.

TABLE 2

| | C | H | N |
|---|---|---|---|
| Actual measurement value | 83.13 | 6.01 | 3.16 |
| Calculated value | 83.02 | 6.00 | 3.33 |

Then an example of the method for synthesizing a radical polymerizable difunctional monomer having a charge transport structure will be explained.

A radical polymerizable difunctional monomer having a charge transport structure, dihydroxymethyltriphenylamine, can be prepared, for example, by the following method.

At first, 49 g of a compound having the below-mentioned formula (10) and 184 g of phosphorous oxychloride were fed into a flask equipped with a thermometer, a condenser, an agitator and a dropping funnel and the mixture was heated to prepare a solution. Then 117 g of dimethylformamide was dropped into the solution using the dropping funnel. Then the mixture was heated for about 15 hours at a temperature of from 85 to 95° C. while agitated. After the reaction liquid was gradually added into a large amount of hot water, the mixture was gradually cooled while agitated. After the precipitated crystal was filtered, follwed by drying, impurities in the crystal was absorbed by silica gel and then the crystal was refined using acetonitrile. Thus 30 g of a compound having the below-mentioned formula (11) was prepared.

The thus prepared 30 g of the compound and 100 ml of ethanol were mixed in a flask while agitated. Then 1.9 g of sodium boron hydride was gradually added to the mixture. Then the mixture was agitated for about 2 hours while the temperature of the mixture was controlled to be from 40 to 60° C. Then the reaction liquid was gradually added into 300 ml of water and the mixture was agitated to precipitate a crystal. After the mixture was filtered, the precipitate was washed and dried. Thus, 30 g of a compound having the following formula (12) was prepared.

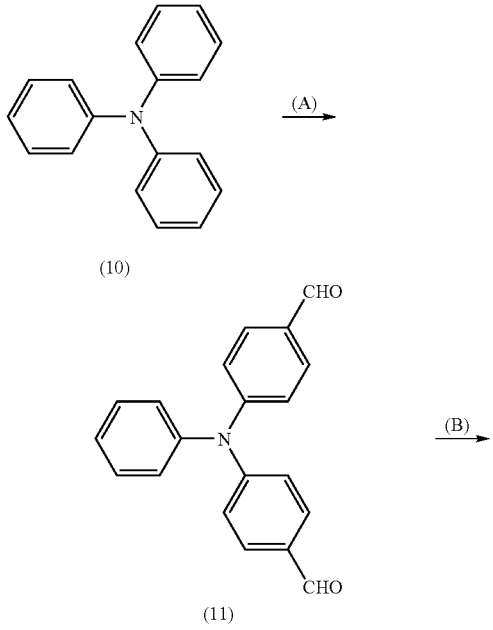

(10)

(11)

-continued

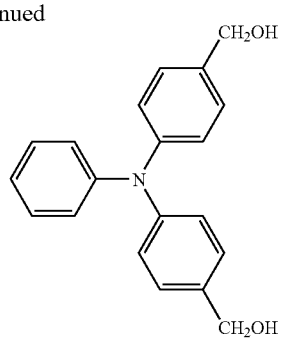

(12)

The image bearing member (photoreceptor) can be used not only for electrophotographic image forming apparatus such as copiers, laser printers, LED printers and liquid crystal shutter printers, but also for displays, recorders, printing machines, printing-plate-forming machines, and facsimiles using electrophotography.

In order to form an electrostatic latent image on the image bearing member, at first the surface of the image bearing member is charged and then the charged surface is exposed to imagewise light. This operation is performed by an electrostatic latent image forming device. The electrostatic latent image forming device includes at least a charger configured to charge the entire surface of the image bearing member and a light irradiator configured to irradiate the charged image bearing member with imagewise light.

Specific examples of the chargers include contact chargers having an electroconductive or semiconductive roller, a brush, a film or a rubber blade; and non-contact chargers such as corotrons and scorotrons.

Specific examples of the chargers include optical devices for copiers, rod lens arrays, laser optical devices, and optical devices using a liquid crystal shutter.

Irradiation of imagewise light can be performed on the image bearing member from the front side (i.e., from the CCTL side) thereof or from the backside (i.e., from the substrate side) thereof.

When the image bearing member is used for copiers and printers, a method in which the image bearing member is exposed to imagewise light reflected from an original or transmitting an original or imagewise light emitted by a device, such as LDs, LEDs and optical devices using a liquid crystal shutter, according to image signals.

Developing Process and Developing Device

In the developing process, the electrostatic latent image formed on the image bearing member is developed with the toner (or the developer) mentioned above for use in the present invention to visualize the electrostatic latent image using a developing device.

Known developing devices can be used for the image forming apparatus of the present invention as long as the toner (or the developer) mentioned above is used therefor. For example, developing devices containing the toner or developer therein and having a developing element which supplies the toner to the photoreceptor with or without contacting the photoreceptor can be used. The developing device preferably has the toner container mentioned above.

The developing device is typically a dry developing device which includes one or more developing sections to develop one or more color images. The developing device includes an agitator configured to agitate the toner or developer to charge the toner, and a developer bearing member bearing the toner or developer using a rotatable magnet roller to supply the toner to the image bearing member.

In the developing device, the toner and a carrier are agitated so that the toner is charged. The toner and carrier are then fed to the surface of the developer bearing member (i.e., the magnet roller) and form a magnetic brush on the surface of the developer bearing member. Since the developer bearing member is arranged in the vicinity of the image bearing member, the toner in the magnetic brush is electrostatically attracted by the electrostatic latent image, resulting in transferring of the toner to the latent image. Thus, the latent image is developed with the toner, resulting in formation of a toner image.

The developer contained in the developing device may be a one-component developer which includes the toner for-use in the present invention and does not include a carrier, or a two-component developer which includes the toner and a carrier.

Transferring Process and Image Transferring Device

In the transferring process, the toner image formed on the image bearing member is preferably transferred to an intermediate transfer medium (i.e., primary transfer process), and the toner image is then transferred to a receiving material (secondary transfer process). When multiple color images and full color images are formed using two or more color toners, it is preferable that plural color toner images are transferred to an intermediate transfer medium one by one (primary transfer process), and the plural toner images on the intermediate transfer medium are transferred to a receiving material at the same time (second transfer process).

It is preferable that toner images are transferred while applying a voltage to the image bearing member using a transfer charger which is included in the transfer device. When an intermediate transfer medium is used, the transferring device includes a first transferring member which transfers the toner image on the photoreceptor to the intermediate transfer medium and a second transferring member which transfers the toner image on the intermediate transfer medium to a receiving material.

The intermediate transfer medium for use in the image forming apparatus is not particularly limited, and known intermediate transfer media can be used. Specific examples thereof include belt-form intermediate transfer media.

Suitable transfer members for use in the (first and second) transfer devices include transferers which can charge the toner image so that the image is released from the image bearing member and transferred to a receiving material. Plural transferers can be used for the transfer device. Specific examples of the transferers include corona-charging transferers, transfer belts, transfer rollers, pressure transfer rollers, adhesive transferers.

The receiving material is not particularly limited and known receiving materials such as papers and PET films for OHP (overhead projection) can be used.

Fixing Process and Fixing Device

In the fixing process, the toner image transferred to a receiving material is fixed using a fixing device. When plural toner images are transferred on a receiving sheet, the fixing operation can be performed on each of the toner images after the toner image is transferred on the receiving material, or on all the toner images transferred on the receiving material at the same time.

The fixing device is not particularly limited, and a proper fixing device is chosen and used for the image forming apparatus for which the toner of the present invention is used.

Suitable fixing devices include heat fixing devices which heat toner images while applying a pressure thereto. Specific examples thereof include combinations of a heat roller and a pressure roller, and combinations of a heat roller, a pressure roller and an endless belt.

When a heat fixing device is used, the fixing temperature is preferably from 80 to 200° C.

It is possible to use a photo fixing device which fixes toner images using light.

Cleaning Process and Cleaning Device

In the cleaning process, toner particles, which remain on the surface of the image bearing member even after the toner image thereon is transferred on a receiving material, are removed therefrom using a cleaning device.

Known cleaners can be used as the cleaning device. Specific examples thereof include magnetic brush cleaners, electrostatic brush cleaners, magnetic roller cleaners, blade cleaners, brush cleaners, and web cleaners.

Figure 6:
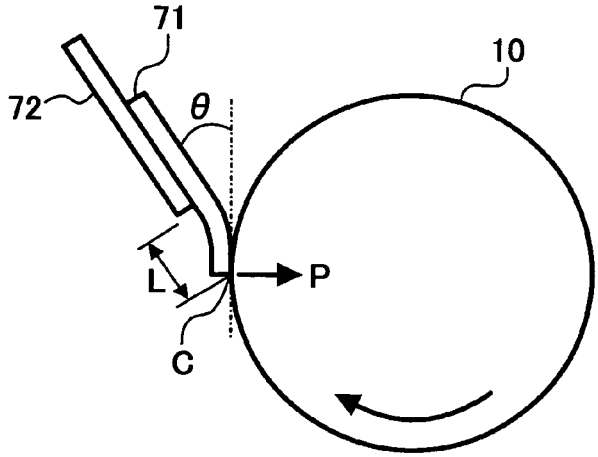
FIG. 6 is a schematic view illustrating a cleaner for use in the image forming apparatus of the present invention.

An example of the cleaner will be explained referring to FIG. 6. FIG. 6 is a schematic cross-sectional view of a cleaner for use in the image forming apparatus of the present invention. The cleaning device has a cleaning blade 71 and a support 72. The material of the blade is not particularly limited, and known materials such as rubbers can be used therefor. In addition, cleaning conditions are not particularly limited, and the cleaning operation can be performed under known cleaning conditions. However, as illustrated in FIG. 6, the blade 71 is preferably contacted with the surface of an image bearing member 10 so as to counter the surface of the image bearing member 10 which is rotated in the direction indicated by an arrow.

In FIG. 6, P represents a vector of the pressure of the blade 71 in the normal direction of a contact point C, which is applied by the blade to the image bearing member. Character θ represents a contact angle formed by the blade 71 and a tangent line of the image bearing member at the contact point C. Character L represents a length of a free portion of the blade 71, which portion is not supported by the support 72.

The pressure P is preferably from 5 to 50 gf/cm and the contact angle θ is preferably from 5 to 35°. In addition, the length L and the thickness of the blade are preferably from 3 to 15 mm and from 0.5 to 10 mm, respectively.

Suitable materials for use as the blade include rubbers such as urethane rubbers, silicone rubbers, fluorine-containing rubbers, chloroprene rubbers, butadiene rubbers, etc. Among these rubbers, urethane rubbers are preferably used.

By properly controlling the hardness and repulsion elasticity of a rubber blade, occurrence of a blade reversing problem in that the tip edge of the blade is reversed by a rotated image bearing member can be prevented. The hardness (JIS A hardness) of the rubber blade is preferably from 65° to 80° at a temperature of 25±5° C. When the hardness is too low, the blade reversing problem is easily caused. When the hardness is too high, the cleanability of the blade deteriorates. The repulsion elasticity of the blade is preferably from 20 to 75%. When the repulsion elasticity is too large, the blade reversing problem is easily caused. When the repulsion elasticity is too small, the cleanability of the blade deteriorates. The JIS A hardness and repulsion elasticity can be determined by the method described in JIS K6301.

Discharging Process and Discharging Device

In the discharging (quenching) process, charges, which remain on the image bearing member (photoreceptor) even after a toner image thereon is transferred from the photoreceptor to a receiving material, are discharged by applying a bias voltage to the photoreceptor or irradiating the photoreceptor with light, using a discharging device.

Known discharging devices can be used. Specific examples thereof include discharging lamps.

Toner Recycling Process and Recycling Device

In the toner recycling process, the toner particles collected by the cleaner mentioned above are returned to the developing device using a recycling device to be reused for developing electrostatic latent images.

Known powder feeding devices can be used as the recycling device.

Controlling Process and Controller

The above-mentioned processes are controlled by a controller such as sequencers, and computers.

Then the image forming processes and image forming apparatus of the present invention will be explained in detail referring to drawings.

Figure 7:
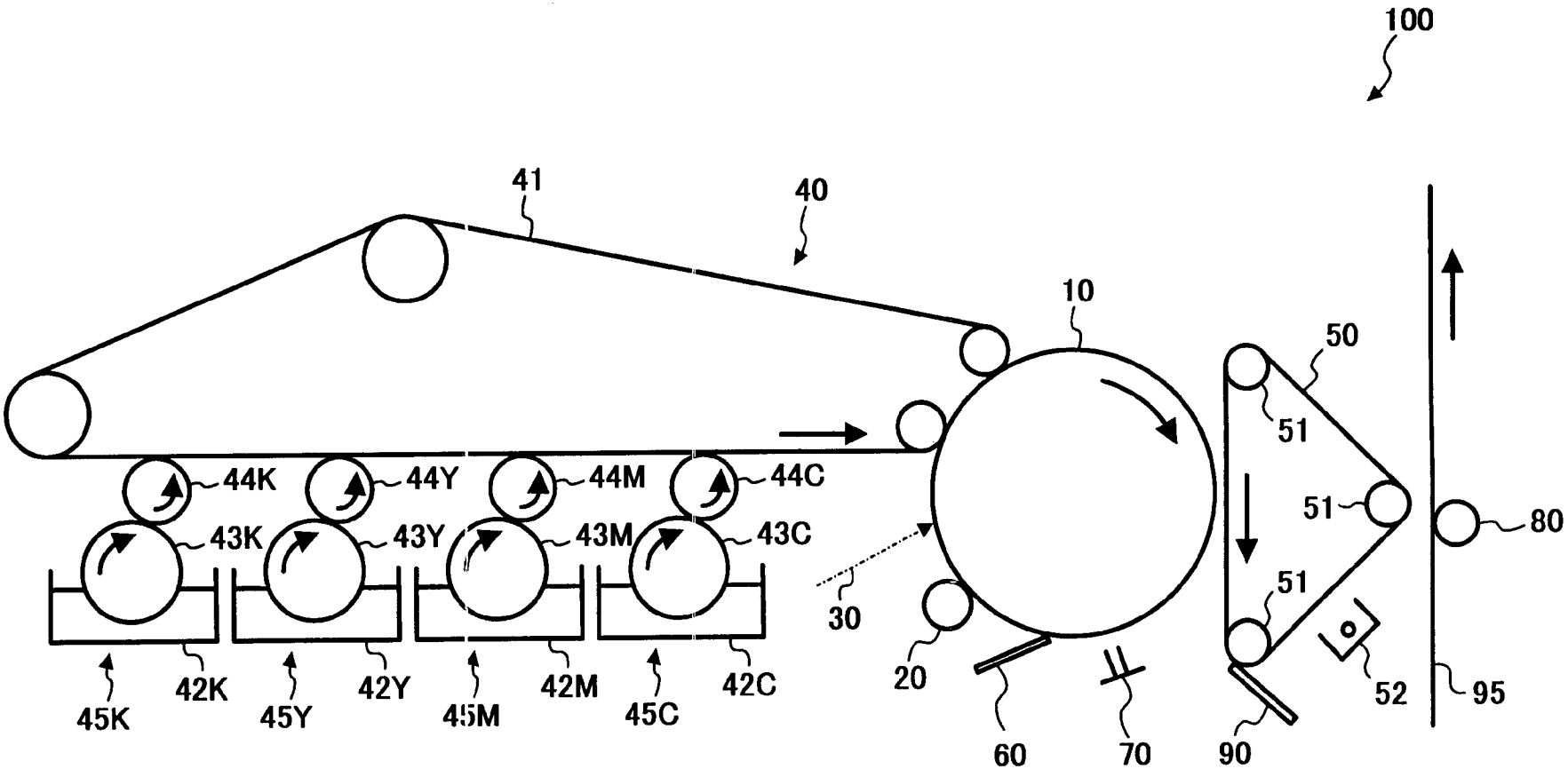
FIG. 7 is a schematic view illustrating the image forming section of an embodiment of the image forming apparatus of the present invention.

FIG. 7 is a schematic view illustrating an embodiment of the image forming apparatus of the present invention.

In FIG. 7, an image forming apparatus 100 includes a photoreceptor drum 10 (hereinafter referred to as a photoreceptor 10) serving as the image bearing member; a charging roller 20 serving as the charging device; a light irradiator which serves as the latent image forming device and irradiates imagewise light 30; a developing device 40 serving as the image developing device; an intermediate transfer medium 50; a cleaner 60 serving as the cleaning device and including a cleaning blade; and a discharging lamp 70 serving as the discharging device.

The intermediate transfer medium 50 is an endless belt which is rotated in a direction indicated by an arrow by three rollers 51 while tightly stretched by the rollers. At least one of the three rollers 51 applies a transfer bias (first transfer bias) to the intermediate transfer medium 50. A cleaner 90 is provided to clean the surface of the intermediate transfer medium 50.

On the right side of the intermediate transfer medium 50, a transfer roller 80 is provided which applies a transfer bias (a second transfer bias) to a receiving material 95 on which a toner image is to be transferred. In addition, a corona charger 52 is provided to charge the toner image on the intermediate transfer medium 50 before the toner image is transferred to the receiving material 95.

A developing device 40 includes a developing belt 41, and a black developing unit 45K; a yellow developing unit 45Y; a magenta developing unit 45M; and a cyan developing unit 45C, which are arranged in the vicinity-of the developing belt 41. Each of the developing units includes a developer containing portion 42 (42K, 42Y, 42M or 42C), a developer supplying roller 43 (43K, 43Y, 43M or 43C), and a developing roller 44 (44K, 44Y, 44M or 44C). The developing belt 41 is an endless belt which is rotated while tightly stretched by plural rollers.

In the image forming apparatus 100, the surface of the photoreceptor 10 is uniformly charged with the charging roller 20. The light irradiator 30 irradiates the charged surface of the photoreceptor 10 with imagewise light to form an electrostatic latent image on the photoreceptor 10. The developing device 40 develops the latent image with color toners, each of which is the toner of the present invention, to sequentially form color toner images on the photoreceptor 10. The color toner images are transferred to the intermediate transfer medium 50 (first transfer) to form a toner image (e.g., a full color toner image) while at least one of the rollers 51 applies a transfer bias thereto. The toner image formed on the intermediate transfer medium 50 is then transferred to the receiving material 95 (second transfer) by a transfer roller 80. Toner particles remaining on the photoreceptor 10 are removed with the cleaner 60 and charges remaining on the photoreceptor 10 are removed by irradiating the photoreceptor 10 with light using the discharging lamp 70.

Figure 8:
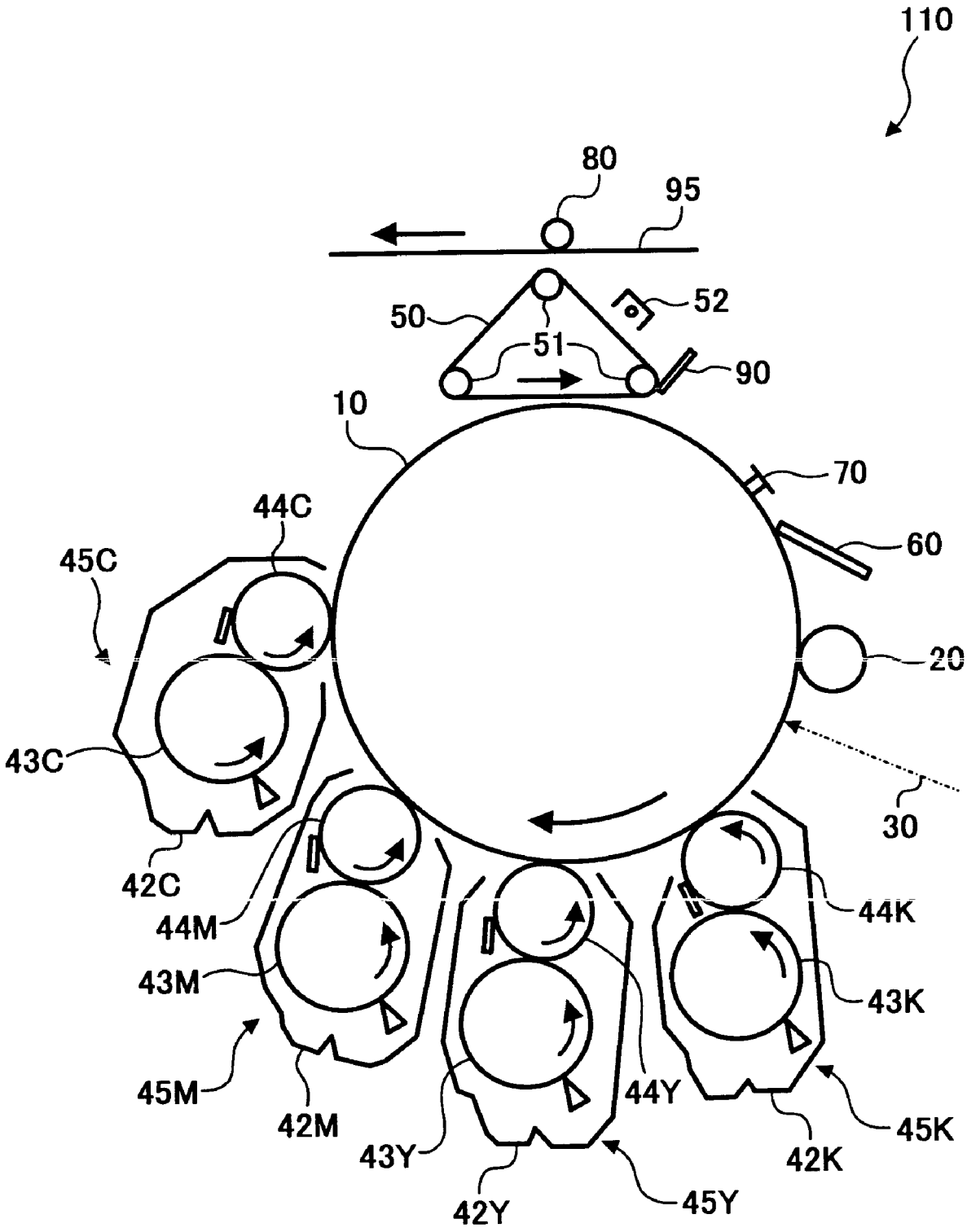
FIG. 8 is a schematic view illustrating the image forming section of another embodiment of the image forming apparatus of the present invention.

FIG. 8 illustrates another embodiment of the image forming apparatus of the present invention. The image forming apparatus has the same configuration as that of the image forming apparatus illustrated in FIG. 1 except that the black, yellow, magenta and cyan developing units 45K, 45Y, 45M and 45C are directly contacted with the photoreceptor 10 without using the developing belt 41. The action of the image forming apparatus is also the same as that of the image forming apparatus illustrated in FIG. 1.

The image forming operations will be explained referring to FIG. 9.

Figure 9:
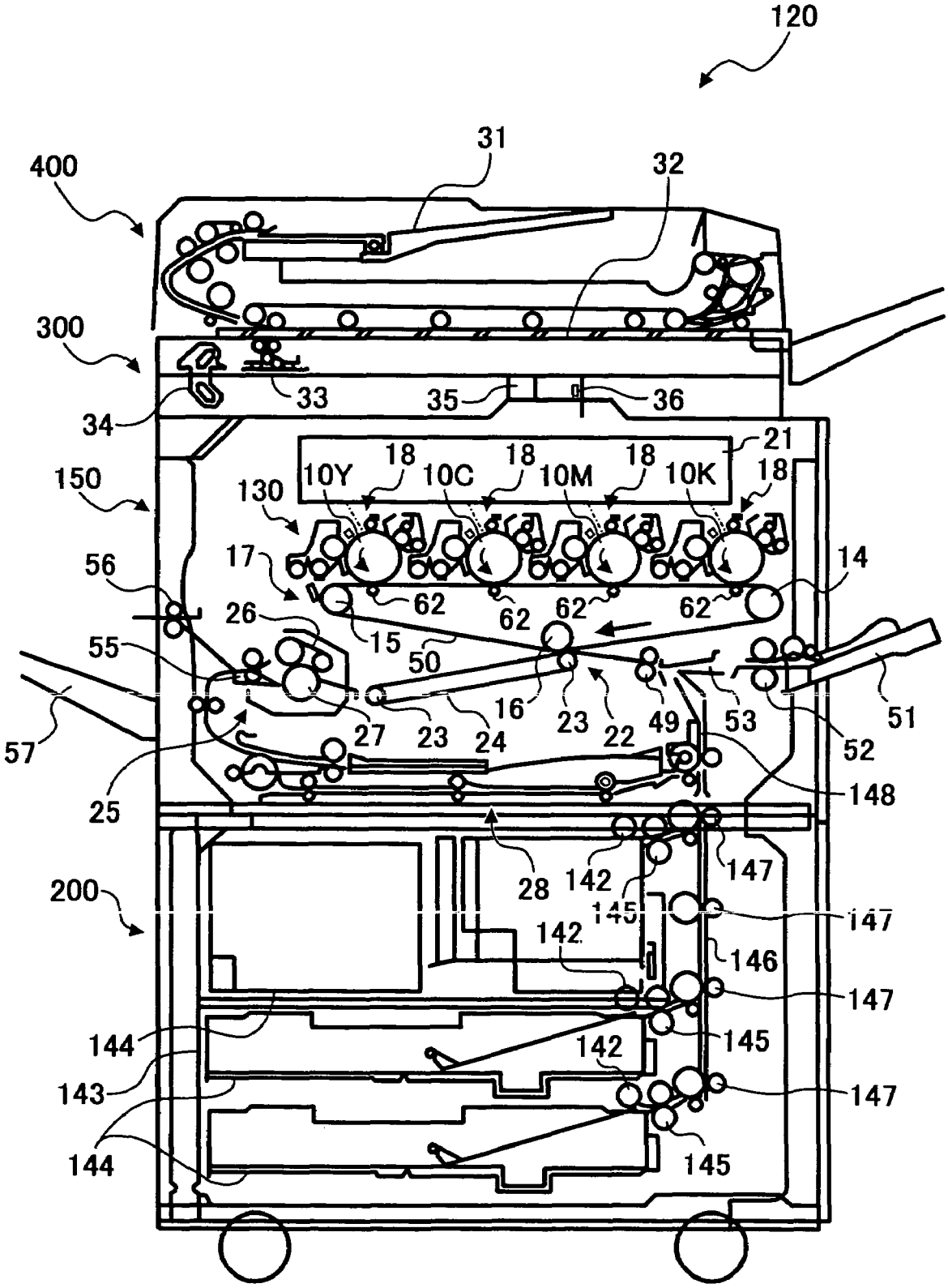
FIG. 9 is a schematic view illustrating yet another embodiment of the image forming apparatus of the present invention.

FIG. 9 is the overview of an embodiment of the image forming apparatus of the present invention, which is a tandem-type color image forming apparatus.

In FIG. 9, a tandem-type color image forming apparatus 120 includes an image forming section 150, a paper feeding section 200, a scanner 300 and an automatic document feeder 400.

The image forming section 150 includes an endless intermediate transfer medium 50 which is provided in the center of the image forming section 150. The intermediate transfer medium 50 is rotated clockwise by rollers 14, 15 and 16 while tightly stretched by the rollers. A cleaner 17 is provided near the roller 15 to remove toner particles remaining on the surface of the intermediate transfer medium.

Four image forming units 18 for forming yellow, magenta, cyan and black toner images are arranged side by side on the intermediate transfer medium 50. The image forming units 18 include respective photoreceptors 10Y, 10M, 10C and 10K. Numeral 130 denotes a tandem type developing device. The developing device 130 includes four developing devices arranged in the respective four image forming units 18. A light irradiator 21 is arranged at a location over the image forming units 18.

A second transfer device 22 is provided below the intermediate transfer medium 50. The second transfer device 22 includes an endless belt 24 which is rotatably stretched a pair of rollers 23. The endless belt 24 feeds a receiving material so that the toner images on the intermediate transfer medium 50 are transferred to the receiving material while sandwiched by the intermediate transfer medium 50 and the endless belt 24.

A fixing device 25 is arranged at a position near the second transfer device 22. The fixing device 25 includes an endless fixing belt 26 and a pressure roller 27 which presses the fixing belt 26.

In addition, a sheet reversing device 28 configured to reverse the receiving material is provided at a position near the fixing device 25, to produce double-sided copies.

Then the full color image forming operation using the tandem-type color image forming apparatus 120 will be explained.

An original to be copied is set on an original table 130 of the automatic document feeder 400. Alternatively, the original is directly set on a glass plate 32 of the scanner 300 after the automatic document feeder 400 is opened, followed by closing of the automatic document feeder 400. When a start button (not shown) is pushed, the color image on the original on the glass plate 32 is scanned with a first traveler 33 and a second traveler 34 which move in the right direction. In the case where the original is set on a table 31 of the automatic document feeder 400, at first the original is fed to the glass plate 32, and then the color image thereon is scanned with the first and second travelers 33 and 34. The first traveler 33 irradiates the color image on the original with light and the second traveler 34 reflects the light reflected from the color image to send the color image light to a sensor 36 via a focusing lens 35. Thus, color image information (i.e., black yellow, magenta and cyan color image data) is provided.

The black, yellow, magenta and cyan color image data are sent to the respective black, yellow, magenta and cyan color image forming units 18, and black, yellow, magenta and cyan color toner images are formed on the respective photoreceptors 10K, 10Y, 10M and 10C.

Figure 10:
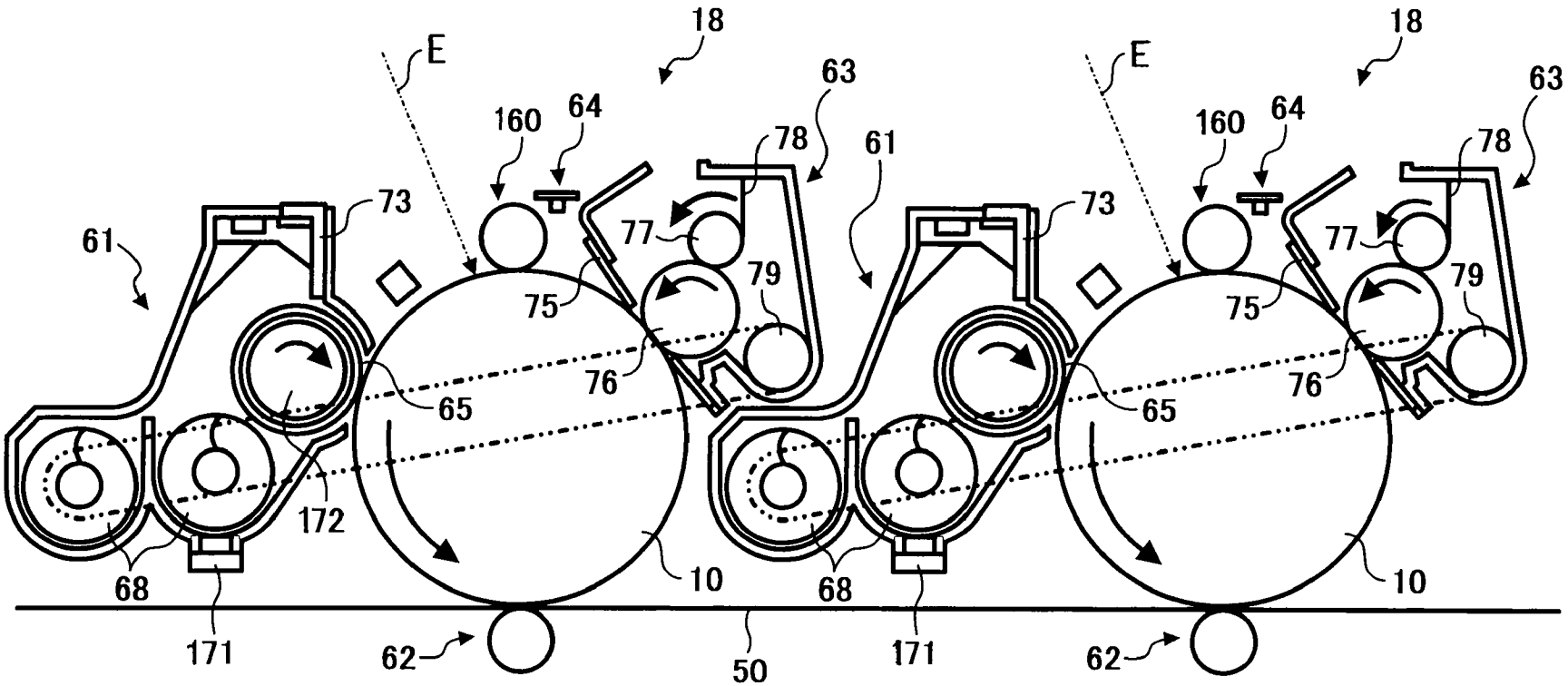
FIG. 10 is a schematic view illustrating the image forming section of the image forming apparatus illustrated in FIG. 10.

FIG. 10 is a schematic view illustrating a part of the image forming units 18.

Numeral 160, 61, 62, 63 and 64 denote a charger, a developing device, a transfer roller, a cleaner and a discharger.

The developing device 61 includes agitators 68, a developing roller 172, and a regulating blade 73 configured to forming a developer layer 65 on the surface of the developing roller 172. Numeral 171 denotes a toner sensor configured to determine the toner concentration. Character E denotes imagewise light exposure.

The cleaner 63 includes cleaning blade 75, a cleaning brush 76, a roller 77, a blade 78 and a toner recycling device 79 configured to feed the collected toner particles to the developing device 61.

Referring back to FIG. 9, the thus prepared black, yellow, magenta and cyan color toner images are transferred one by one to the intermediate transfer medium 50 which is rotated by the rollers 14, 15 and 16, resulting in formation of a full color toner image on the intermediate transfer medium 50. Numeral 62 denotes a transfer charger.

In the paper feeding section 200, one of paper feeding rollers 142 is selectively rotated to feed the top paper sheet of paper sheets stacked in a paper cassette 144 in a paper bank 143 while the paper sheet is separated one by one by a separation roller 145 when plural paper sheets are continuously fed. The paper sheet is fed to a passage 148 in the image forming section 150 through a passage 146 in the paper feeding section 200, and is stopped once by a registration roller 49. Numeral 147 denotes feed rollers. A paper sheet can also be fed from a manual paper tray 51 to a passage 53 by a separation roller and a pair of rollers 52. The thus fed paper sheet is also stopped once by the registration roller 49. The registration roller 49 is generally grounded, but a bias can be applied thereto to remove paper dust therefrom.

The thus prepared full color toner image on the intermediate transfer medium 50 is transferred to the paper sheet, which is timely fed by the registration roller 49, at the contact point of the second transfer device 22 and the intermediate transfer medium 50. Toner particles remaining on the surface of the intermediate transfer medium 50 even after the second image transfer operation are removed therefrom by the cleaner 17.

The paper sheet having the full color toner image thereon is then fed by the second transfer device 22 to the fixing device 25, and the toner image is fixed on the paper sheet upon application of heat and pressure. Then the paper sheet is discharged from the image forming section 150 by a discharge roller 56 while the path is properly selected by a paper path changing pick 55. Thus, a copy is stacked on a tray 57. When a double sided copy is produced, the paper sheet having a toner image on one side thereof is fed to the sheet reversing device 28 to be reversed. Then the paper sheet is fed to the second transfer device 24 so that an image is transferred to the other side of the paper sheet. The image is also fixed by the fixing device 25 and then the copy is discharged to the tray 57 by the discharge roller 56.

The image forming apparatus of the present invention can include a process cartridge in which a combination of the above-mentioned photoreceptor with one or more of a charger, an imagewise light irradiator, a developing device, a transfer device, a cleaning device is arranged as a unit and which can detachably attached to the image forming apparatus using a rail or the like provided in the image forming apparatus.

One embodiment of the process cartridge of the present invention is mentioned above referring to FIG. 4.

The image forming apparatus including such a process cartridge can perform image forming operations similar to those mentioned above (i.e., the operations such as charging, irradiating, developing, transferring, fixing, cleaning, etc.).

In the image forming apparatus and method, the photosensitive layer of the photoreceptor (i.e., the image bearing member) includes a reaction product of a radical polymerizable tri- or more-functional monomer having no charge transport structure and a radical polymerizable monofunctional monomer having a charge transport structure, and therefore the photoreceptor has good abrasion resistance. In addition, the toner for use in developing an electrostatic latent image includes a binder resin which has a sharp molecular weight distribution and which includes low molecular weight components as much as possible. Therefore, even when image formation is repeated for a long period of time, the image forming apparatus can produce high quality images with hardly producing undesired images such as rice fish-form images, blurred images and black spot (or streak) images.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Synthesis of Polyester Resins

Each of monomer combinations A to T listed in Tables 3 to 5 was contained in a 1-liter four-neck round-bottom flask equipped with a thermometer, a stirrer, a condenser and a nitrogen gas feed pipe. The flask was set in a mantle heater and heated while a nitrogen gas was fed into the flask through the nitrogen gas feed pipe so that the inside of the flask was kept under inactive environmental conditions. After 0.05 g of dibutyltin oxide was added thereto, the mixture was heated at 200° C. to react the monomers. Thus, polyester resins A to T were prepared.

The polyester resins were evaluated with respect to the following properties.

Molecular Weight Distribution

The molecular weight distribution of each polyester resin was determined by gel permeation chromatography (GPC). The measurement method is mentioned above. The weight average molecular weight (Mw) and the peak molecular weight (Mp) were determined.

Content of Chloroform-Insoluble Components (CIC Content)

The content of chloroform-insoluble components in each of the polyester resins was determined by the method mentioned above.

Glass Transition Temperature (Tg)

The glass transition temperature of each of the polyester resins was determined using an instrument THERMOFLEX TG8110 manufactured by Rigaku Corporation. In this regard, the temperature rising speed is 10° C./min.

Acid Value (AV) and Hydroxyl Value (HV)

The acid value and hydroxyl value of each of the resins were measured by the method described in JIS K0070. When the resin was not dissolved by the solvent, dioxane or tetrahydrofuran was used as the solvent. The unit of the acid value and hydroxyl value is mgKOH/g.

Softening Point (F1/2)

The softening point of a resin was determined using an instrument FLOW TESTER CFT-500 manufactured by Shimadzu Corporation. Measurements were performed under the following conditions:

(1) diameter of die: 1 mm (2) pressure: 20 kgf/cm$^2$ (3) temperature rising speed: 10° C./min The measurement method is mentioned above.

The results are shown in Tables 3 to 5.

TABLE 3

| | | A | B | C | D | E | F | G |
|---|---|---|---|---|---|---|---|---|
| Acid Component | TPA* | 60 | 67 | | | | 58 | 70 |
| | IPA* | | | | | 92 | | |
| | FA* | | | 92 | 100 | | | |
| | DSA* | 25 | 25 | | | | 22 | 28 |
| | TA* | 15 | 8 | 8 | | 8 | 20 | 2 |
| Alcohol component | EG* | | | | | | | |
| | BAPO* | 70 | 70 | 70 | 70 | 70 | 70 | 70 |
| | BAEO* | 50 | 50 | 50 | 50 | 50 | 50 | 50 |
| Property | Mw | 11000 | $10^5$ | 10000 | 5000 | 6000 | 6100 | 5100 |
| | Mp | 5800 | 15000 | 5800 | 4000 | 3500 | 3600 | 4100 |
| | AV | 23 | 20 | 26 | 20 | 47 | 40 | 32 |
| | HV | 40 | 38 | 35 | 40 | 42 | 45 | 41 |
| | F1/2 | 140 | 141 | 137 | 100 | 145 | 151 | 98 |
| | Tg | 67 | 66 | 62 | 63 | 61 | 62 | 63 |

TABLE 3-continued

| | | A | B | C | D | E | F | G |
|---|---|---|---|---|---|---|---|---|
| | CIC content | 25 | 5 | 8 | 0 | 8 | 30 | 0 |
| Note | Resin | | | | PE(1)** | PE(2)** | PE(2)** | PE(1)** |

Note*
TPA: terephthalic acid
IPA: isophthalic acid
FA: fumaric acid
DSA: dodecenyl succinic anhydride
TA: trimellitic anhydride
EG: ethylene glycol
BAPO: bisphenol A (2,2')propylene oxide
BAEO: bisphenol A (2,2')ethylene oxide
Note**
PE(1): polyester resin (1) mentioned above, which has a softening point of from 90 to 110° C.
PE(2): polyester resin (2) mentioned above, which has a softening point of from 120 to 160° C.

TABLE 4

| | | H | I | J | K | L | M | N |
|---|---|---|---|---|---|---|---|---|
| Acid Component | TPA* | | 70 | | 65 | 70 | 70 | |
| | IPA* | 85 | | | | | | |
| | FA* | | | 85 | | | | 88 |
| | DSA* | | 28 | | 15 | 28 | 28 | |
| | TA* | 15 | 2 | 15 | 20 | 2 | 2 | 12 |
| Alcohol component | EG* | | | | | | | |
| | BAPO* | 70 | 70 | 70 | 70 | 70 | 70 | 70 |
| | BAEO* | 50 | 50 | 50 | 50 | 50 | 50 | 50 |
| Property | Mw | 5800 | 5200 | 10000 | 6000 | 5300 | 5500 | 11000 |
| | Mp | 3600 | 3400 | 7600 | 6000 | 3300 | 4000 | 7700 |
| | AV | 34 | 36 | 25 | 26 | 47 | 39 | 48 |
| | HV | 45 | 32 | 36 | 35 | 38 | 57 | 41 |
| | F1/2 | 145 | 95 | 140 | 138 | 101 | 103 | 140 |
| | Tg | 61 | 64 | 61 | 62 | 62 | 63 | 60 |
| | CIC content | 20 | 0 | 21 | 23 | 0 | 0 | 18 |
| Note | Resin | PE(2) | PE(1) | PE(2) | PE(2) | PE(1) High AV | PE(1) High HV | PE(2) High AV |

TABLE 5

| | | O | P | Q | R | S | T |
|---|---|---|---|---|---|---|---|
| Acid Component | TPA* | | 50 | 70 | | | |
| | IPA* | | 20 | | | | |
| | FA* | 88 | | | 80 | 85 | 75 |
| | DSA* | | 28 | 28 | | | |
| | TA* | 12 | 2 | 2 | 20 | 15 | 25 |
| Alcohol component | EG* | | | | | 20 | 20 |
| | BAPO* | 70 | 70 | 70 | 70 | 70 | 70 |
| | BAEO* | 50 | 50 | 50 | 50 | 50 | 50 |
| Property | Mw | 9800 | 7000 | 5000 | 13000 | 9000 | 32000 |
| | Mp | 7500 | 4500 | 4000 | 8900 | 6400 | 9800 |
| | AV | 38 | 33 | 34 | 36 | 29 | 30 |
| | HV | 53 | 31 | 27 | 34 | 37 | 40 |
| | F1/2 | 143 | 121 | 89 | 166 | 112 | 141 |
| | Tg | 62 | 65 | 62 | 61 | 60 | 62 |
| | CIC content | 23 | 0 | 0 | 23 | 13 | 30 |
| Note | Resin | PE(2) High HV | PE(1) High F1/2 | PE(1) Low F1/2 | PE(2) High F1/2 | PE(1) Low F1/2 | PE(2) Wide MWD*3 |

Note *3
Wide MWD: wide molecular weight distribution

Toner Preparation Example 1

The following components were mixed using a HENSCHEL MIXER.

| | |
|---|---|
| Polyester resin A prepard above | 100 parts |
| Low molecular weight polypropylene (VISCOL 550P from Sanyo Chemical Industries, Ltd.) | 5 parts |
| Carbon black (#44 from Mitsubishi Chemical Corp.) | 10 parts |
| Metal-containing azo compound | 1 part |

The mixture was heated and kneaded for about 30 minutes at a temperature of from 130 to 140° C. using a roll mill. After cooled to room temperature, the kneaded mixture was pulverized with a jet mill, followed by classification using an air classifier. Thus, mother toner particles were prepared. Then a hydrophobized silica was added to the mother toner particles in an amount of 0.5% by weight based on the mother toner particles. Thus, a toner (1), which has a volume average particle diameter of 11.5 μm, was prepared.

Toner Preparation Example 2

The procedure for preparation of toner (1) was repeated except that the pulverization and classification conditions were changed. Thus, a toner (2), which has a volume average particle diameter of 7.5 μm, was prepared.

Toner Preparation Example 3

The procedure for preparation of toner (2) was repeated except that the polyester resin (A) was replaced with the polyester resin (B) prepared above. Thus, a toner (3) was prepared.

Toner Preparation Example 4

The following components were mixed using a HENSCHEL MIXER.

| | |
|---|---|
| Polyester resin C prepared above | 100 parts |
| Oxidized rice wax | 5 parts |
| Carbon black (#44 from Mitsubishi Chemical Corp.) | 10 parts |
| Quaternary ammonium compound | 1 part |

The mixture was heated and kneaded for about 30 minutes at a temperature of from 130 to 140° C. using a roll mill. After cooled to room temperature, the kneaded mixture was pulverized with a jet mill, followed by classification using an air classifier. Thus, mother toner particles were prepared. Then a hydrophobized silica was added to the mother toner particles in an amount of 0.5% by weight. Thus, a toner (4) was prepared.

Toner Preparation Example 5

The following components were mixed using a HENSCHEL MIXER.

| | |
|---|---|
| Polyester resin D prepared above | 50 parts |
| Polyester resin E prepared above | 50 parts |
| Fatty acid eliminated carnauba wax | 5 parts |
| Carbon black (#44 from Mitsubishi Chemical Corp.) | 10 parts |
| Metal-containing azo compound | 1 part |

The mixture was heated and kneaded for about 30 minutes at a temperature of from 130 to 140° C. using a roll mill. After cooled to room temperature, the kneaded mixture was pulverized with a jet mill, followed by classification using an air classifier. Thus, mother toner particles were prepared. Then a hydrophobized silica was added to the mother toner particles in an amount of 0.5% by weight. Thus, a toner (5) was prepared.

Toner Preparation Example 6

The procedure for preparation of toner (5) was repeated except that the polyester resin (E) was replaced with the polyester resin (F) prepared above. Thus, a toner (6) was prepared.

Toner Preparation Example 7

The procedure for preparation of toner (5) was repeated except that the metal-containing azo compound was replaced with a zirconium (IV) salicylate compound. Thus, a toner (7) was prepared.

Toner Preparation Example 8

The following components were mixed using a HENSCHEL MIXER.

| | |
|---|---|
| Polyester resin G prepared above | 45 parts |
| Polyester resin H prepared above | 45 parts |
| Styrene-acrylic resin (Weight average molecular weight (Mw) of 25,800, glass transition temperature (Tg) of 65° C., chloroform-insoluble component content of 3%, softening point (F½) of 140° C., peak molecular weight (Mp) of 4,200) | 15 parts |
| fatty acid eliminated carnauba wax | 5 parts |
| Carbon black (#44 from Mitsubishi Chemical Corp.) | 10 parts |
| Ferric salicylate | 1 part |

The mixture was heated and kneaded for about 30 minutes at a temperature of from 130 to 140° C. using a roll mill. After cooled to room temperature, the kneaded mixture was pulverized with a jet mill, followed by classification using an air classifier. Thus, mother toner particles were prepared. Then a hydrophobized silica was added to the mother toner particles in an amount of 0.5% by weight. Thus, a toner (8) was prepared.

Toner Preparation Example 9

The following components were mixed using a HENSCHEL MIXER.

| | |
|---|---|
| Polyester resin I prepared above | 45 parts |
| Polyester resin J prepared above | 45 parts |
| Styrene-methacrylate copolymer (Weight average molecular weight (Mw) of 20,000, glass transition temperature (Tg) of 65° C., chloroform-insoluble component content of 5%, softening point (F½) of 135° C., peak molecular weight (Mp) of 6,300) | 15 parts |
| Oxidized rice wax (acid value of 15 mgKOH/g) | 5 parts |
| Carbon black (#44 from Mitsubishi Chemical Corp.) | 8 parts |
| Metal-containing azo compound (S-34 from Orient Chemical Industries Co., Ltd.) | 2 parts |

The mixture was heated and kneaded for about 30 minutes at a temperature of from 130 to 140° C. using a roll mill. After cooled to room temperature, the kneaded mixture was pulverized with a jet mill, followed by classification using an air classifier. Thus, mother toner particles were prepared. Then a hydrophobized silica was added to the mother toner particles in an amount of 0.5% by weight. Thus, a toner (9) was prepared.

Toner Preparation Example 10

The procedure for preparation of toner (9) was repeated except that the polyester resin (J) was replaced with the polyester resin (K) prepared above. Thus, a toner (10) was prepared.

Toner Preparation Example 11

The procedure for preparation of toner (9) was repeated except that the polyester resin (I) was replaced with the polyester resin (L) prepared above. Thus, a toner (11) was prepared.

Toner Preparation Example 12

The procedure for preparation of toner (9) was repeated except that the polyester resin (I) was replaced with the polyester resin (M) prepared above. Thus, a toner (12) was prepared.

Toner Preparation Example 13

The procedure for preparation of toner (9) was repeated except that the polyester resin (J) was replaced with the polyester resin (N) prepared above. Thus, a toner (13) was prepared.

Toner Preparation Example 14

The procedure for preparation of toner (9) was repeated except that the polyester resin (J) was replaced with the polyester resin (O) prepared above. Thus, a toner (14) was prepared.

Toner Preparation Example 15

The procedure for preparation of toner (9) was repeated except that the polyester resin (I) was replaced with the polyester resin (P) prepared above. Thus, a toner (15) was prepared.

Toner Preparation Example 16

The procedure for preparation of toner (9) was repeated except that the polyester resin (I) was replaced with the polyester resin (Q) prepared above. Thus, a toner (16) was prepared.

Toner Preparation Example 17

The procedure for preparation of toner (9) was repeated except that the polyester resin (J) was replaced with the polyester resin (R) prepared above. Thus, a toner (17) was prepared.

Toner Preparation Example 18

The procedure for preparation of toner (9) was repeated except that the polyester resin (J) was replaced with the polyester resin (S) prepared above. Thus, a toner (18) was prepared.

Toner Preparation Example 19

The procedure for preparation of toner (9) was repeated except that the polyester resin (J) was replaced with the polyester resin (T) prepared above. Thus, a toner (19) was prepared.

Toner Preparation Example 20

The procedure for preparation of toner (5) was repeated except that the metal-containing azo compound was replaced with zinc (II) salicylate compound. Thus, a toner (20) was prepared.

Toner Preparation Example 21

The following components were mixed using a HENSCHEL MIXER.

| | |
|---|---|
| Styrene-acrylic copolymer (Weight average molecular weight (Mw) of 50,000) | 100 parts |
| hydrogenated petroleum resin (Softening point of 80° C., hydrogenation rate of 50%, prepared by polymerizing C5 and C6 aliphatic hydrocarbons) | 3 parts |
| Carnauba wax (Melting point of 82° C.) | 5 parts |
| Carbon black (#44 from Mitsubishi Chemical Corp.) | 10 parts |
| Metal complex salt dye | 2 parts |

The mixture was heated and kneaded for about 30 minutes at a temperature of from 130 to 140° C. using an extruder. After cooled to room temperature, the kneaded mixture was pulverized with a jet mill while the quantity of the kneaded mixture fed to the jet mill was fixed to 2.0 kg/hr and the pulverization pressure was changed, followed by classification using an air classifier. Thus, mother toner particles having a volume average particle diameter of 10.5 μm were prepared. Then 0.5 parts of a silica (R-972 from Nippon Aerosil Co.) was mixed with 100 parts of the mother toner particles using a HENSCHEL MIXER. Thus, a toner (21) was prepared.

The thus prepared toners (1) to (21) were evaluated as follows.

Volume Average Particle Diameter

The volume average particle diameter of each toner was determined by an instrument, COULTER COUNTER TA II, manufactured by Beckman Coulter Inc.

Molecular Weight Distribution of Toner

The molecular weight distribution of each toner was determined by the method mentioned above. The main peak (Mp) and the half width (HW) of the molecular weight distribution curve were determined. In addition, the percentage of components having a molecular weight not less than 100,000 was also determined.

Content of Chloroform-Insoluble Components in Toner (CIC Content)

The content of chloroform-insoluble components in each toner was determined by the method mentioned above.

Fixability

Each of the toners was set in an image forming apparatus, IMAGIO MF2200 manufactured by Ricoh Co., Ltd., which had been modified such that a TEFLON roller is used as the fixing roller. Copies of an image were produced using a paper TYPE 6200 from Ricoh Co., Ltd., while the fixing temperature was changed to evaluate the low temperature fixability (i.e., the cold offset temperature) and the hot offset resistance (i.e., the hot offset temperature) of the toner. The low temperature fixable temperature of conventional low temperature fixable toners is from about 140 to about 150° C.

(1) Low Temperature Fixability

Images were produced under the following conditions while the fixing temperature was changed to determine the minimum fixing temperature below which the toner causes a cold offset problem.

Paper feeding speed: 120 to 150 mm/s

Fixing pressure: 1.2 kgf/cm$^2$

Nip width (i.e., width of nip between the fixing roller and the pressure roller): 3 mm The low temperature fixability is graded as follows:

◎: The minimum fixing temperature is lower than 130° C.

○: The minimum fixing temperature is not lower than 130° C. and lower than 140° C.

□: The minimum fixing temperature is not lower than 140° C. and lower than 150° C.

Δ: The minimum fixing temperature is not lower than 150° C. and lower than 160° C.

X: The minimum fixing temperature is higher than 160° C.

(2) Hot Offset Resistance

Images were produced under the following conditions while the fixing temperature was changed to determine the maximum fixing temperature above which the toner causes a hot offset problem.

The hot offset resistance is graded as follows:

◎: The maximum fixing temperature is not lower than 201° C.

○: The maximum fixing temperature is from 191° C. to 200° C.

□: The maximum fixing temperature is from 181° C. to 190° C.

Δ: The maximum fixing temperature is from 171° C. to 180° C.

X: The minimum fixing temperature is not higher than 170° C.

High Temperature Preservability

The high temperature preservability of each toner was evaluated by the following penetration method. The procedure is as follows.

1) a toner is contained in a 50 ml container and the container is tapped 50 times;
2) the container is allowed to settle for 24 hours in a chamber heated to 50° C.;
3) the toner in the container is cooled to room temperature; and
4) the toner is subjected to a penetration test in which a needle is penetrated into the toner layer at a predetermined pressure and the length of the part of the needle penetrated into the toner layer is measured.

The high temperature preservability is graded as follows:

◎: The entire toner layer is penetrated by the needle.
○: The penetration length is not less than 25 mm.
□: The penetration length is not less than 20 mm and less than 25 mm.
Δ: The penetration length is not less than 15 mm and less than 20 mm.
X: The penetration length is less than 25 mm.

Fine Line Reproducibility

A one-dot lattice image having line densities in the main scanning direction and sub-scanning direction of 600 dot/inch and 150 line/inch, respectively was produced. The image was observed to determine whether the line image is faithfully reproduced (i.e., whether there are undesired image portions such as narrow, fat or cut line images).

The fine line reproducibility is graded as follows.

◎: The image has no undesired image portion.
○: The image has a very small number of undesired image portions.
□: The image has a small number of undesired image portions.
Δ: The image has a considerable number of undesired image portions.
X: The image has a large number of undesired image portions.

The constituents of the toners are listed in Table 6, and the evaluation results are shown in Tables 7 and 8.

TABLE 6

| Toner | Binder resin: Polyester resin | Binder resin: Other resin | Release agent | Colorant | Charge controlling agent |
|---|---|---|---|---|---|
| (1) | A | No | Low molecular weight polypropylene | Carbon black | Metal-containing azo compound |
| (2) | A | No | Low molecular weight polypropylene | Carbon black | Metal-containing azo compound |
| (3) | B | No | Low molecular weight polypropylene | Carbon black | Metal-containing azo compound |
| (4) | C | No | Oxidized rice wax | Carbon black | Quaternary ammonium compound |
| (5) | D E | No | Free fatty acid eliminated carnauba wax | Carbon black | Metal-containing azo compound |
| (6) | D F | No | Free fatty acid eliminated carnauba wax | Carbon black | Metal-containing azo compound |
| (7) | D E | No | Free fatty acid eliminated carnauba wax | Carbon black | Zirconium(IV) salicylate |

TABLE 6-continued

| Toner | Binder resin: Polyester resin | Binder resin: Other resin | Release agent | Colorant | Charge controlling agent |
|---|---|---|---|---|---|
| (8) | G H | St-MA | Free fatty acid eliminated carnauba wax | Carbon black | Ferric salicylate |
| (9) | I J | St-MMA | Oxidized rice wax | Carbon black | Metal-containing azo compound |
| (10) | I K | St-MMA | Oxidized rice wax | Carbon black | Metal-containing azo compound |
| (11) | L J | St-MMA | Oxidized rice wax | Carbon black | Metal-containing azo compound |
| (12) | M J | St-MMA | Oxidized rice wax | Carbon black | Metal-containing azo compound |
| (13) | I N | St-MMA | Oxidized rice wax | Carbon black | Metal-containing azo compound |
| (14) | I O | St-MMA | Oxidized rice wax | Carbon black | Metal-containing azo compound |
| (15) | P J | St-MMA | Oxidized rice wax | Carbon black | Metal-containing azo compound |
| (16) | Q J | St-MMA | Oxidized rice wax | Carbon black | Metal-containing azo compound |
| (17) | I R | St-MMA | Oxidized rice wax | Carbon black | Metal-containing azo compound |
| (18) | I S | St-MMA | Oxidized rice wax | Carbon black | Metal-containing azo compound |
| (19) | I T | St-MMA | Oxidized rice wax | Carbon black | Metal-containing azo compound |
| (20) | D E | No | Free fatty acid eliminated carnauba wax | Carbon black | Zirconium(IV) salicylate |
| (21) | No No | St-A | carnauba wax | Carbon black | Metal complex salt dye |

TABLE 7

| Toner | Dv (μm) | Mp | Half width of molecular weight distribution curve | Percentage of high molecular components (% by weight) | Content of chloroform-insoluble components (%) |
|---|---|---|---|---|---|
| (1) | 11.5 | 8000 | 13000 | 8 | 20 |
| (2) | 7.5 | 8000 | 13000 | 8 | 20 |
| (3) | 7.5 | 7800 | 12000 | 6 | 2 |
| (4) | 7.5 | 6000 | 10000 | 4 | 14 |
| (5) | 6.5 | 5900 | 9800 | 4 | 14 |
| (6) | 7.5 | 5900 | 9900 | 3 | 15 |
| (7) | 9.5 | 6100 | 11000 | 4 | 9 |
| (8) | 7.5 | 5500 | 9000 | 4 | 9 |
| (9) | 7.5 | 5600 | 9300 | 5 | 5 |
| (10) | 7.5 | 5700 | 9400 | 4 | 9 |
| (11) | 7.5 | 5500 | 9600 | 4 | 10 |
| (12) | 7.5 | 5400 | 9400 | 4 | 6 |
| (13) | 7.5 | 5600 | 9300 | 4 | 11 |
| (14) | 7.5 | 8200 | 13000 | 7 | 9 |
| (15) | 7.5 | 4800 | 9000 | 3 | 9 |
| (16) | 7.5 | 8200 | 12000 | 8 | 11 |
| (17) | 7.5 | 5100 | 8800 | 2 | 6 |
| (18) | 7.5 | 8100 | 15000 | 13 | 18 |
| (19) | 7.5 | 6000 | 10000 | 4 | 14 |
| (20) | 7.5 | 11000 | 300000 | 20 | 0 |
| (21) | 10.5 | 17000 | 200000 | 35 | 5 |

TABLE 8

| Toner | Low temperature fixability | Offset resistance | High temperature preservability | Fine line reproducibility |
|---|---|---|---|---|
| (1) | ○ | ○ | □ | □ |
| (2) | ○ | ○ | □ | ◎ |
| (3) | ○ | □ | □ | ◎ |
| (4) | ◎ | □ | ○ | ◎ |
| (5) | ◎ | ◎ | ○ | ◎ |
| (6) | ◎ | ◎ | ○ | ◎ |
| (7) | ◎ | ◎ | ◎ | ○ |
| (8) | ◎ | ○-◎ | ○ | ◎ |
| (9) | □-○ | ○ | ○ | ◎ |
| (10) | ○ | Δ | ○ | ◎ |
| (11) | ○ | ○-◎ | ○ | ◎ |
| (12) | ○ | X-Δ | ○ | ◎ |
| (13) | ○ | ○-◎ | ○ | ◎ |
| (14) | □ | ○-◎ | ○ | ◎ |
| (15) | ◎ | X-Δ | ○ | ◎ |
| (16) | □ | ○-◎ | ○ | ◎ |
| (17) | ◎ | X-Δ | ○ | ◎ |
| (18) | □-○ | ◎ | ○ | ◎ |
| (19) | ◎ | □-○ | ○ | ◎ |
| (20) | □ | □ | □ | ◎ |
| (21) | Δ | □ | Δ | □ |

Then several examples of the photoreceptor for use in the image forming apparatus of the present invention were prepared and evaluated. The thickness of layers was measured with an eddy current type thickness meter, FISCHERSCOPE MMS manufactured by Fischer Instrument, was used. The thickness of the CGL was determined by measuring the transparency against light having a specific wavelength and using a previously prepared working curve showing the relationship between a transparency of the CGL and a thickness thereof.

Photoreceptor Preparation Example 1

Formation of Undercoat Layer

At first, an aluminum pipe having a diameter of 30 mm and a length of 350 mm which had been subjected to a cutting treatment to prevent occurrence of a moiré image was dipped into a 5% methanol solution of a polyamide resin (CM8000 from Toray Industries, Inc.), followed by drying, to form an undercoat layer having a thickness of 0.3 μm on the peripheral surface of the pipe.

Formation of CGL

The following components were mixed and dispersed for 20 hours using a sand mill including glass beads having a diameter of 1 mm.

| | |
|---|---|
| Oxytitanium phthalocyanine (having an X-ray diffraction spectrum having strong peaks at Bragg (2θ) angles of 9.0°, 14.2°, 23.9° and 27.1° (±0.2°) | 10 parts |
| Polyvinyl butyral (S-LEC BM2 from Sekisui Chemical Co., Ltd.) | 10 parts |
| Cyclohexanone | 60 parts |

The dispersion was mixed with 100 parts of methyl ethyl ketone. Thus, a CGL coating liquid was prepared.

The aluminum pipe with the undercoat layer was dipped into the above-prepared CGL coating liquid, followed by drying. Thus, a CGL having a thickness of 0.12 μm was prepared.

Formation of CTL

The following components were mixed to prepare a CTL coating liquid.

| | |
|---|---|
| CTM having the following formula (13) | 10 parts |

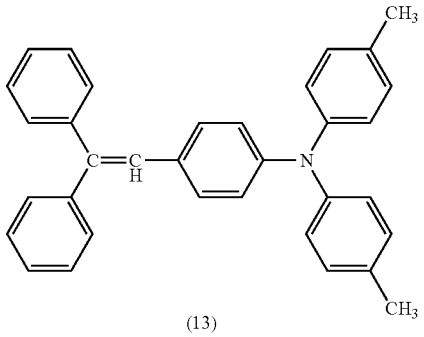

(13)

| | |
|---|---|
| Z-form polycarbonate resin (weight average molecular weight (Mw) of 28000) | 12 parts |
| Monochlorobenzene | 60 parts |

The thus prepared CTL coating liquid was coated on the surface of the CGL, followed by drying. Thus, a CTL having a thickness of 20 μm was prepared.

Formation of CCTL

The following components were mixed to prepare a CCTL coating liquid.

| | |
|---|---|
| Trimethylolpropane triacrylate (KAYARAD TMPTA from Nippon Kayaku Co., Ltd., which is a radical polymerizable trifunctional monomer having no charge transport structure, molecular weight of 296, a ratio (Mw/F) of the molecular weight (Mw) to the number of functional groups (F) of 99) | 10 parts |
| Compound No. 54 mentioned above (serving as a radical polymerizable monofunctional monomer having a charge transport structure) | 10 parts |
| 1-hydroxycyclohexyl phenyl ketone (photopolymerization initiator, IRGACURE 184 from Chiba Specialty Chemicals) | 1 part |
| Tetrahydrofuran | 100 parts |

The thus prepared CCTL coating liquid was coated on the CTL by a spray coating method, followed by natural drying. Then the coated layer was exposed to light emitted by a metal halide lamp under the following conditions:

Distance between the lamp and coated layer: 120 mm

Illuminance intensity: 500 mW/cm$^2$

Illumination time: 60 sec

The layer was then heated for 20 minutes at 130° C. Thus, a CCTL having a thickness of 5.0 μm was prepared.

Thus a photoreceptor (1) was prepared.

Photoreceptor Preparation Example 2

The procedure for preparation of the photoreceptor (1) was repeated except that the thickness of the CCTL was changed from 5.0 μm to 2.0 μm. Thus, a photoreceptor (2) was prepared.

Photoreceptor Preparation Example 3

The procedure for preparation of the photoreceptor (1) was repeated except that the thickness of the CCTL was changed from 5.0 μm to 8.0 μm. Thus, a photoreceptor (3) was prepared.

Photoreceptor Preparation Example 4

Formation of Undercoat Layer

The following components were mixed to prepare an undercoat layer coating liquid.

| | |
|---|---|
| Titanium chelate compound (TC-750 from Matsumoto Chemical Industry Co., Ltd.) | 30 parts |
| Silane coupling agent | 17 parts |
| 2-propanol | 150 parts |

Then an aluminum drum which has a diameter of 80 mm and a length of 355 mm and whose peripheral surface has a ten-point mean roughness of 1.5 μm was dipped into the undercoat layer, followed by drying for 1 hour at 120° C. Thus, an undercoat layer having a thickness of 1.0 μm was formed on the peripheral surface of the aluminum substrate.

Formation of CGL

The following components were mixed.

| | |
|---|---|
| Oxytitanium phthalocyanine (same as that used in Photoreceptor Preparation Example 1) | 60 g |
| Xylene/butanol solution of silicone resin (KR5240 from Shin-Etsu Chemical Co., Ltd., solid content of 15% by weight) | 700 g |
| 2-butanone | 2000 ml |

The mixture was subjected to a dispersion treatment for 10 hours using a sand mill. Thus, a CGL coating liquid was prepared. Then the aluminum drum having the undercoat layer thereon was dipped into the CGL coating liquid, followed by drying. Thus, a CGL having a thickness of 0.2 μm was formed on the undercoat layer.

Formation of CTL

The following components were mixed to prepare a CTL coating liquid.

| | |
|---|---|
| 4-methoxy-4'-(4-methyl-α-phenylstyryl)triphenylamine | 200 g |
| Z-form bisphenol A polycarbonate (IUPILON Z300 from Mitsubishi Gas Chemical Co., Inc.) | 300 g |
| 1,2-dichloroethane | 2000 ml |

Then the aluminum drum having the undercoat layer and CGL thereon was dipped into the CTL coating liquid, followed by drying. Thus, a CTL having a thickness of 25 μm was prepared.

Formation of CCTL

The following components were mixed.

| | |
|---|---|
| Trimethoxymethyl silane | 180 g |
| 1-butanol | 280 ml |
| 1% aqueous solution of acetic acid | 106 ml |

The mixture was agitated at 60° C. for 2 hours.

Then 370 ml of 1-butanol was added thereto and the mixture was agitated for 48 hours. Further, 67.5 g of dihydroxymethyltriphenylamine (i.e., a difunctional compound having a charge transport structure), 1.7 g of antioxidant (SANOL LS2626 from Sankyo Co. Ltd.) and 4.5 g of dibutyltin acetate were added thereto. Thus, a resin layer coating liquid was prepared. The coating liquid was coated on the CTL, and then the coated layer was heated for 1 hour at 120° C. to be crosslinked. Thus, a resin layer having a thickness of 1 μm was formed on the CTL.

Thus, a photoreceptor (4) was prepared.

Photoreceptor Preparation Example 5

The procedure for preparation of the photoreceptor (1) was repeated except that a protective layer having a thickness of 3 μm was formed on the CTL instead of the CCTL.

The protective layer was formed by coating the following protective layer coating liquid.

| | |
|---|---|
| A-form polycarbonate | 10 parts |
| CTM having formula (13) | 8 parts |
| Particulate alumina (average particle diameter of 0.2 μm) | 4 parts |
| Tetrahydrofuran | 400 parts |
| Cyclohexanone | 150 parts |

Thus, a photoreceptor (5) was prepared. It was confirmed that the photosensitive layer has a total thickness of 22 μm.

Photoreceptor Preparation Example 6

The procedure for preparation of the photoreceptor (1) was repeated except that the CCTL was not formed on the CTL.

Thus, a photoreceptor (6) was prepared. It was confirmed that the photosensitive layer (i.e., a combination of the CGL and CTL) has a thickness of 25 μm.

Examples 1 to 20 and Comparative Examples 1 to 4

Combinations of the photoreceptors (1) to (6) and the toners (1) to (21) which are listed in Tables 9 and 10 were evaluated by the following method.

Image Forming Apparatus Used for Evaluation

A tandem-type digital color printer (IPSIO 8200 manufactured by Ricoh Co., Ltd. which is modified such that the drum heater is removed therefrom), which has a structure illustrated in FIG. 9, was used for evaluation. The image forming conditions were as follows.

Light source: Laser diode

Developing method: reverse developing method

Developing bias: −850 V

Material of cleaning blade: polyurethane

Hardness of cleaning blade: 70° (JIS A hardness)

Repulsion elasticity of cleaning blade: 25 kg/cm$^2$

Thickness of cleaning blade: 2 mm

Length of free portion: 9 mm

Contact angle θ: 20° (blade was set so as to counter the photoreceptor)

Contact pressure (P): 20 g/cm

Copy Test

Ten thousand (10,000) copies of a character image having an image area proportion of 7% were intermittently produced under conditions of 35° C. in temperature and 80% RH in relative humidity. This running test was repeated ten times with an 8-hour pause therebetween. Thus, one hundred thousand copies in total were produced using each of the combinations listed in Tables 9 and 10. The evaluation items are the following.

(1) Abrasion Loss of Photosensitive Layer

The thickness of the photosensitive layer was measured before and after the copy test to determine the difference of the thickness (i.e., the abrasion loss of the photosensitive layer).

(2) Checking of Undesired Images

The 20,000$^{th}$ ($2\times10^4$), 50,000$^{th}$ ($5\times10^4$) and 100,000$^{th}$ ($1\times10^5$) images were visually observed to determine whether the images have undesired images such as rice-fish-form images, and black spot images (having a diameter not less than 0.3 mm) and whether the images are relatively blurred compared to images produced under normal temperature and normal humidity. In addition, the surface of the photoreceptor was visually observed to determine whether the surface has a scratch having a width not less than 0.2 mm.

Each of the undesired images and scratch was classified into the following five ranks.

◎: The image has few undesired images (or scratches).

○: The image has a few undesired images (or scratches).

Δ: The image has several undesired images (or scratches).

X: The image has a number of undesired images (or scratches).

XX: The running test was suspended because the photoreceptor has poor durability.

TABLE 9

| | | | Rice-fish-form image | | | Black spot image | | |
|---|---|---|---|---|---|---|---|---|
| | Toner | Photoreceptor | $2\times10^4$ | $5\times10^4$ | $1\times10^5$ | $2\times10^4$ | $5\times10^4$ | $1\times10^5$ |
| Ex. 1 | (1) | (1) | ◎ | ◎ | ○ | ◎ | ◎ | ○ |
| Ex. 2 | (2) | (1) | ◎ | ◎ | ○-Δ | ◎ | ◎ | ○ |
| Ex. 3 | (3) | (1) | ◎ | ◎ | Δ | ◎ | ◎ | ○-Δ |
| Ex. 4 | (4) | (1) | ◎ | ◎ | ○-Δ | ◎ | ◎ | ○ |
| Ex. 5 | (5) | (1) | ◎ | ◎ | Δ | ◎ | ○ | Δ |
| Ex. 6 | (6) | (1) | ◎ | ◎ | ○ | ◎ | ◎ | ◎-○ |
| Ex. 7 | (7) | (1) | ◎ | ◎ | ○ | ◎ | ◎ | ○ |
| Ex. 8 | (8) | (1) | ◎ | ◎ | ○ | ◎ | ◎ | ○ |
| Ex. 9 | (9) | (1) | ◎ | ◎ | ○ | ◎ | ○ | Δ |
| Ex. 10 | (10) | (2) | ◎-○ | ◎-○ | ○ | ◎ | ◎ | ○ |
| Ex. 11 | (11) | (2) | ◎ | ◎ | ○ | ◎ | ◎ | ○-Δ |
| Ex. 12 | (12) | (2) | ◎ | ◎ | ○ | ◎ | ◎ | ○ |
| Ex. 13 | (13) | (3) | ◎ | ◎ | ○-Δ | ◎ | ◎ | ○ |
| Ex. 14 | (14) | (3) | ◎ | ◎ | Δ | ◎ | ○ | Δ |
| Ex. 15 | (15) | (3) | ◎ | ○ | ○-Δ | ◎ | ○ | ○-Δ |
| Ex. 16 | (16) | (3) | ◎ | ◎ | Δ | ◎ | ◎ | ○ |
| Ex. 17 | (17) | (3) | ◎ | ◎ | ○ | ◎ | ○ | Δ |
| Ex. 18 | (18) | (3) | ◎ | ◎ | ○ | ◎ | ○ | ○ |
| Ex. 19 | (19) | (3) | ◎-○ | ○ | ○ | ◎ | ◎ | ○ |
| Ex. 20 | (20) | (2) | ○ | ○ | Δ | ○ | ○ | ○ |
| Comp. Ex. 1 | (21) | (6) | ○ | Δ | XX | ○ | Δ | XX |
| Comp. Ex. 2 | (6) | (4) | ◎ | ◎ | ◎ | ◎ | ◎ | ◎ |
| Comp. Ex. 3 | (7) | (5) | ○ | Δ | X | Δ-X | X | X |
| Comp. Ex. 4 | (8) | (6) | X | X | XX | ○ | X | XX |

TABLE 10

| | Blurred image | | | Scratch on the surface of photoreceptor | | | Abrasion loss (μm) | | |
|---|---|---|---|---|---|---|---|---|---|
| | $2\times10^4$ | $5\times10^4$ | $1\times10^5$ | $2\times10^4$ | $5\times10^4$ | $1\times10^5$ | $2\times10^4$ | $5\times10^4$ | $1\times10^5$ |
| Ex. 1 | ◎ | ◎ | ◎ | ◎ | ◎ | ○-Δ | 0.40 | 0.93 | 2.0 |
| Ex. 2 | ◎ | ◎ | ○ | ◎ | ◎ | ◎-○ | 0.35 | 0.81 | 1.7 |
| Ex. 3 | ◎ | ◎ | ○ | ◎ | ◎ | ○ | 0.40 | 0.89 | 1.82 |
| Ex. 4 | ◎ | ◎ | ○ | ◎ | ◎ | ○ | 0.38 | 0.83 | 1.80 |

TABLE 10-continued

| | Blurred image | | | Scratch on the surface of photoreceptor | | | Abrasion loss (μm) | | |
|---|---|---|---|---|---|---|---|---|---|
| | $2 \times 10^4$ | $5 \times 10^4$ | $1 \times 10^5$ | $2 \times 10^4$ | $5 \times 10^4$ | $1 \times 10^5$ | $2 \times 10^4$ | $5 \times 10^4$ | $1 \times 10^5$ |
| Ex. 5 | ◎ | ◎ | ○ | ◎ | ○ | ○ | 0.32 | 0.90 | 1.75 |
| Ex. 6 | ◎ | ◎ | ○-Δ | ◎ | ◎ | ◎-○ | 0.34 | 0.81 | 1.88 |
| Ex. 7 | ◎ | ◎ | ○ | ◎ | ◎ | ○ | 0.34 | 0.82 | 1.88 |
| Ex. 8 | ◎ | ◎ | ○ | ◎ | ◎ | ○ | 0.34 | 0.83 | 1.81 |
| Ex. 9 | ◎ | ◎ | ○ | ◎ | ◎ | ○ | 0.35 | 0.90 | 1.77 |
| Ex. 10 | ◎ | ◎ | ○ | ◎ | ◎ | ○ | 0.32 | 0.94 | 1.80 |
| Ex. 11 | ◎ | ◎ | ○ | ◎ | ◎ | ○ | 0.30 | 0.86 | 1.86 |
| Ex. 12 | ◎ | ○ | Δ | ◎ | ◎ | ◎-○ | 0.31 | 0.75 | 1.90 |
| Ex. 13 | ◎ | ◎ | ○ | ◎ | ◎ | ○ | 0.32 | 0.80 | 1.88 |
| Ex. 14 | ◎ | ◎ | ○ | ◎ | ◎ | ○ | 0.36 | 0.86 | 1.86 |
| Ex. 15 | ◎ | ◎ | ○ | ◎ | ◎ | ○-Δ | 0.33 | 0.85 | 1.85 |
| Ex. 16 | ◎ | ◎ | ○-Δ | ◎ | ◎ | ○ | 0.38 | 0.79 | 1.89 |
| Ex. 17 | ◎ | ◎ | ○ | ◎ | ○ | ○ | 0.32 | 0.74 | 1.75 |
| Ex. 18 | ◎ | ◎ | ○ | ◎ | ○ | ○ | 0.31 | 0.72 | 1.79 |
| Ex. 19 | ◎ | ◎ | ○ | ◎ | ◎ | ○ | 0.30 | 0.69 | 1.84 |
| Ex. 20 | ○ | ○ | ○ | ◎ | ◎ | ○ | 0.35 | 0.90 | 1.80 |
| Comp. Ex. 1 | ○ | ○ | XX | ○ | Δ | XX | 1.50 | 3.00 | XX |
| Comp. Ex. 2 | Δ-X | X | X | ◎ | ◎ | ◎ | 0.03 | 0.08 | 0.15 |
| Comp. Ex. 3 | Δ | X | X | ○ | ○ | ○ | 0.08 | 0.19 | 0.35 |
| Comp. Ex. 4 | ○ | ○ | XX | X | X | XX | 1.60 | 3.10 | XX |

It is clear from Tables 9 and 10 that combinations (i.e., Examples 1 to 20) of a photoreceptor which includes a substrate, and a charge generation layer, a charge transport layer and a crosslinked charge transport layer, wherein the crosslinked charge transport layer includes a compound obtained by polymerizing radical polymerizable monomers including a first monomer having three or more functional groups and no charge transport structure and a second monomer having one functional group and a charge transport structure; and a toner which includes a binder resin, a colorant, and a release agent, wherein tetrahydrofuran(THF)-soluble components included in the binder resin have a molecular weight distribution such that at least one peak is observed in a range of from 1,000 to 10,000 and the half-width of the molecular weight distribution curve is not greater than 15,000, can produce high quality images for a long period of time with hardly causing undesired images such as rice-fish-form images (which are caused by free external additives of the toner used), blurred images and black spot (or streak) images.

Since the image forming method and apparatus have such advantages as mentioned above, they can be preferably used for full color copiers, full color laser printers, full color facsimile machines, and the like electrophotographic image forming apparatus using a direct or indirect developing method.

This document claims priority and contains subject matter related to Japanese Patent Application No. 2004-188616, filed on Jun. 25, 2004, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secure by Letters Patent of the United States is:

1. An image forming method comprising:

forming an electrostatic latent image on an image bearing member;

developing the electrostatic latent image with a developer comprising a toner to form a toner image on the image bearing member;

transferring the toner image onto a receiving material; and fixing the toner image on the receiving material, wherein the image bearing member comprises a substrate, and a charge generation layer, a charge transport layer and a crosslinked charge transport layer, which are located overlying the substrate in this order, wherein the crosslinked charge transport layer comprises a compound obtained by polymerizing radical polymerizable monomers comprising a first monomer having three or more radical polymerizable functional groups and no charge transport structure and a second monomer having one radical polymerizable functional group and a charge transport structure, and wherein the toner comprises a binder resin, a colorant, and a release agent, wherein tetrahydrofuran-soluble components comprised within the binder resin have a molecular weight distribution such that at least one peak is observed in a range of from 1,000 to 10,000 and a half-width of a molecular weight distribution curve is not greater than 15,000 when the molecular weight distribution is determined by gel permeation chromatography.

2. The image forming method according to claim 1, wherein the thickness of the crosslinked charge transport layer is from 2 to 8 μm.

3. The image forming method according to claim 1, wherein the first and second monomers each have at least one of an acryloyloxy group and a methacryloyloxy group as a radical polymerization functional group.

4. The image forming method according to claim 1, wherein the tetrahydrofuran-soluble components comprise components having a molecular weight not less than $10^5$ in an amount of not greater than 10% by weight.

5. The image forming method according to claim 1, wherein the binder resin of the toner comprises a polyester resin.

6. The image forming method according to claim 5, wherein the polyester resin has an acid value from 8 to 45 mgKOH/g, and a hydroxyl value not greater than 50 mgKOH/g.

7. The image forming method according to claim 1, wherein the binder resin comprises chloroform-insoluble components in an amount less than that of chloroform-soluble components comprised within the binder resin.

8. The image forming method according to claim 7, wherein the binder resin comprises chloroform-insoluble components in an amount from 5 to 40% by weight based on a weight of the binder resin.

9. The image forming method according to claim 1, wherein the binder resin has an island-sea structure such that a first resin component is dispersed as islands in a sea of a second resin component, wherein the first resin component has a higher molecular weight than the second resin component.

10. The image forming method according to claim 1, wherein the half-width of the molecular distribution curve is not greater than 10,000.

11. The image forming method according to claim 1, wherein the binder resin comprises at least a first resin and a second resin, wherein a softening point of the first resin is not less than 25° C. higher than that of the second resin, and wherein the first and second resins each comprise tetrahydrofuran-soluble components having a molecular weight distribution such that a peak is observed in a range of from 1,000 to 10,000.

12. The image forming method according to claim 11, wherein the tetrahydrofuran-soluble components of the first and second resins each comprise components having a molecular weight not less than $10^5$ in an amount of not greater than 10% by weight.

13. The image forming method according to claim 12, wherein the first resin further comprises chloroform-insoluble components in an amount less than that of chloroform-soluble components comprised within in the first resin.

14. The image forming method according to claim 11, wherein the first resin further comprises chloroform-insoluble components in an amount of from 5 to 40% by weight based on a weight of the first resin.

15. The image forming method according to claim 11, wherein the first and second resins are polyester resins.

16. The image forming method according to claim 15, wherein the first resin is obtained from monomers comprising a first polybasic carboxylic acid selected from the group consisting of benzenecarboxylic acids, benzenecarboxylic acid anhydrides, unsaturated dicarboxylic acids and unsaturated dicarboxylic acid anhydrides and has a softening point of from 120 to 160° C., and the second resin is obtained from monomers comprising a second polybasic carboxylic acid which is selected from the group consisting of benzenecarboxylic acids, benzenecarboxylic acid anhydrides, unsaturated dicarboxylic acids and unsaturated dicarboxylic acid anhydrides and which is different from the first polybasic carboxylic acid and has a softening point of from 90 to 110° C.

17. The image forming method according to claim 1, wherein the release agent of the toner is one selected from the group consisting of free fatty acid eliminated carnauba waxes, montan waxes and oxidized rice waxes.

18. The image forming method according to claim 1, wherein the toner further comprises a salicylic acid metal salt.

19. The image forming method according to claim 18, wherein the metal of the salicylic acid metal salt is at least trivalent and has a coordination number of 6.

20. The image forming method according to claim 1, wherein the toner has a volume average particle diameter from 5 to 10 μm.

21. An image forming apparatus comprising:

an image bearing member configured to bear an electrostatic latent image thereon;

a developing device configured to develop the electrostatic latent image with a developer comprising a toner to form a toner image on the image bearing member;

a transfer device configured to transfer the toner image onto a receiving material; and a fixing device configured to fix the toner image on the receiving material, wherein the image bearing member comprises a substrate, and a charge generation layer, a charge transport layer and a crosslinked charge transport layer, which are located overlying the substrate in this order, wherein the crosslinked charge transport layer comprises a compound obtained by polymerizing radical polymerizable monomers comprising a first monomer having three or more radical polymerizable functional groups and no charge transport structure and a second monomer having one radical polymerizable functional group and a charge transport structure, and wherein the toner comprises a binder resin, a colorant, and a release agent, wherein tetrahydrofuran-soluble components comprised within in the binder resin have a molecular weight distribution such that at least one peak is observed in a range of from 1,000 to 10,000 and a half-width of a molecular weight distribution curve is not greater than 15,000 when the molecular weight distribution is determined by gel permeation chromatography.

22. A process cartridge comprising:

an image bearing member configured to bear an electrostatic latent image thereon; and a developing device configured to develop the electrostatic latent image with a developer comprising a toner to form a toner image on the image bearing member, wherein the image bearing member comprises a substrate, and a charge generation layer, a charge transport layer and a crosslinked charge transport layer, which are located overlying the substrate in this order, wherein the crosslinked charge transport layer comprises a compound obtained by polymerizing radical polymerizable monomers comprising a first monomer having three or more radical polymerizable functional groups and no charge transport structure and a second monomer having one radical polymerizable functional group and a charge transport structure, and wherein the toner comprises a binder resin, a colorant, and a release agent, wherein tetrahydrofuran-soluble components comprised within in the binder resin have a molecular weight distribution such that at least one peak is observed in a range of from 1,000 to 10,000 and a half-width of a molecular weight distribution curve is not greater than 15,000 when the molecular weight distribution is determined by gel permeation chromatography.

* * * * *

UNITED STATES PATENT AND TRADEMARK OFFICE

CERTIFICATE OF CORRECTION

PATENT NO. : 7,662,533 B2
APPLICATION NO. : 11/165279
DATED : February 16, 2010
INVENTOR(S) : Ohshima et al.

It is certified that error appears in the above-identified patent and that said Letters Patent is hereby corrected as shown below:

On the title page, Item (45), the Terminal Disclaimer information has been omitted. Item (45) and the Notice information should read as follows:

--(45) **Date of Patent: *Feb. 16, 2010**

(*) Notice: Subject to any disclaimer, the term of this patent is extended or adjusted under 35 U.S.C. 154(b) by 578 days.

This patent is subject to a terminal disclaimer.--

Signed and Sealed this

Thirteenth Day of April, 2010

David J. Kappos

David J. Kappos
*Director of the United States Patent and Trademark Office*